US012163328B2

(12) United States Patent
Ligeti et al.

(10) Patent No.: US 12,163,328 B2
(45) Date of Patent: Dec. 10, 2024

(54) SELF-SEALING BUILDING MODULE WITH A SELF-ALIGNING CONNECTOR

(71) Applicant: QUBE Building Systems Inc., Vancouver (CA)

(72) Inventors: Fred Ligeti, Vancouver (CA); Mark Stephenson, Vancouver (CA)

(73) Assignee: QUBE Building Systems Inc., Vancouver (CA)

( * ) Notice: Subject to any disclaimer, the term of this patent is extended or adjusted under 35 U.S.C. 154(b) by 0 days.

(21) Appl. No.: 16/963,649

(22) PCT Filed: Jan. 22, 2019

(86) PCT No.: PCT/CA2019/050080
§ 371 (c)(1),
(2) Date: Jul. 21, 2020

(87) PCT Pub. No.: WO2019/144224
PCT Pub. Date: Aug. 1, 2019

(65) Prior Publication Data

US 2021/0062495 A1 Mar. 4, 2021

Related U.S. Application Data

(60) Provisional application No. 62/620,725, filed on Jan. 23, 2018.

(51) Int. Cl.
*E04B 1/348* (2006.01)
*E04B 1/38* (2006.01)
*E04B 1/41* (2006.01)

(52) U.S. Cl.
CPC ..... *E04B 1/34861* (2013.01); *E04B 1/388* (2023.08)

(58) Field of Classification Search
CPC ..... E04B 1/34861; E04B 1/40
(Continued)

(56) References Cited

U.S. PATENT DOCUMENTS 3,752,511 A * 8/1973 Racy ..... B65D 90/0013 410/82
3,824,750 A * 7/1974 Antoniou ..... E04B 1/3483 52/223.4

(Continued)

FOREIGN PATENT DOCUMENTS

DE 3715434 A1 12/1988
KR 20160074746 6/2016

(Continued)

*Primary Examiner* — James J Buckle, Jr.
(74) *Attorney, Agent, or Firm* — Nexus Law Group LLP; Nicholas P. Toth

(57) ABSTRACT

A self-aligning module for a self-sealing modular building includes a male connector projecting from a first side of the module to form a cylindrical projection terminated by a terminus having a hemispherical shape, the male connector being dimensioned for being received by a female connector having an aperture dimensioned to receive the terminus and at least a portion of the cylindrical projection so as to permit the module to be connected to the female connector by off-level installation. The module may include a module gasket for self-sealing against an adjacent module.

A method of assembling the modular building involves: (a) off-level contacting the terminus to the female connector; and (b) aligning the module and the adjacent module such that the cylindrical projection is received by the female connector. The male connector may be bolted to the female connector, bolted to another male connector, and/or locked by a key-lock system.

18 Claims, 77 Drawing Sheets

(58) Field of Classification Search
USPC ..... 52/79.9
See application file for complete search history.

(56) References Cited

U.S. PATENT DOCUMENTS

| | | | | |
|---|---|---|---|---|
| 3,894,494 | A * | 7/1975 | Erith | B65D 90/0013 410/83 |
| 3,938,461 | A | 2/1976 | Marriner | |
| 3,966,285 | A * | 6/1976 | Porch | B65D 7/24 312/263 |
| 4,214,404 | A * | 7/1980 | Fischer | A63H 33/102 403/3 |
| 4,435,927 | A * | 3/1984 | Umezu | E04B 1/3483 52/235 |
| 4,507,032 | A * | 3/1985 | Rosaia | B60P 7/132 410/83 |
| 4,599,829 | A * | 7/1986 | DiMartino, Sr. | E04B 1/3483 52/106 |
| 5,771,650 | A | 6/1998 | Williams et al. | |
| 6,390,742 | B1 * | 5/2002 | Breeden | B65D 90/0013 410/82 |
| 6,625,937 | B1 * | 9/2003 | Parker | E04H 1/02 52/79.9 |
| 7,827,940 | B2 * | 11/2010 | Silverman | A01K 63/003 119/474 |
| 7,922,413 | B2 * | 4/2011 | Roth | F16B 5/0628 403/59 |
| 8,001,730 | B2 * | 8/2011 | Wallance | E04B 1/34331 52/79.1 |
| 8,177,178 | B2 * | 5/2012 | Carnevali | F16M 11/2078 248/223.41 |
| 8,776,326 | B2 * | 7/2014 | Clarke | F16B 21/186 24/297 |
| D720,205 | S * | 12/2014 | Reynard | B65D 90/0013 D8/343 |
| 9,103,111 | B2 * | 8/2015 | Nakajima | E04B 1/3442 |
| 9,140,294 | B2 * | 9/2015 | Burton | F16C 11/069 |
| 9,347,222 | B2 * | 5/2016 | Bottin | E04H 1/005 |
| 9,458,619 | B2 | 10/2016 | Bowron et al. | |
| 9,845,595 | B2 * | 12/2017 | Bowron | E04B 1/34326 |
| 10,301,813 | B1 * | 5/2019 | Hawkins | E04B 1/34336 |
| 10,676,239 | B2 * | 6/2020 | Allegretti | B65D 19/06 |
| 10,689,155 | B2 * | 6/2020 | Sullivan | B65D 11/1873 |
| 10,689,840 | B2 * | 6/2020 | Bonlin | E04H 1/005 |
| 10,926,940 | B2 * | 2/2021 | Allegretti | B65D 19/08 |
| 11,105,088 | B2 * | 8/2021 | Binder | E04C 3/07 |
| 11,118,348 | B2 * | 9/2021 | Strickland | E04B 2/88 |
| 11,209,033 | B2 * | 12/2021 | Spitzer | F16B 21/073 |
| 11,255,364 | B2 * | 2/2022 | Phillips | F16B 12/26 |
| 11,479,961 | B2 * | 10/2022 | Bowron | E04B 1/3483 |
| 2007/0271857 | A1 * | 11/2007 | Heather | B65D 90/006 52/79.9 |
| 2008/0134589 | A1 * | 6/2008 | Abrams | E04B 1/34807 52/79.1 |
| 2011/0016802 | A1 * | 1/2011 | Wallance | E04B 1/34384 52/79.9 |
| 2012/0006369 | A1 * | 1/2012 | Cantin | E04B 1/3444 135/96 |
| 2012/0037198 | A1 * | 2/2012 | Cantin | E04B 1/3442 220/1.5 |
| 2013/0305629 | A1 * | 11/2013 | Stephenson | E04B 1/3483 52/79.9 |
| 2014/0298745 | A1 * | 10/2014 | Rechenmacher | E04H 1/005 52/425 |
| 2014/0325931 | A1 * | 11/2014 | Prodaniuk | E04H 15/02 52/656.9 |
| 2015/0075271 | A1 * | 3/2015 | Tracy | G01M 17/027 73/146 |
| 2016/0002909 | A1 * | 1/2016 | Bowron | E04B 1/1903 52/745.03 |
| 2016/0040443 | A1 | 2/2016 | Stephenson et al. | |
| 2016/0160515 | A1 * | 6/2016 | Wallance | E04F 10/10 52/745.02 |
| 2019/0153720 | A1 * | 5/2019 | Bonlin | E04B 1/388 |

FOREIGN PATENT DOCUMENTS

| | | |
|---|---|---|
| WO | 2006122372 | 11/2006 |
| WO | 2010031129 | 3/2010 |
| WO | 2017/027965 A1 | 2/2017 |
| WO | 2017185125 | 11/2017 |

* cited by examiner

SELF-SEALING BUILDING MODULE WITH A SELF-ALIGNING CONNECTOR

BACKGROUND OF THE INVENTION

1. Field of Invention

This invention relates to modular building construction and assembly technology, and in particular to a self-sealing building module having a self-aligning connector.

2. Description of Related Art

Modular building systems have been developed for residential, commercial and industrial applications.

United States patent application publication No. 2016/0040443 to Stephenson et al. discloses a modular building system in which self-supporting modules are fabricated at a manufacturing facility and then transported to a building site. On site, a modular building is assembled using a variety of specialized, interchangeable adaptors to attach the modules to each other horizontally and vertically. To ensure proper alignment of the specialized adaptors during installation of each additional module onto a set of already attached modules, the additional module is positioned level to the already attached modules as it approaches its installation location. To prevent the additional module from sliding against an adjacent module during on-level installation, an open space between modules can be provided.

However, the plurality of specialized adaptors of the modular building system of Stephenson et al. imposes a burden on inventory management and carries the risk that an incorrectly installed specialized adaptor may prevent installation of a module on-site. Also, the open space between modules associated with on-level installation necessitates further on-site work to form a water resistant and airtight connection between modules. Not providing the open space can cause an assembly failure due to binding between a descending module and its adjacent module, or cause wear or otherwise damage adjacent modules during the on-level installation procedure.

An object of the invention is to address the above shortcomings.

SUMMARY

The above shortcomings may be addressed by providing, in accordance with one aspect of the invention, a module for a modular building. The module includes a male connector projecting from a first side of the module to form a projection terminated by a terminus having a hemispherical shape, the male connector being dimensioned for being received by a first instance of a female connector having an aperture dimensioned to receive the terminus and at least a portion of the projection so as to permit the module to be connected to the first instance of the female connector by off-level installation.

The module may include one male connector disposed at each corner of one face of the module. The module may include one male connector disposed at each corner of a bottom face of the module. The module may include one male connector disposed at each corner of a top face of the module. The module may include four male connectors disposed at four corners of one face of the module, respectively. The module may include four male connectors disposed at four corners of the bottom face of the module, respectively. The module may include four male connectors disposed at four corners of the top face of the module, respectively.

The module may include the female connector. The module may include one female connector disposed at each corner of one face of the module. The module may include one female connector disposed at each corner of a top face of the module. The module may include one female connector disposed at each corner of a bottom face of the module. The module may include four female connectors disposed at four corners of one face of the module, respectively. The module may include four female connectors disposed at four corners of the top face of the module, respectively. The module may include four female connectors disposed at four corners of the bottom face of the module, respectively.

The module may include a second instance of the female connector. The male connector and the second instance of the female connector may be disposed at opposing ends of the module. The module may include a plurality of sets of the male connector and the second instance of the female connector disposed at opposing ends of the module. The module may include four of the sets disposed at corner edges of the module. The module may include a connection column. The connection column may include the male connector at a first end of the connection column. The connection column may include the female connector at a second end of the column opposite the first end. The connection column may be disposed vertically within the module. The connection column may be disposed horizontally within the module. The module may include one connection column disposed at each corner edge of the module. The module may include four connection columns disposed at four corner edges of the module, respectively. The connection columns may be disposed such that the male connectors of the connection columns are disposed at the bottom of the module. The connection columns may be disposed such that the female connectors of the connection columns are disposed at the top of the module. The connection columns may be disposed such that the male connectors of the connection columns are disposed at the top of the module. The connection columns may be disposed such that the female connectors of the connection columns are disposed at the bottom of the module.

The module may include a module gasket. The module gasket may be dimensioned such that the module is self-sealing. The module gasket may be dimensioned such that the module self-seals against an adjacent module in the modular building. The module gasket may be a vertical membrane gasket. The module gasket may be a horizontal membrane gasket. The module gasket may be a vertical SIP gasket. The module gasket may be a horizontal SIP gasket.

The module may include an insulation gasket. The insulation gasket may be a vertical insulation gasket. The insulation gasket may be a horizontal insulation gasket.

The module may be attachable to a corresponding module. The male connector of the module may be attachable to a corresponding female connector of the corresponding module. The male connector may include at least one bolt hole. The female connector may include at least one bolt hole. The male connector may be attachable to the female connector via the at least one bolt hole of the male connector and the at least one bolt hole of the female connector. The male connector of the module may be attachable to a corresponding male connector of the corresponding module. The male connector may include a terminus bolt hole. The corresponding male connector may include a terminus bolt hole. The male connector of the module may be attachable to the corresponding male connector of the corresponding module by a terminus bolt passing through the terminus bolt hole of the male connector and the terminus bolt hole of the corresponding male connector. The module may be attachable to the corresponding module by a key-lock system. The key-lock system may include a key-lock male connector having at least one key and a key-lock female connector having at least one key slot. The key slot may be dimensioned to receive the key. The key-lock male connector may be lockable to the key-lock female connector when the key-lock male connector is connected to the key-lock female connector. The key-lock female connector may include a key-lock plate. The key-lock male connector may be rotatable when connected to the key-lock female connector such that the at least one key locks against the key-lock plate when the at least one key is not aligned with the at least one key slot.

In accordance with another aspect of the invention, there is provided a module for a modular building. The module includes: (a) a male connector projecting from a first side of the module to form a projection terminated by a terminus having a hemispherical shape; and (b) a female connector disposed on a second side of the module opposite the first side, the female connector comprising a plate having therethrough an aperture dimensioned to receive a corresponding male connector of a corresponding module.

The projection may be cylindrical. The aperture may be circular.

In accordance with another aspect of the invention, there is provided a pair of mating modules for a modular building. The pair includes: (a) a first module comprising a self-aligning male connector projecting therefrom, the male connector terminating in a terminus having a hemispherical shape; and (b) a second module comprising a self-aligning female connector defining a recess dimensioned for receiving the male connector.

In accordance with another aspect of the invention, there is provided a module for a modular building. The module includes male connection means for connecting the module by off-level installation, the male connection means being dimensioned for being received by female connection means dimensioned to receive the male connection means so as to permit the module to be connected to the female connection means.

The module may include sealing means for sealing the module to the corresponding module. The sealing means may be installed on the module prior to attaching together the module and the corresponding module.

In accordance with another aspect of the invention, there is provided a module for a modular building. The module includes: (a) male connection means for connecting the module by off-level installation; and (b) female connection means for receiving a corresponding male connection means of a corresponding module.

The module may include sealing means for sealing the module to the corresponding module. The sealing means may be installed on the module prior to attaching together the module and the corresponding module. The sealing means may be installed on at least one of the module and the corresponding module prior to the female connection means receiving the corresponding male connection means.

In accordance with another aspect of the invention, there is provided a modular building comprising at least one module. Each of the at least one module includes a male connector projecting from a first side of the module to form a projection terminated by a terminus having a hemispherical shape, the male connector being dimensioned for being received by a female connector having an aperture dimensioned to receive the terminus and at least a portion of the projection so as to permit the module to be connected to the female connector by off-level installation.

The at least one module may include at least one module gasket for rendering said at least one module self-sealing. The at least one module may include a first module comprising a first male connector and a second module may include a second male connector. The first and second male connectors may be horizontally adjacent to each other when the modular building is assembled. The modular building may further include at least one spacer plate dimensioned for being received by the first and second male connectors. The modular building may include a roofing module. The at least one module may include a roofing module. The modular building may include a gasketed roofing module and a gasket-receiving roofing module.

In accordance with another aspect of the invention, there is provided a method of assembling a modular building having a first module having a male connector and a second module having a female connector dimensioned for receiving the male connector. The method involves: (a) off-level contacting a terminus of the male connector to the female connector; and (b) aligning the first and second modules such that a projection member of the male connector is received by the female connector.

The method may further involve: (c) attaching the male connector to the female connector. Attaching the male connector to the female connector may involve bolting the male connector to the female connector. Bolting the male connector to the female connector may involve bolting the male connector to the female connector through a spacer plate such that the connected first and second modules become attached to a third module. Attaching the male connector to the female connector may involve bolting the male connector to an adjacent male connector of the third module. Bolting the male connector to an adjacent male connector of the third module may involve bolting the terminus to an adjacent terminus of the adjacent male connector. Attaching the male connector to the female connector may involve locking the male connector to the female connector by a key-lock system.

The foregoing summary is illustrative only and is not intended to be in any way limiting. Other aspects and features of the present invention will become apparent to those of ordinary skill in the art upon review of the following description of embodiments of the invention in conjunction with the accompanying figures and claims.

BRIEF DESCRIPTION OF THE DRAWINGS

In drawings which illustrate by way of example only embodiments of the invention.

DETAILED DESCRIPTION

A module for a modular building includes: male connection means for connecting the module by off-level installation, the male connection means being dimensioned for being received by female connection means dimensioned to receive said male connection means so as to permit the module to be connected to said female connection means. The module may include sealing means for sealing the module to a corresponding module, the sealing means being installed on the module prior to attaching together the module and said corresponding module.

Figure 1:
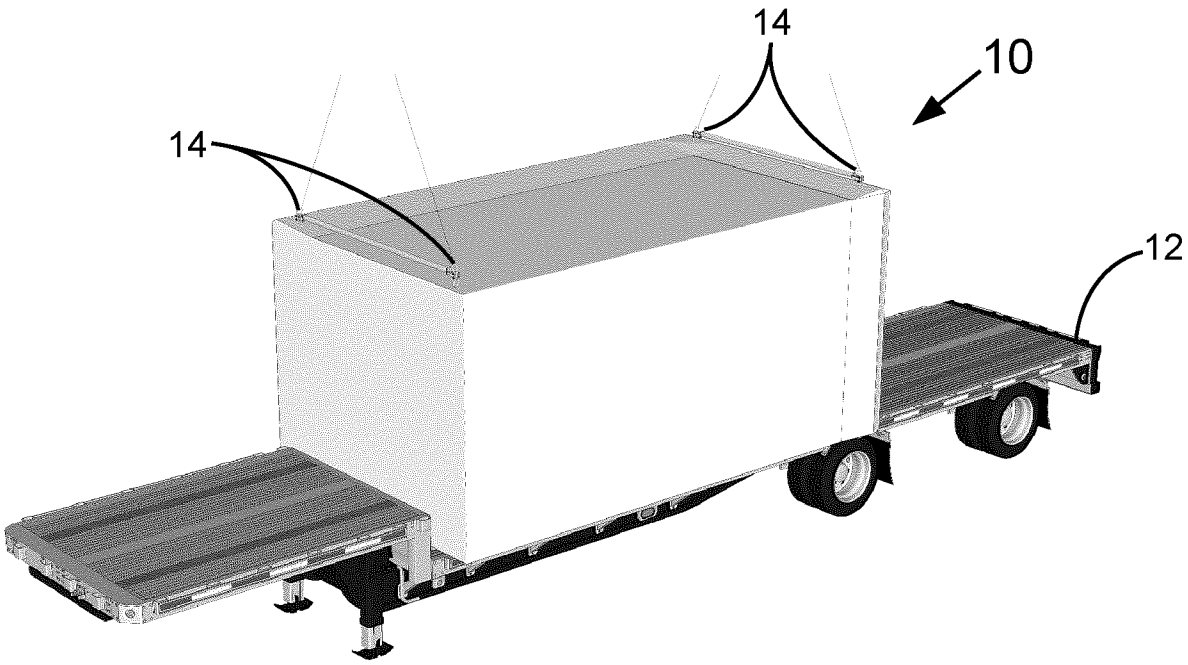
FIG. 1 is a perspective view of a module according to a first embodiment of the invention, showing the module being transported on a trailer.

Referring to FIG. 1, the module according to a first embodiment of the invention is shown generally at 10. In the first embodiment, the module 10 is fabricated in a manufacturing facility to be self-sealing and then transported, such as on the trailer 12 shown in FIG. 1, to a building site. On-site, at least one and typically a plurality of the self-sealing modules 10 are attached to each other horizontally and/or vertically, using an off-level installation technique that is described further below, so as to assemble a modular building. The module 10 itself, upon assembly onto a foundation for example, in some instances constitutes a modular building.

The module 10 may in general have any desired overall dimensions, and the overall dimensions of the module 10 may be selected to facilitate transportation for example. In general, transportation may occur by any suitable means, including by any ocean, rail, air and truck delivery systems. It should be noted that room sizes within a given modular building do not constrain the dimensions of the modules 10 used to assemble the modular building.

In one instance of the first embodiment, the module 10 may have an overall length of 20 feet (6.10 m), overall width of 10 feet (3.05 m), and overall height of 11 feet (3.35 m). In other specific instances, the module 10 can have an overall length in the range of 10 feet (3.05 m) to 108 feet (30.5 m), an overall width in the range of 6 feet (1.83 m) to 24 feet (7.32 m), and an overall height in the range of 7 feet (2.13 m) to 20 feet (6.10 m) for example.

In the embodiment shown in FIG. 1, the module 10 includes four closed eyelet hooks 14 to facilitate the lifting and placing of the module 10 during installation. In general, however, the module 10 may include any number and type of hooks, if any. Additionally or alternatively, the module 10 may be lifted and placed by the use of forklift operations, crane hooks, lifting platforms, other techniques and any combination thereof for example. While not shown in FIG. 1, the module 10 may in general include any number and type of interior fixtures, interior flooring, interior walls, interior and exterior doors, interior and exterior windows or other fenestrations, other related building features, and any combination thereof for example.

Gasket for Self-Sealing Module

Figure 2:
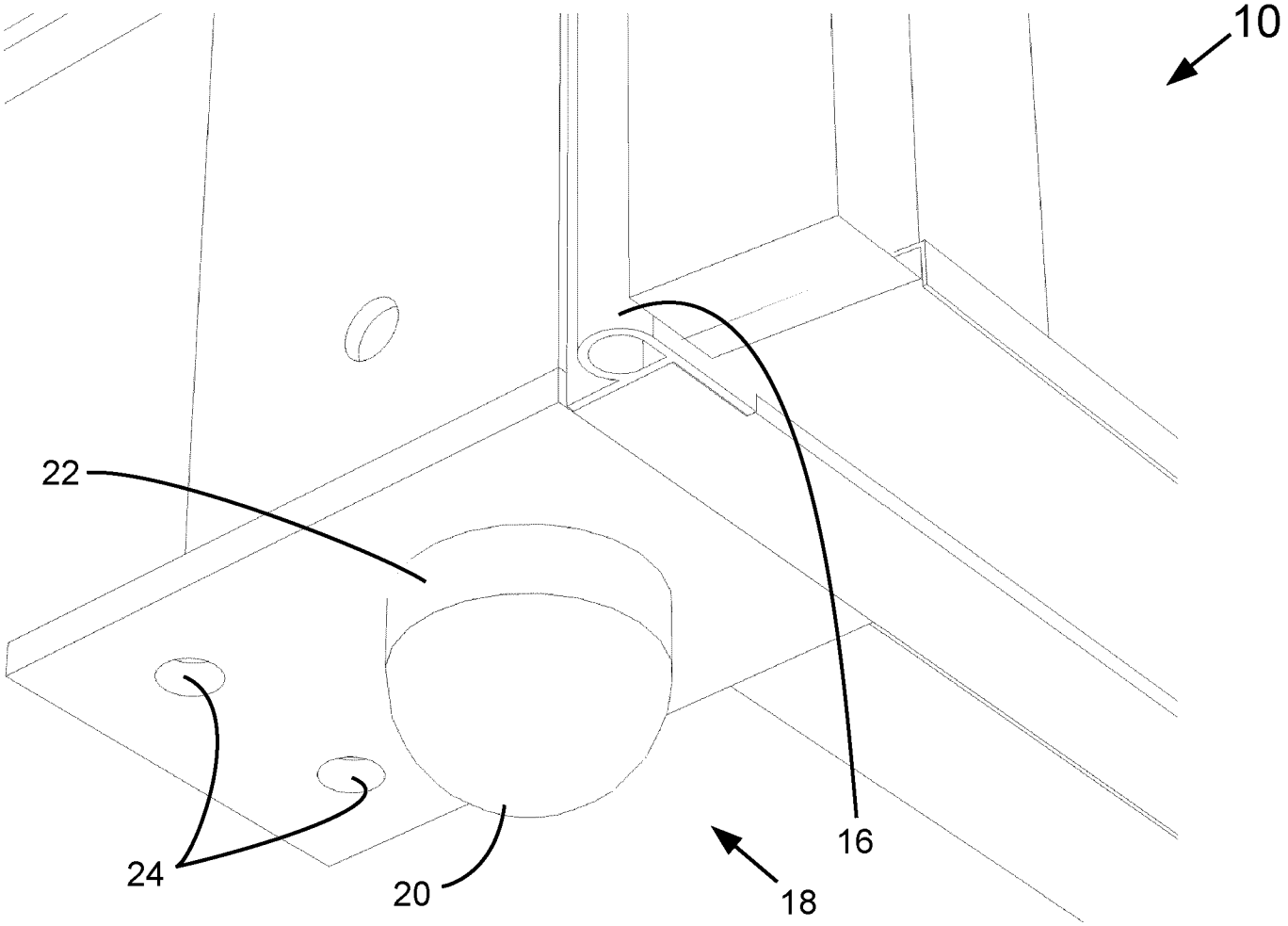
FIG. 2 is a close-up perspective view of a self-aligning male connector of the module shown in FIG. 1.

Referring to FIG. 2, the module 10 in at least some embodiments includes a module gasket 16 for rendering the module 10 self-sealing. For example, the module gasket 16 is dimensioned to seal between the module 10 and an adjacent module 10 when both modules 10 are adjacently assembled in a modular building. The module gasket 16 can be of any suitable dimensions and material, including water-resistant and airtight materials such as EPDM (Ethylene Propylene Diene Monomers) rubber, silicone, neoprene, or other similar materials, etc.

Self-Aligning Male Connector

Still referring to FIG. 2, the module 10 also includes a self-aligning male connector 18 (not visible in FIG. 1) that projects from an outer side of the module 10. In the first embodiment, the male connector 18 terminates at a terminus 20 having a hemispherical shape. In the first embodiment, the male connector 18 includes a projection member 22 preferably having a cylindrical shape. In variations, the terminus 20 may be removably attached to the projection member 22, permanently affixed to the projection member 22, or integrally attached to the projection member 22, for example.

The male connector 18 advantageously permits off-level installation of the module 10 onto a suitable surface having a recess dimensioned to receive the male connector 18, as described further below. The hemispherical shape of the terminus 20 advantageously permits rotation about three orthogonal axes of the male connector 18 when the terminus 20 is being received by such recess dimensioned for the male connector 18.

In the first embodiment, the male connector 18 also includes bolt holes 24 for connecting adjacent modules 10 as described further herein below.

Self-Aligning Female Connector

Figure 3:
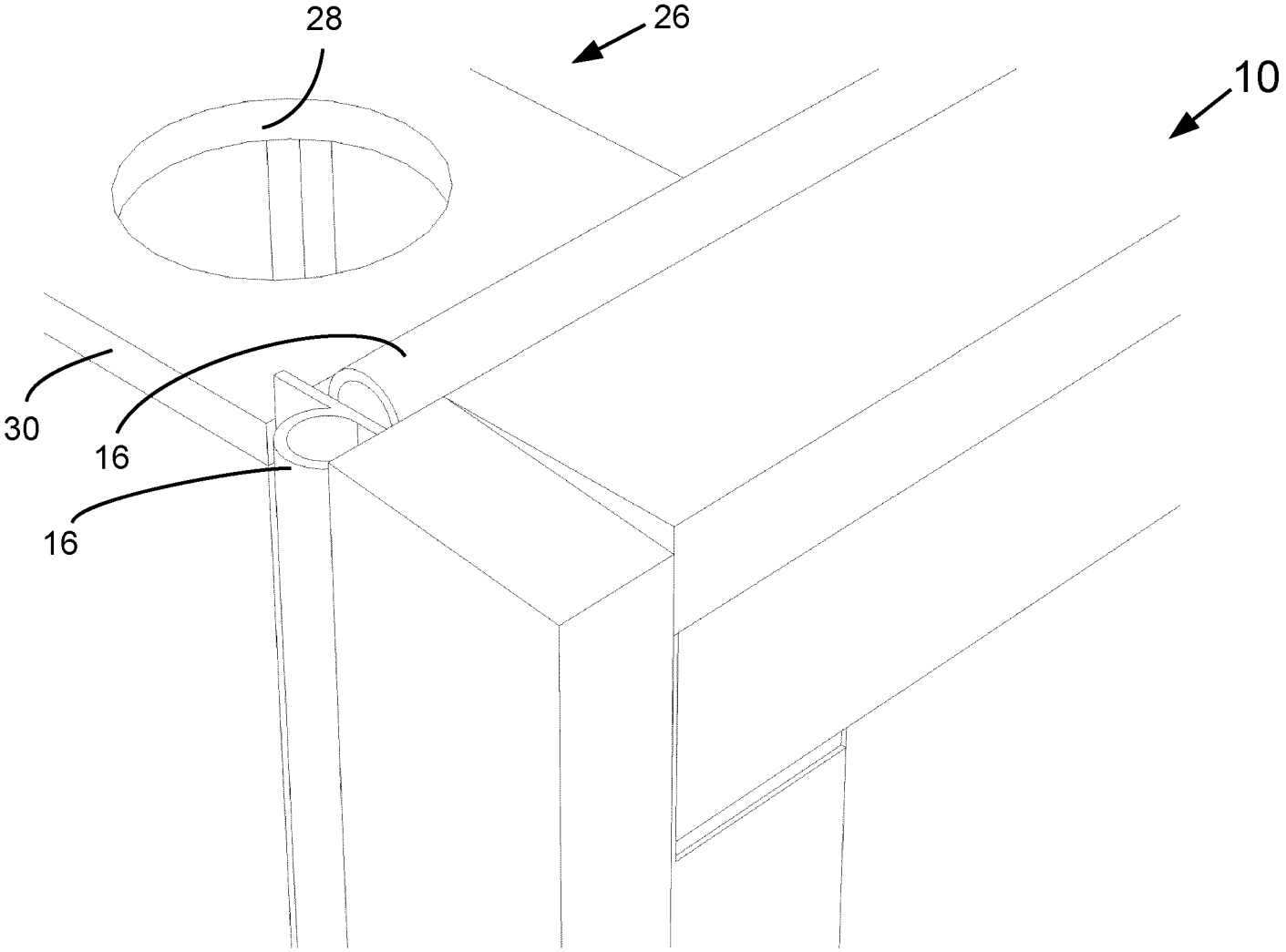
FIG. 3 is a close-up perspective view of a self-aligning female connector of the module shown in FIG. 1.

Referring to FIG. 3, additionally or alternatively to the male connector 18, the module 10 or a corresponding module 10 includes in some embodiments a self-aligning female connector 26 (not visible in FIG. 1) that defines a recess dimensioned for receiving the male connector 18. In the first embodiment, the female connector 26 is formed as an aperture 28 through a connector plate 30 of the module 10, of a corresponding module 10, of a building foundation (not shown) for supporting a modular building, of a ceiling structure (not shown), or other constructed structure. Other forms of the female connector 26 are possible. For example, the female connector 26 may be formed as an aperture 28 in a structural beam (not shown in FIG. 3) of the module 10.

The shape of the aperture 28 preferably corresponds to the cross-sectional shape of the projection member 22, and in the first embodiment the aperture 28 is preferably circular in shape. Sufficient clearance on the inner or opposing side of the connector plate 30 for the terminus 20 of the male connector 18 provides the recess for receiving the male connector 18. The recess formed by the female connector 26 may have any suitable shape, provided the male connector 18 is moveable within the female connector 26 when the terminus 20 only is received within the female connector 26 yet is constrained from moving laterally once the male connector 18 is fully received by the female connector 26.

Still referring to FIG. 3, the module 10 in the first embodiment includes the module gaskets 16 along two adjacent sides of the module 10 so that the module 10 becomes sealed between itself and adjacent modules 10 below, to the left, above and to the right of the module 10. In variations, one or more module gaskets 16 may be employed along any one or more sides of the module 10. For example, the two module gaskets 16 shown in FIG. 3 may meet each other at any corner of the module 10. In some embodiments, the module gaskets 16 are omitted. In embodiments employing any number of module gaskets 16 or no module gaskets 16 at all, gaps between adjacent modules 10 of a modular building may be filled with sealant or other filler material during assembly of the modular building.

Referring to FIGS. 1 to 3, the module 10 in the first embodiment includes a pair of male and female connectors 18 and 26 on opposing sides of the module 10. For example, the module 10 may include one or more male connectors 18 on a bottom side of the module 10 and include one or more female connectors 26 on a top side of the module 10, such that each male connector 18 is vertically aligned with an opposing female connector 26. Conversely, one or more male connectors 18 may be disposed on a top side of the module 10 while one or more female connectors 26 may be disposed on a bottom side of the module 10. In other arrangements opposing male and female connectors 18 and 26 may be disposed on front and rear sides and/or left and right sides of the module 10. The male and female connectors 18 and 26 of adjacent modules 10 advantageously form a self-aligning connection that allows off-level installation as described in further detail below.

The connectors 18 and 26 may have any suitable sizes, provided the sizes are selected so that the female connector 26 can receive a corresponding male connector 18 of a corresponding module 10. In doing so, misalignment between the male and female connectors 18 and 26 will self-correct as the connectors 18 and 26 engage each other when one module 10 is guided via the connectors 18 and 26 into position in connection with a vertically or horizontally adjacent module 10. When the male connector 18 is fully received by the female connector 26, there is preferably minimal clearance (e.g. $1/16^{th}$ of an inch, or 1.59 mm) between the projection member 22 and the aperture 28 to ensure proper alignment of the attached modules 10 of a modular building. However, in variations for different applications, different clearance dimensions may be employed, such as a clearance in the range of $1/32^{nd}$ of an inch (0.79 mm) to 0.5 inches (12.7 mm) for example. It should be noted that the dimensions of the connectors 18 and 26 are not constrained by the overall dimensions of the module 10.

In a particular instance of the first embodiment shown in FIGS. 1 to 3, the projection member 22 has a cross-sectional diameter of 3.5 inches (96.9 mm), and the aperture 28 has a diameter of $1/16^{th}$ of an inch (1.59 mm) larger than the cross-sectional diameter of the projection member 22. In other specific instances, the projection member 22 can have a cross-sectional diameter in the range of 2.0 inches (50.8 mm) to 5.0 inches (127 mm), for example. In further other instances, the connectors 18 and 26 can be based on the projection member 22 having a cross-sectional diameter of 6 inches (168.4 mm), 9 inches (228.6 mm), 12 inches (304.8 mm), or other diameters.

While in the first embodiment the terminus 20 has a hemispherical shape, in variations of embodiments the terminus 20 may have any suitable shape such as ellipsoidal, pyramidal, conical or frusto-conical, for example. While in the first embodiment the projection member 22 and its corresponding aperture 28 each have a circular cross-sectional shape, in variations of embodiments the projection member 22 and its corresponding aperture 28 may have any suitable cross-sectional shapes such as polygonal, elliptical, rectangular or square, for example.

Connection Column

Figure 4:
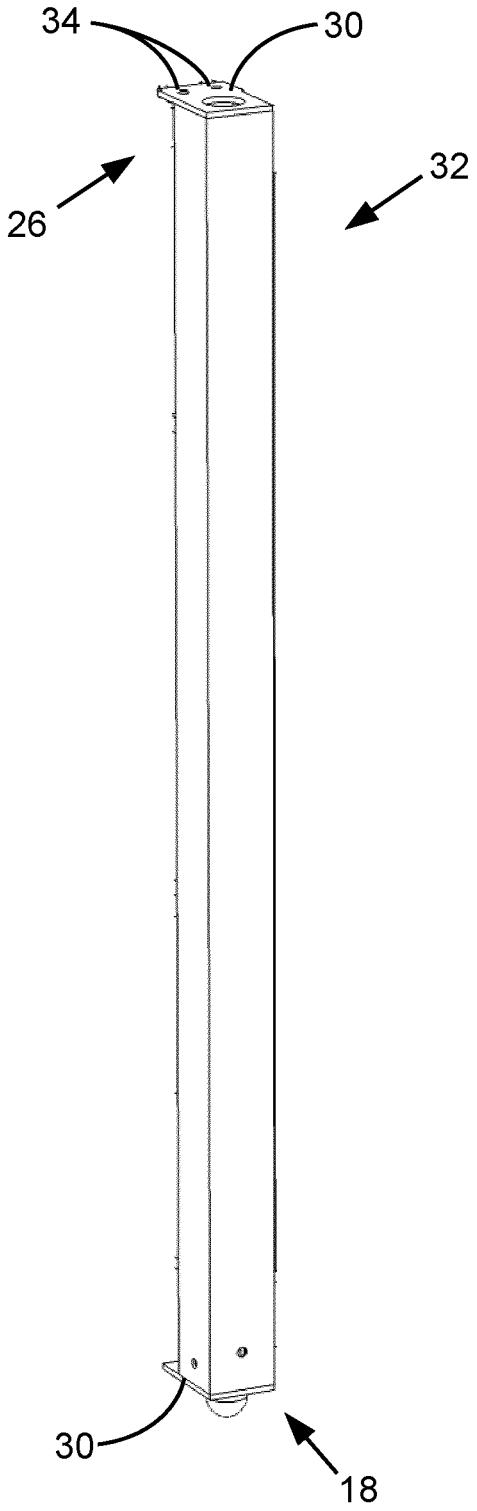
FIG. 4 is a perspective view of a connection column of the module shown in FIG. 1.

Referring to FIG. 4, the module 10 in the first embodiment includes the connection column 32 as a structural or framework component. The connection column 32 includes the male and female connectors 18 and 26 at opposing ends of the column 32.

The column 32 also includes one connector plate 30 at each end of the column 32. The connector plates 30 act as endplates of the column 32 and may be attached onto the column 32 such as by welding, formed integrally with the column 32 such as by metal casting, formed by other techniques, and any combination thereof for example. In variations of manufacturing, the connectors 18 and 26 may be attached to or formed in the connector plate 30 before or after the connector plate 30 is attached to or integrally formed with the column 32. In some embodiments, either or both of the male and female connectors 18 and 26 are also integrally formed with its connector plate 30 and the column 32.

As shown in FIG. 4, the male connector 18 projects from one connector plate 30 at one end of the column 32, while the female connector 26 is formed in the other connector plate 30 at the other end of the column 32. FIG. 4 also shows the bolt holes 34 of the female connector 26.

The connection column 32 is dimensioned to form part of any building structure, such as the module 10 of a modular building. Typically, one connection column 32 is disposed at each of four corners of the module 10. However, in general any number of connection columns 32 may be disposed at any position within the module 10. For example, in some embodiments a given module 10 may include more than four connection columns 32, such as having four connection columns 32 at each opposing corner of the module 10 plus having additional intermediary connection columns 32 located along module 10 walls between corners and/or located inside of module 10 walls. Modules 10 in some embodiments do not have connection columns 32 at its corners, such as when there is one single connection column 32 for each module 10. Modules 10 having a single connection column 32 may have its single connection column 32 at its center, for example. Modules 10 in some embodiments have connection columns 32 midway along the module 10 walls between corners instead of at the corners of the module 10.

It should be noted that the dimensions of the connection column 32, including those of the connectors 18 and 26, are not constrained by the overall dimensions of the module 10. Sufficiently large modules 10 may include additional structural support columns (not shown) that do not have the connectors 18 and 26, for example. Also, the dimensions of the connectors 18 and 26 are not constrained by the dimensions of the column 32, provided the cross-sectional area of the column 32 is sufficient to accommodate the connectors 18 and 26. The dimensions of the columns 32 may be selected for architectural design purposes, for example.

In some embodiments, a given module 10 does not include any connection columns 32, but may, for example, include one or more male connectors 18 and/or one or more female connectors 26 separate from any module 10 column.

Module Fabrication Example 1

Figure 5:
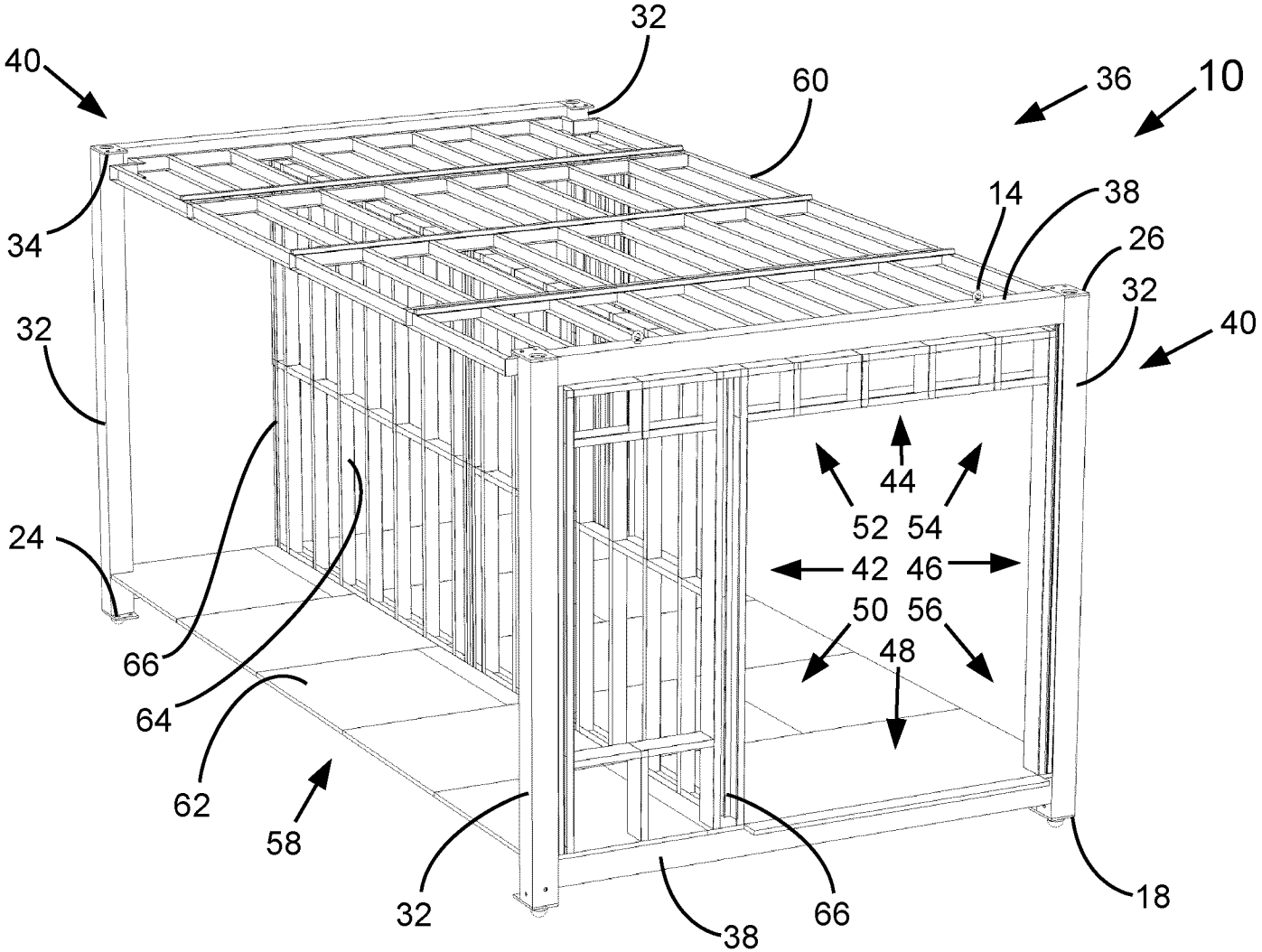
FIG. 5 is a perspective view of a frame of the module shown in FIG. 1, showing self-aligning connectors attached to vertical columns of a an end-frame member.

Referring to FIG. 5, a frame 36 of the module 10 is fabricated, typically in a manufacturing facility, to include a number of the connection columns 32. For convenience of design, four columns 32 may be disposed vertically at four opposing corners of the module 10. However, in general any given module 10 may include any number of columns 32 disposed at any locations within the module 10.

In the exemplary embodiment shown in FIG. 5, one male connector 18 and one female connector 26 is disposed at opposing ends of each column 32. Also, in this exemplary embodiment the height of the column 32 is commensurate with the height of the module 10. In this manner, one module 10 can be stacked on top of another module 10 having the same arrangement of male and female connectors 18 and 26 at opposing ends of the columns 32.

FIG. 5 shows the male connector 18 at the bottom of the column 32 and the female connector 26 at the top of the column 32. Alternatively, embodiment the male connector 18 can be at the top of the column 32 and the female connector 26 at the bottom of the column 32. In further variations, the columns 32 may be disposed horizontally in the manner of connection-type beam posts (not shown).

The frame 36 may be constructed in a variety of ways, including that shown in FIG. 5 in which a pair of parallel, spaced-apart columns 32 are connected by a pair of parallel, spaced-apart horizontal beams 38. Preferably, the columns 32 and beams 38 are made of steel or similar, and are welded, fastened such as by bolting, or otherwise attached to each other to form a pair of end-frame members 40 that are parallel and spaced apart from each other. For ease of reference herein, an exterior end-frame member 40 shown in FIG. 5 defines a left side 42, top side 44, right side 46, bottom side 48, bottom-left corner 50, top-left corner 52, top-right corner 54, and bottom-right corner 56.

At least one of an infill floor 58, an infill ceiling 60, cross beam (not shown) or other structural member or members (not shown) extend between the pair of end-frame members 40 to complete the frame 36. In the first embodiment, the infill floor 58 is structural, while the infill ceiling 60 has little or no structural value. For ease of illustration, the floor 58 is represented graphically in FIG. 5 by its associated floor boards 62. In variations, the floor boards 62 may be wooden boards, concrete boards, concrete slabs, metal sheets, other flooring materials, and any combination thereof for example. The floor boards 62 may be supported structurally by any suitable manner (not shown), including joists or beams extending between the end-frame members 40, decks such as steel decks, open webs, pre-stressed concrete planks, other structural frame elements, and any combination thereof for example. In some embodiments, the floor boards 62 and any underlying structural elements extending between the end-frame members 40 may be implemented by a single structural element (not shown) that inherently provides flooring. Alternatively, in some embodiments the floor 58 is omitted such that the ceiling 60 of a given module 10 is constructed to provide a flooring appearance to another module 10 attached above the given module 10. Conversely, in some embodiments the ceiling 60 is omitted such that the floor 58 of a given module 10 is constructed or otherwise finished on its bottom side to provide a ceiling appearance to another module 10 attached below the given module 10.

In some embodiments, a modular building is assembled by attaching at least one module 10 onto a foundation (not shown). Such foundation may be in the form of a frame 36, end-frame member 40, column 32, female connector 26, and/or a connector plate 30 that is buried in, cemented into and/or otherwise fixed on the ground for example. In some embodiments, the foundation is a concrete and/or steel foundation previously created on-site to have a recess dimensioned for receiving the male connector(s) 18 of the module(s) 10 of the modular building. In some embodiments, the foundation is provided in the form of a foundation module (not shown) containing at least one female connector 26, and typically four female connectors 26 at opposing corners of the foundation module. As such, the foundation module typically does not contain any male connectors 18, except in circumstances where male connectors 18 are employed at the tops of modules 10 of a given modular building.

In the first embodiment shown in FIG. 5, the ceiling 60 of the module 10 is an open-web, steel stud ceiling providing access to the floor cavity of another module 10 stacked above the module 10. In the embodiment of FIG. 5, the ceiling 60 is made of light gauge steel, although other materials may be employed in variations of embodiments. In some embodiments, ceiling panels (not shown) and/or drywall (not shown) provides finishing for a modular building. In variations, the ceiling 60 may be constructed as a self-supporting steel structure covered by concrete, concrete boards, other boards, or other decking material. Alternatively, the ceiling 60 may be made of pre-stressed concrete disposed between steel beams, for example. In some embodiments, the ceiling 60 constitutes a structural feature of the frame 36 of the module 10. In other embodiments, the ceiling 60 is omitted such that the floor 58 of a given module 10 is constructed to provide a ceiling appearance to another module 10 attached below the given module 10. In the first embodiment, further roofing material (not shown in FIG. 5) is provided above the ceiling 60 of the topmost module(s) 10 of a modular building. For example, further structural material may be provided about the ceiling 60 of the topmost module(s) 10.

Still referring to FIG. 5, in an alternate construction (not shown) that omits the horizontal beams 38, the frame 36 may be fabricated from four of the vertical columns 32 disposed at the corners of a supporting floor, such as the floor 58 of the first embodiment, and/or a supporting ceiling. As a further alternative, supporting beams (not shown) may extend between the columns 32 at or near each of the corners of the end-frame members 40 such that the frame 36 becomes self-supporting absent the infill floor 58 and the infill ceiling 60 and neither the floor 58 nor the ceiling 60 have structural value. In typical embodiments, the floor 58 is required to provide a structural diaphragm for the module 10. In embodiments in which the floor 58 is made of concrete, the floor 58 need not include floor 58 beams. In embodiments that include floor 58 beams, ceiling 60 beams need not be included but may nonetheless be included even if structurally redundant.

Still referring to FIG. 5, an interior wall 64 is shown at an exemplary location within the module 10, which location may be varied according to the design of the modular building. Any number of interior walls 64 may be employed, including having no interior walls 64 at all in any given module 10. Each interior wall 64 may include any number of windows, doors, other fenestrations or open sections in any manner known to those skilled in the art. While FIG. 2 shows the interior wall 64 as having end studs 66 in line with the end-frame members 40, the interior wall 64 may end in either horizontal direction at any desired location. Similarly, while FIG. 2 shows the interior wall 64 as extending from the floor 58 to the ceiling 60, the interior wall 64 may in general extend vertically to any desired extent within the module 10, provided that contact at some point is made in some manner with the frame 36. The interior wall 64 may be constructed of wall studs and horizontal wall plates as shown in FIG. 5, for example. Such studs and the wall plates may be made of steel, wood, other suitable construction material, and any combination thereof for example. However, other wall construction techniques are within the scope contemplated by the present invention. For example, the interior wall 64 may employ structural insulated panel (SIP) technology, cross laminated timber (CLT) technology, other building technology, and any combination thereof for example. The interior wall 64 may be finished in any desired manner according to the design of a given modular building.

In a variation, the frame 36 may include further vertical columns as structural members that are not connection columns 36. Such variations, are particularly suitable for larger-sized modules 10 that require interior structural support columns.

The frame 36 of the first embodiment does not include insulation material. In some embodiments (not shown), however, insulation material is embedded within one or more of the frame 36 components such as one or more end-frame members 40 shown in FIG. 5. In such embodiments, the workload of installing insulation during fabrication of the module 10 is reduced or eliminated.

As best seen in FIGS. 2, 4 and 5, in the first embodiment the connector plates 30 at each end of each column 32 include fastening apertures, such as the bolt holes 24 and 34, for receiving fasteners (not shown), such as a bolt and nut, clamp, pin, safety wire, other fastening system and any combination thereof for example. Preferably, adjacent modules 10 of the same modular building are fastened to each other after being connected, as described further below.

While the frame 36 of the first embodiment shown in FIG. 5 has a connection column 32 at each of the four corners of the frame 36, other placements of the male connectors 18 and the female connectors 26 are possible. For example, one or more male connectors 18 and/or one or more female connectors 26 may be formed in a structural beam such as a horizontal beam 38 and/or a cross-beam, if any, extending between end-frame members 40.

Figure 6:
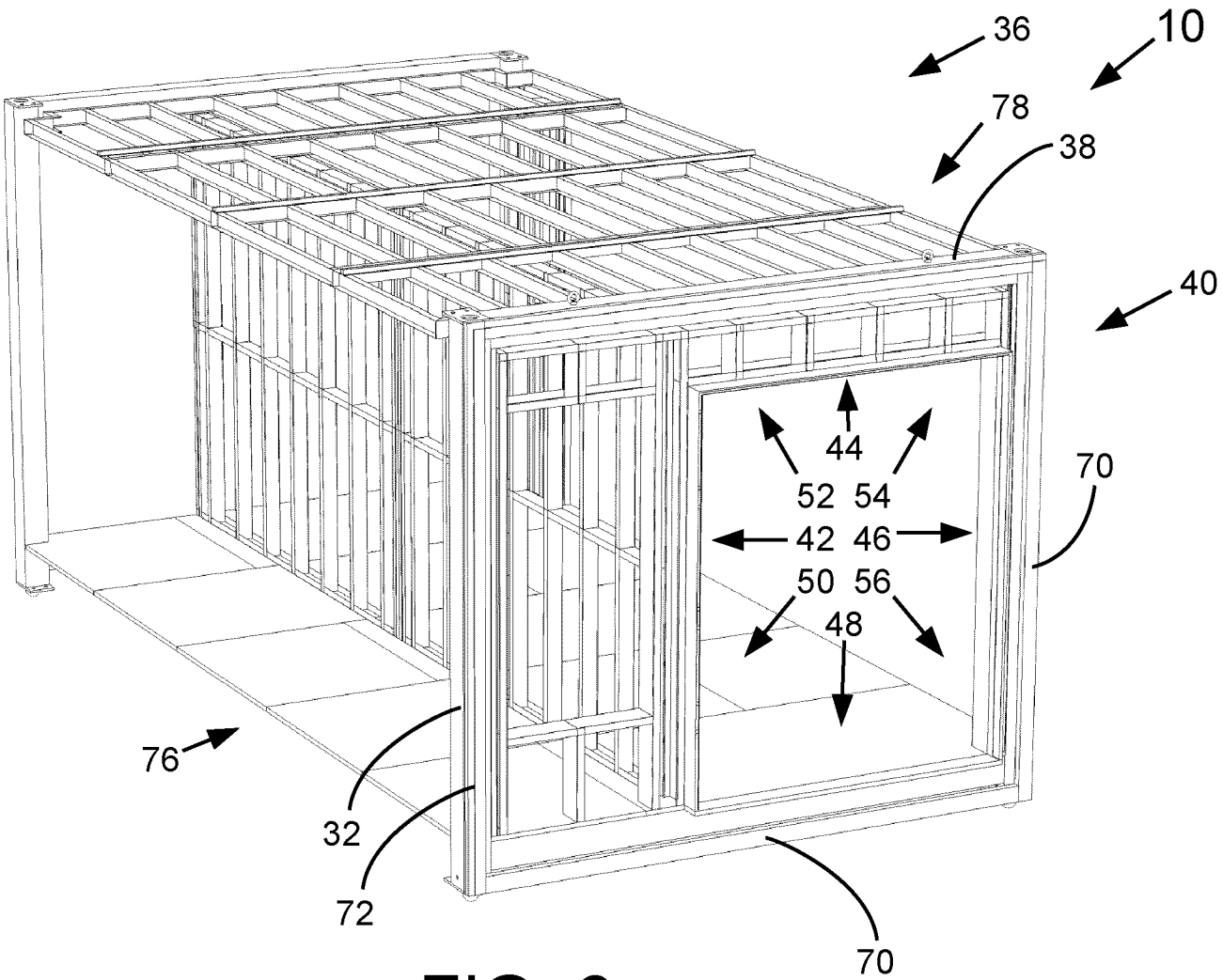
FIG. 6 is a perspective view of the frame shown in FIG. 5, showing the addition of blocking applied to the end-frame member.

Referring to FIG. 6, after the frame 36 has been fabricated, blocking 70 is applied to the perimeter of selected exterior faces of the frame 36. The blocking 70 preferably provides a structural framework for positioning and containing other construction components and materials of the module 10. The blocking 70 may be made of any suitable material such as wood, plastic, fiberglass, pre-cast material (cementitious or otherwise), metal, other materials, and any combination thereof for example. In some embodiments, the column 32 itself incorporates the blocking, such as by the column 32 having a designed sectional profile created by extrusion or other techniques.

While the exemplary embodiment of FIG. 6 shows the blocking 70 applied to only one side of the module 10, which is the exterior-facing wall of the module 10. However, blocking 70 can be applied to any number of exterior-facing or interior-facing walls of the module 10.

In the first embodiment, the cut-out 72 defining a cut-out edge 74 extends along two adjoining perimeter edges of the blocking 70, such as the left vertical edge 76 and the top horizontal edge 78 as seen in FIG. 6.

Figure 7:
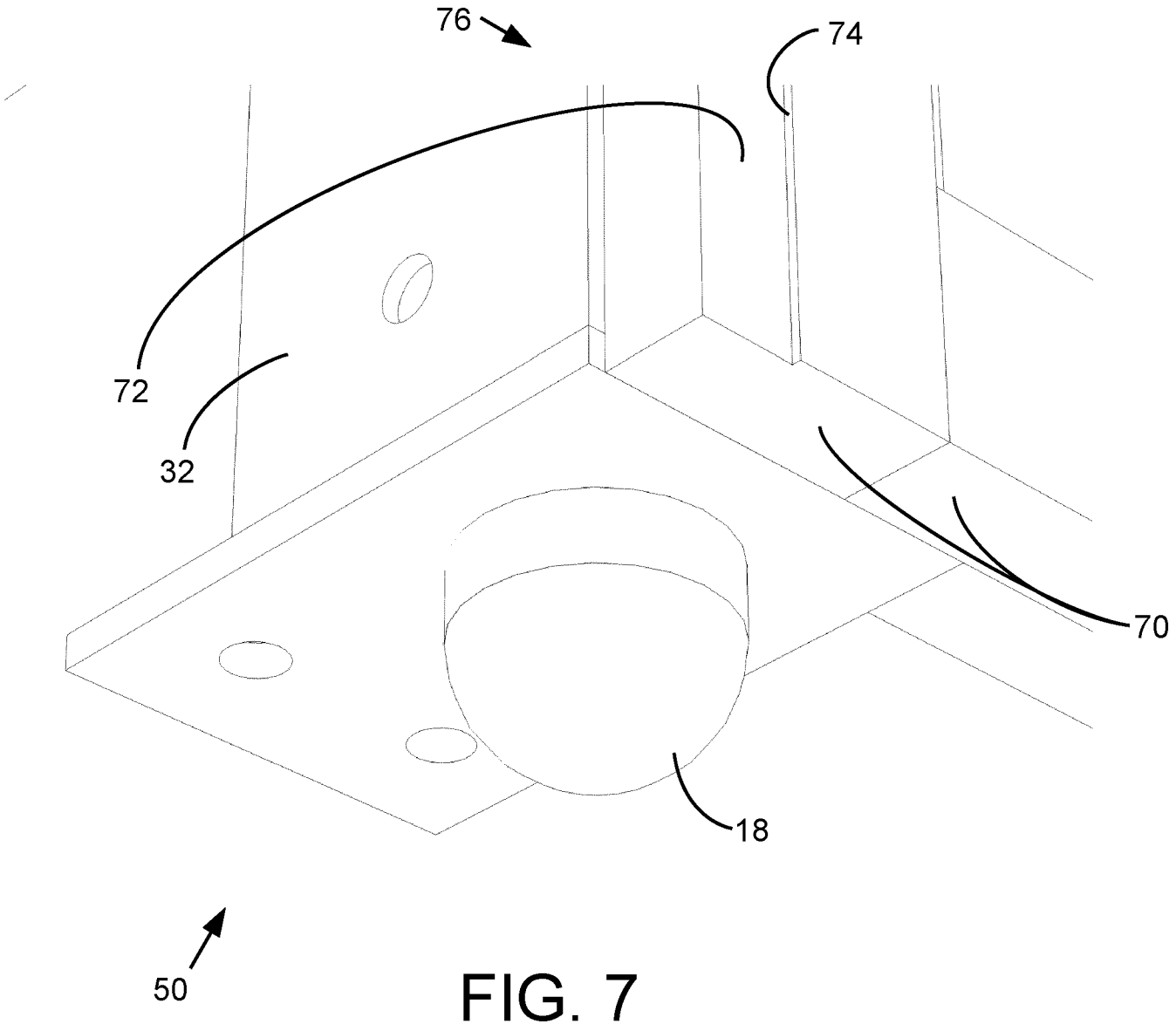
FIG. 7 is a close-up perspective view of a bottom-left corner of the end-frame member shown in FIG. 6, showing a cut-out in the blocking.
Figure 8:
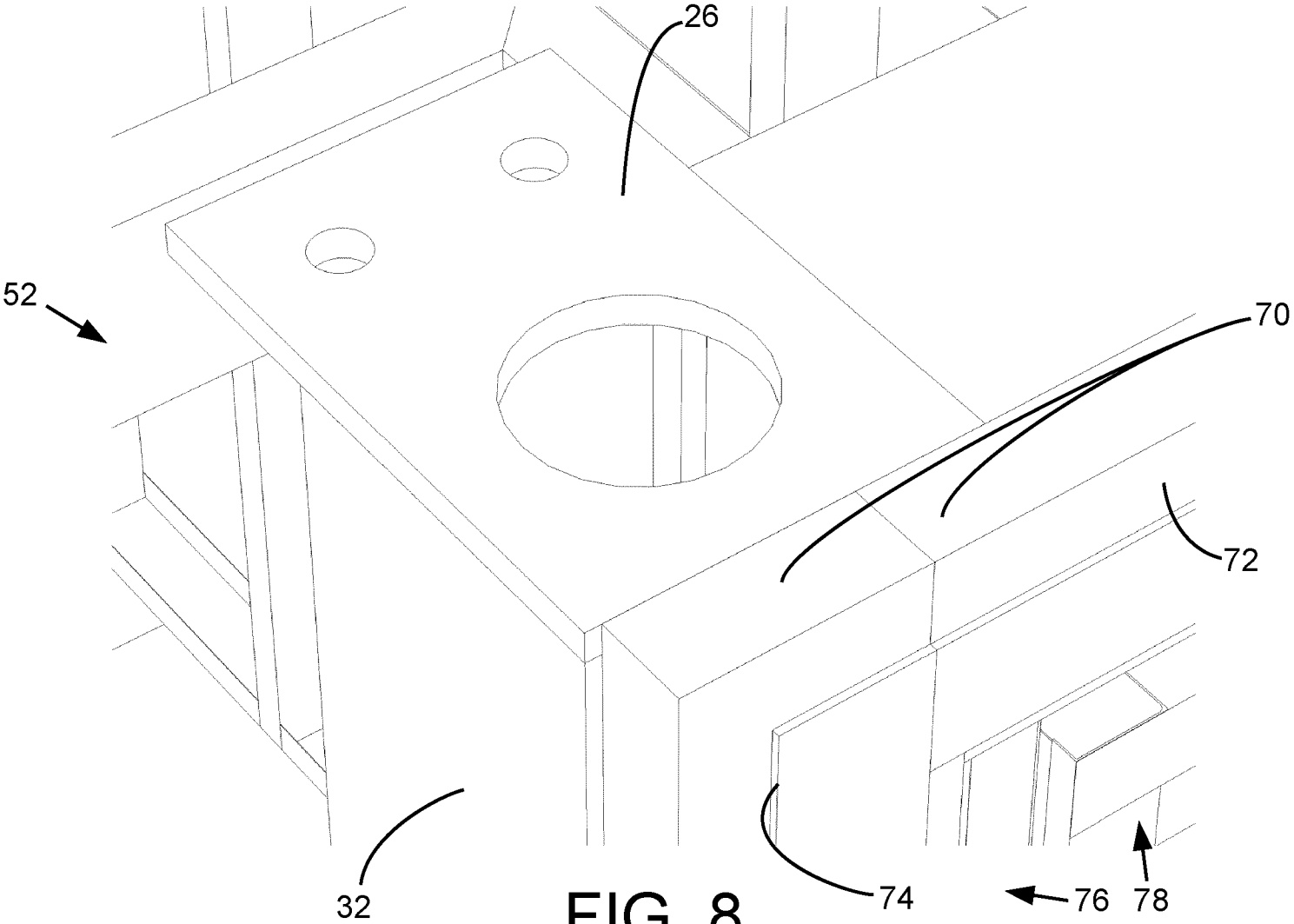
FIG. 8 is a close-up perspective view of a top-left corner of the end-frame member shown in FIG. 6, showing the cut-out.

Referring to FIG. 7, the blocking 70 is visible in close-up view at the bottom-left corner 50 (FIGS. 5 and 6) of the frame 36. In FIG. 8 the blocking 70 is visible in close-up view at the top-left corner 52 (FIGS. 5 and 6) of the frame 36. In the first embodiment, the profile of the blocking 70 is generally rectilinear in shape having the cut-out 72 for receiving module 10 components described below. In general, however, the blocking 70 may have any suitable shape. In some embodiments, the blocking 70 does not include the cut-out 72. As shown in FIGS. 6 to 8, the cut-out 72 of the first embodiment defines the cut-out edge 74 to extend along the blocking 70 approximately midway thereof.

Figure 9:
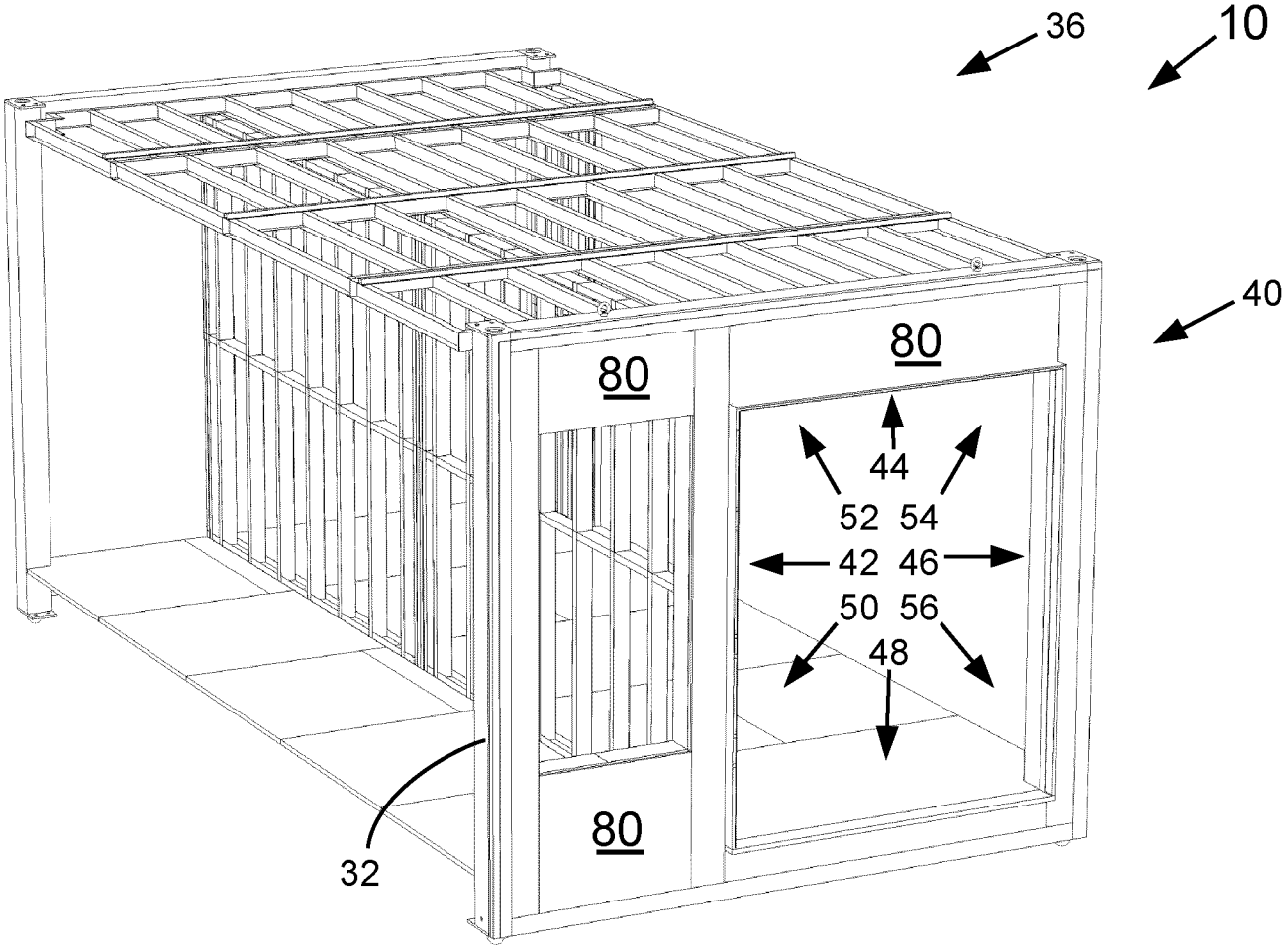
FIG. 9 is a perspective view of the end-frame member shown in FIG. 6, showing the addition of board material installed within the blocking.

Referring to FIG. 9, boards 80 are inserted within the framework formed by the blocking 70. In the first embodiment, the boards 80, which may be or include one or more sheathing boards, are made of a rigid sheet-like material such as particle board, insulation board, plywood, fiberboard, drywall composite, fiberglass, other suitable materials, and any combination thereof for example. In some embodiments (not shown), a layer of rigid insulation is disposed interior to or included with the boards 80.

Figure 10:
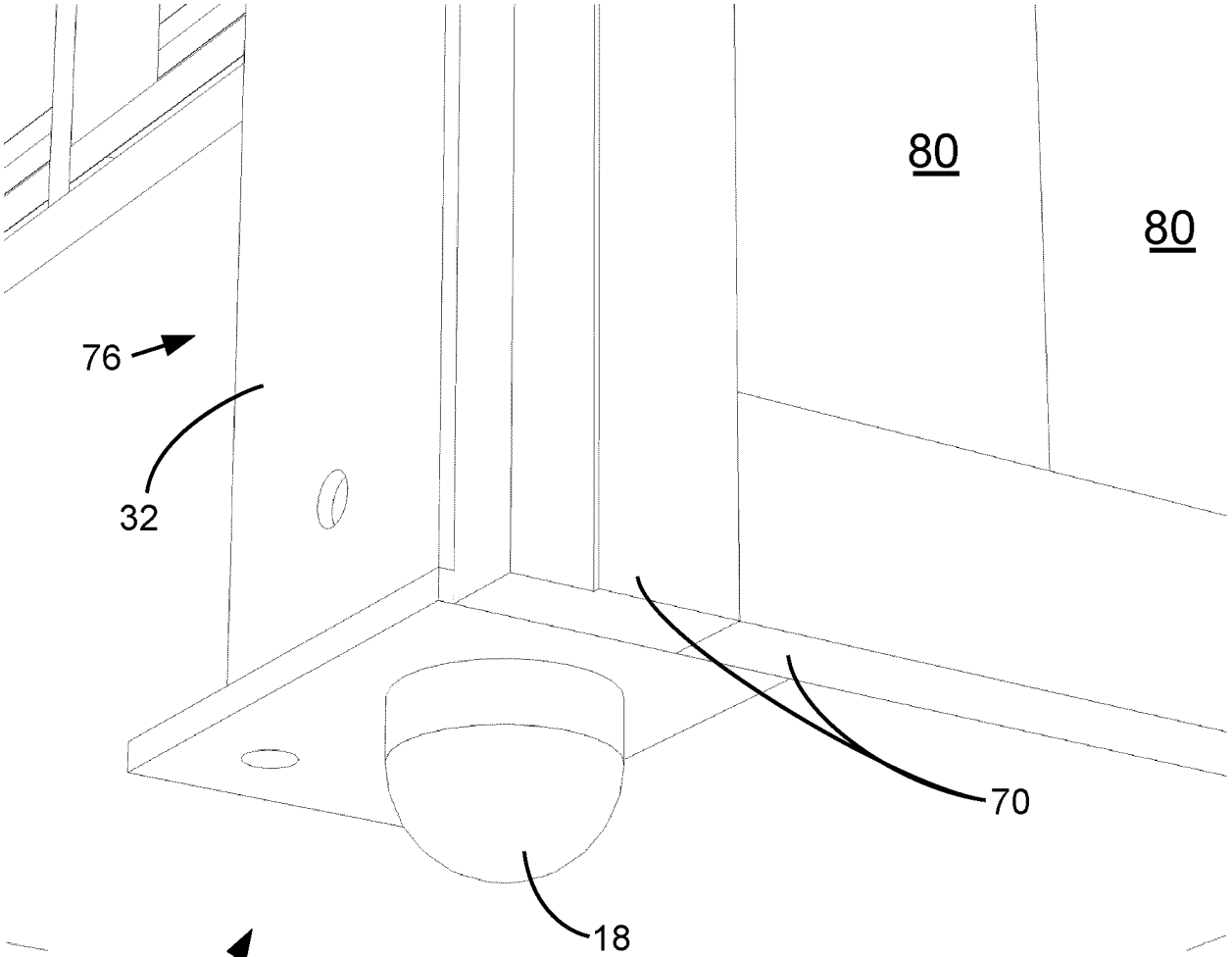
FIG. 10 is a close-up perspective view of the bottom-left corner of the end-frame member shown in FIG. 9, showing the blocking and board material flush to each other.

Referring to FIG. 10, the boards 80 are preferably installed flush with the exterior face of the blocking 70, such that the blocking 70 and the boards 80 do not project outwardly further than each other.

Figure 11:
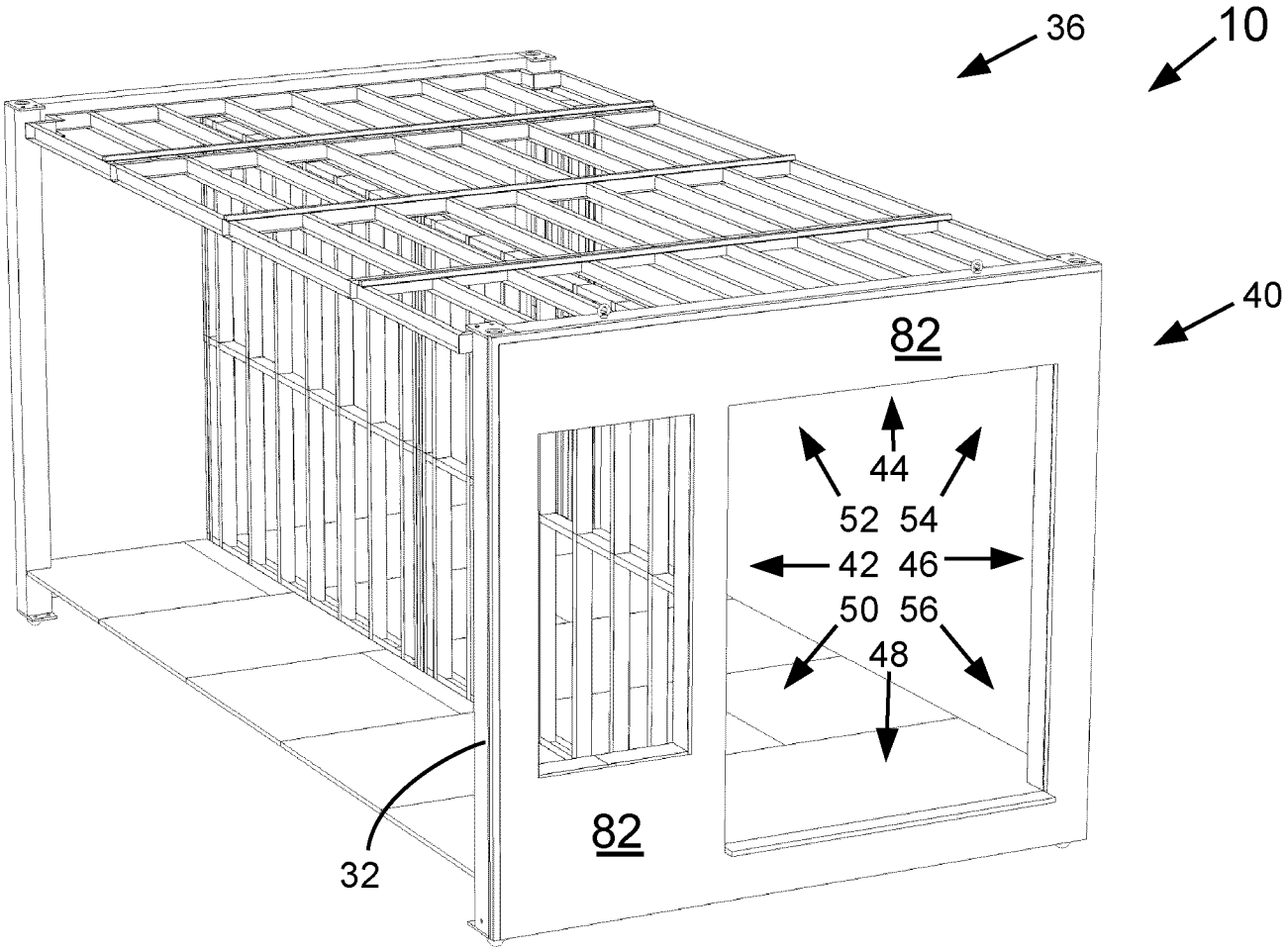
FIG. 11 is a perspective view of the end-frame member shown in FIG. 9, showing the addition of an envelope membrane.

Referring to FIG. 11, an envelope membrane 82 is applied over the boards 80 and the blocking 70. The envelope membrane 82 is typically a sheet-like material or coating that is impervious to water and air to provide a vapour barrier. The envelope membrane 82 may be made of a plastic, vinyl, rubber, or other material and may be applied by any suitable technique, including being taped on and/or made of a peel-and-stick material for convenient application. The envelope membrane 82 may applied with fasteners, such as where the envelope membrane 82 is self-healing. Alternatively, the envelope membrane 82 may be painted on, rolled on, etc. The envelope membrane 82 may be made of a bituminous coating, for example. A self-healing envelope membrane 82 is advantageous whenever a fastener of any kind for any purpose pierces the envelope membrane 82.

Figure 12:
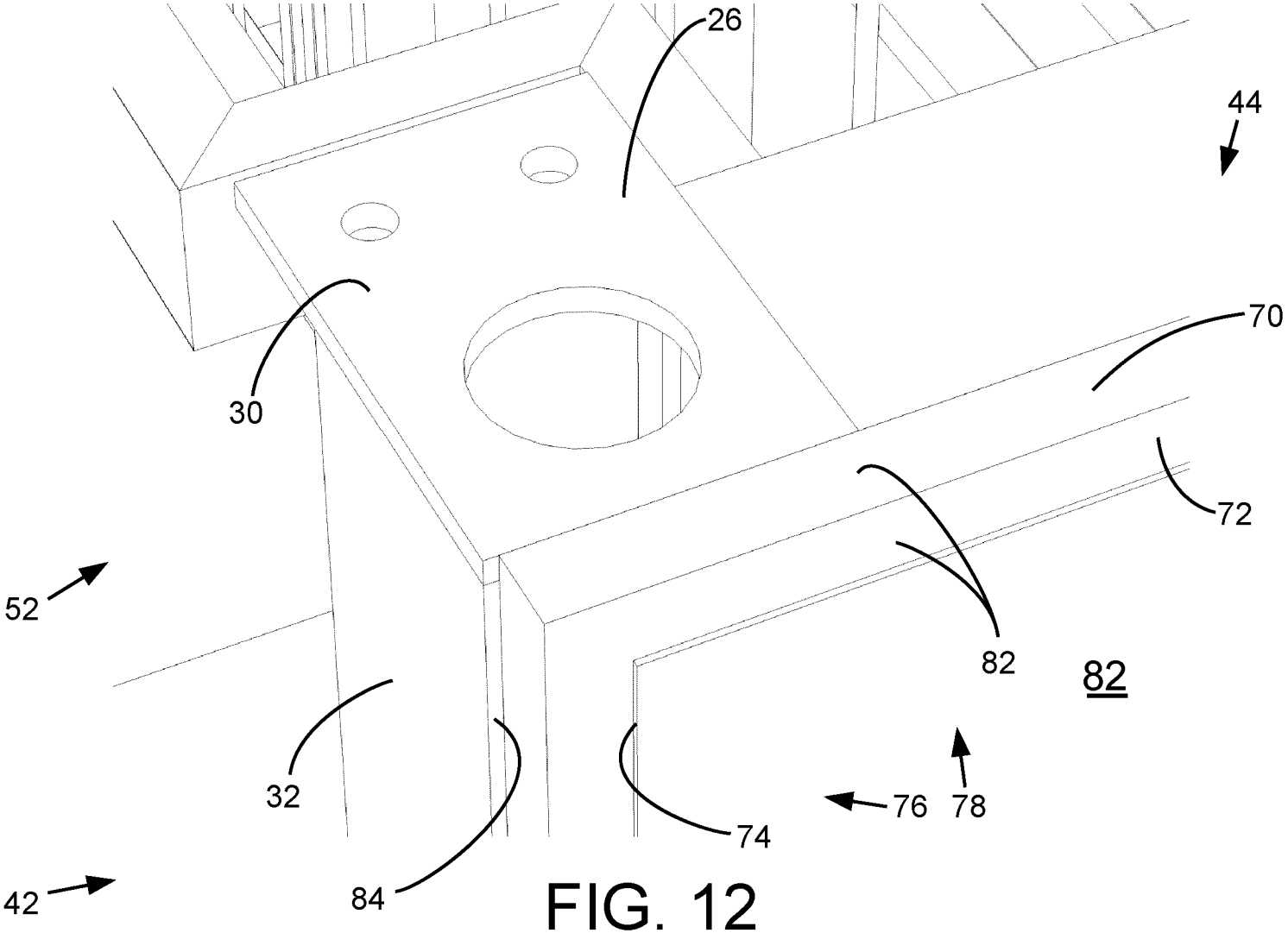
FIG. 12 is a close-up perspective view of the top-left corner of the end-frame member shown in FIG. 11, showing the envelope membrane extending to adjoining cut-out edges.

Referring to the close-up view in FIG. 12, the envelope membrane 82 in the first embodiment extends over the cut-out 72 of the blocking 70 to the left vertical edge 76 and the top horizontal edge 78 of the blocking 70. In the first embodiment, the envelope membrane 82 extends over all exposed surfaces of the boards 80 and the blocking 70, including wrapping around the left vertical edge 76 and the top horizontal edge 78 of the blocking 70. In some embodiments, the envelope membrane 82 extends past the blocking 70 to cover at least a portion of the column 32, although this in general may not be necessary.

In the first embodiment, the blocking 70 and the connector plate 30 are flush to each other along the top side 44, but are not flush to each other along the left side 42 to provide the setback 84 seen in FIG. 12. In the first embodiment, the setback 84 has a horizontal width of 0.5 inches (12.7 mm), although other widths are possible, such as widths in a range of 0.1 inches (2.5 mm) to 1.5 inches (38.1 mm) for example.

Figure 13:
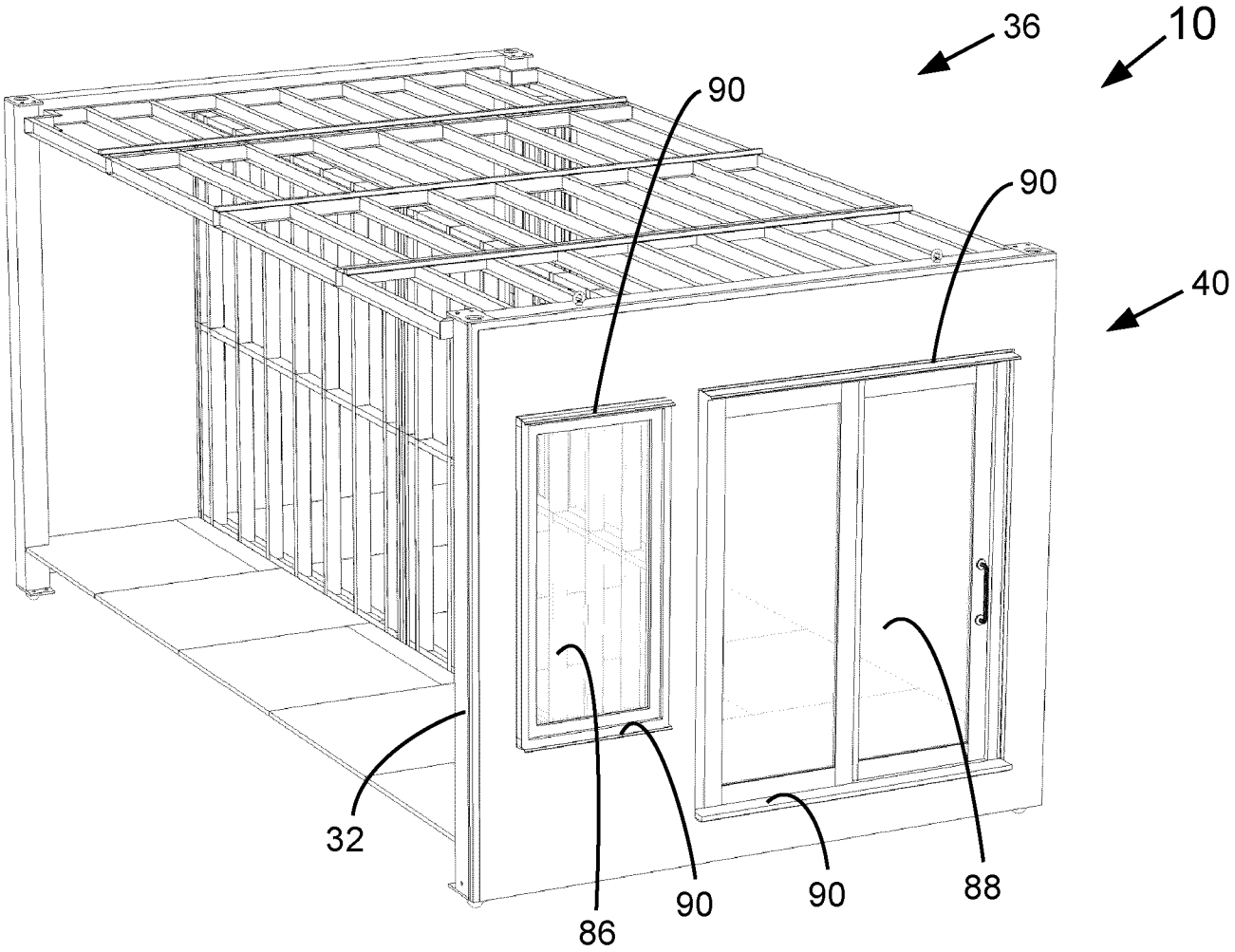
FIG. 13 is a perspective view of the end-frame member shown in FIG. 11, showing the addition of a window, window sill flashing, door, and door sill flashing.
Figure 14:
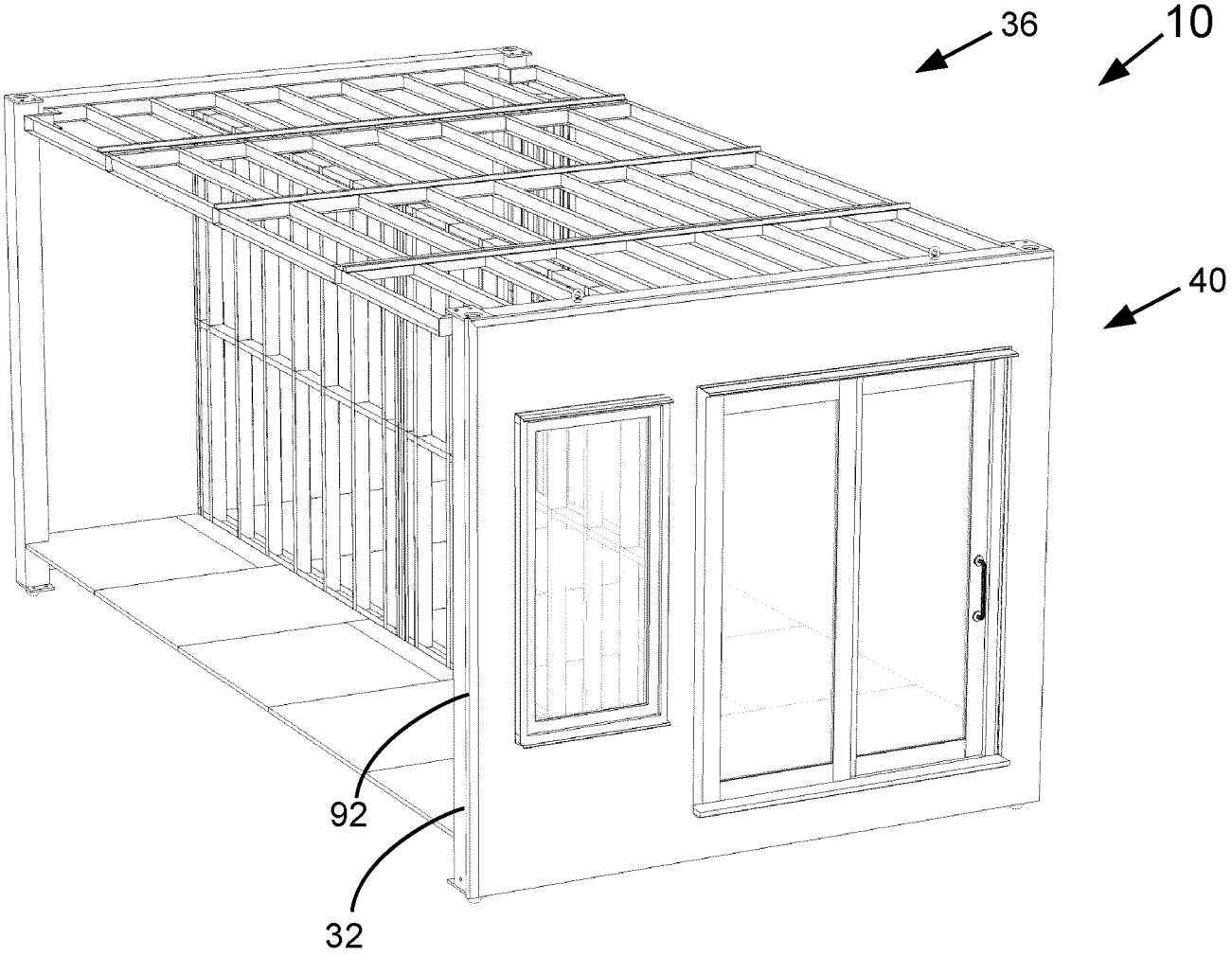
FIG. 14 is a perspective view of the end-frame member shown in FIG. 13, showing the addition of a vertical membrane gasket.

Referring to FIG. 13, after the envelope membrane 82 has been applied, fenestration systems are installed onto the module 10. Any desired arrangement and type of windows 86, doors 88, etc., may be installed in accordance with the module 10 design. In the exemplary embodiment shown in FIG. 13, flashing 90 is installed with each window 86 and each door 88. In the embodiment of FIG. 13, such flashing 90 includes sill flashing 90 at the bottom of each window 86 and each door 88 and includes head flashing 90 at the top of each window 86 and each door 88. In variations of embodiments, either or both of the sill flashing 90 and the head flashing 90 may be omitted, for example.

Referring to FIGS. 14 to 17, a vertical membrane gasket 92 is fastened, adhered, or otherwise attached to the blocking 70 on at least one exposed face of the blocking 70, including possibly an exposed face of the blocking 70 having a membrane or other material attached thereto. Preferably, the vertical membrane gasket 92 extends over the blocking 70 on at least both perpendicular facing exposed surfaces of the blocking 70. In the first embodiment, the vertical membrane gasket 92 is installed over the envelope membrane 82 in the cut-out 72 of the blocking 70. Preferably, the cut-out 72 and the vertical membrane gasket 92 are dimensioned such that when the vertical membrane gasket 92 is installed it entirely fills in the cut-out 72 of the blocking 70.

The vertical membrane gasket 92 includes a vertical gasket base 94 having a sheet-like shape that extends in perpendicular horizontal directions, while also extending vertically. When the vertical membrane gasket 92 is installed at the left vertical edge 76, the vertical gasket base 94 extends in perpendicular directions from the left vertical edge 76 so as to wrap around the left vertical edge 76. The vertical membrane gasket 92 also includes a vertical gasket loop 96 attached to a side face of the vertical gasket base 94. In the first embodiment, the vertical gasket loop 96 is compressible to form a water-and-air resistant seal between horizontally adjacent modules 10, as described further below.

Figure 16:
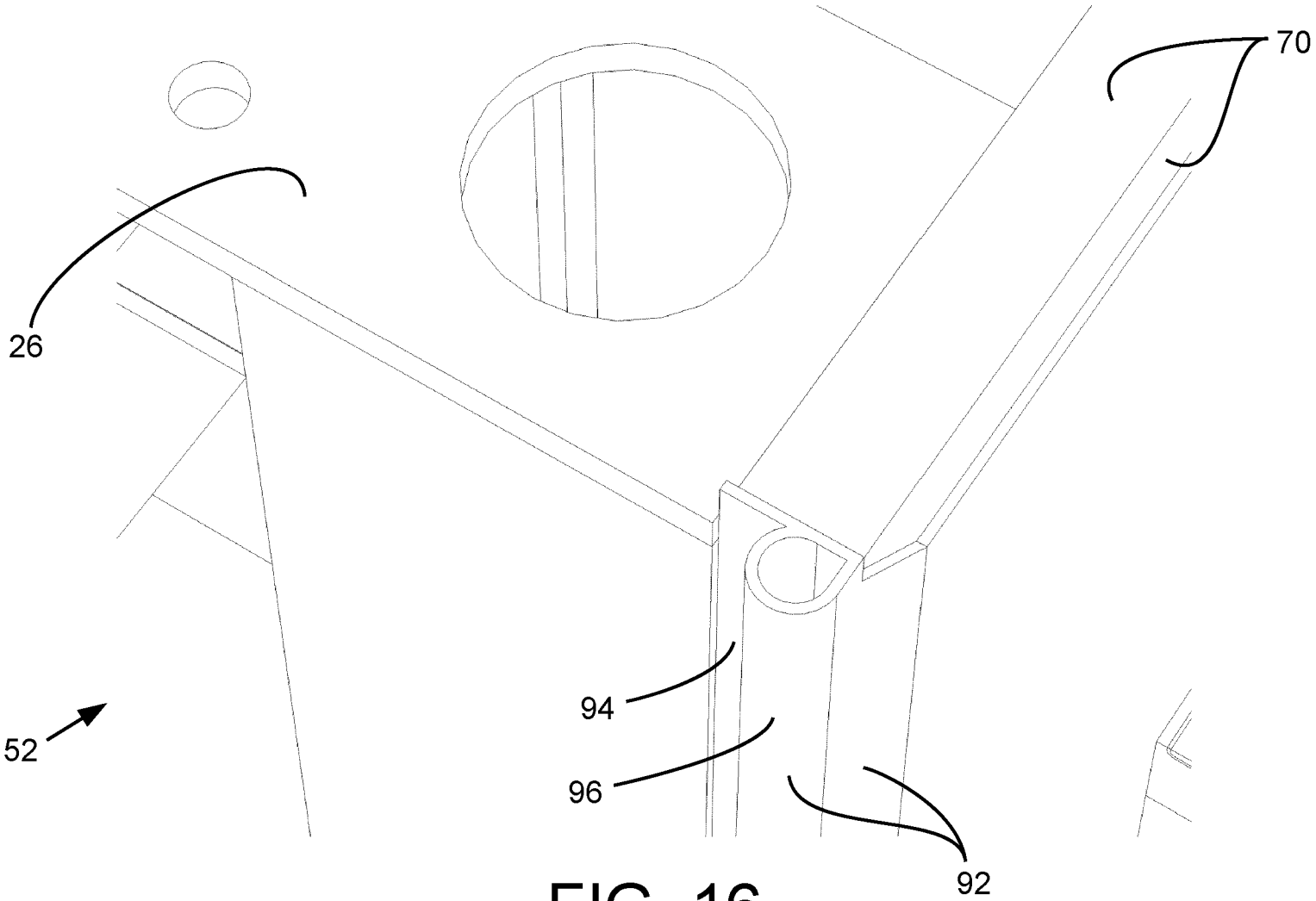
FIG. 16 is a close-up perspective view of the top-left corner shown in FIG. 15, showing the vertical membrane gasket from a second perspective angle.

As best seen in FIG. 16, the setback 84 and the vertical membrane gasket 92 are dimensioned such that the vertical gasket base 94 partly fills the setback 84.

Figure 15:
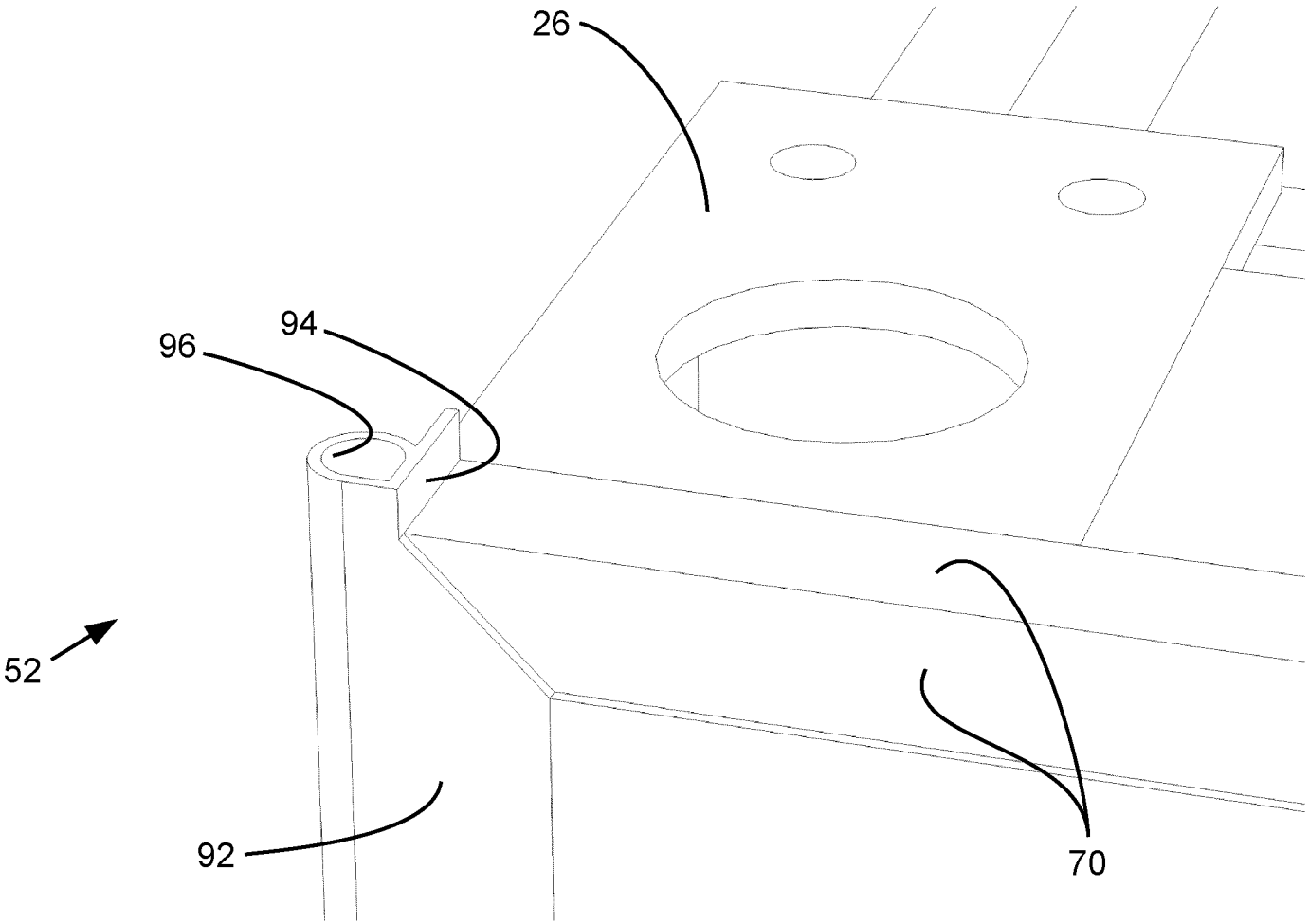
FIG. 15 is a close-up perspective view of the top-left corner of the end-frame member shown in FIG. 14, showing from a first perspective angle the vertical membrane gasket extending vertically above the height of the blocking.
Figure 17:
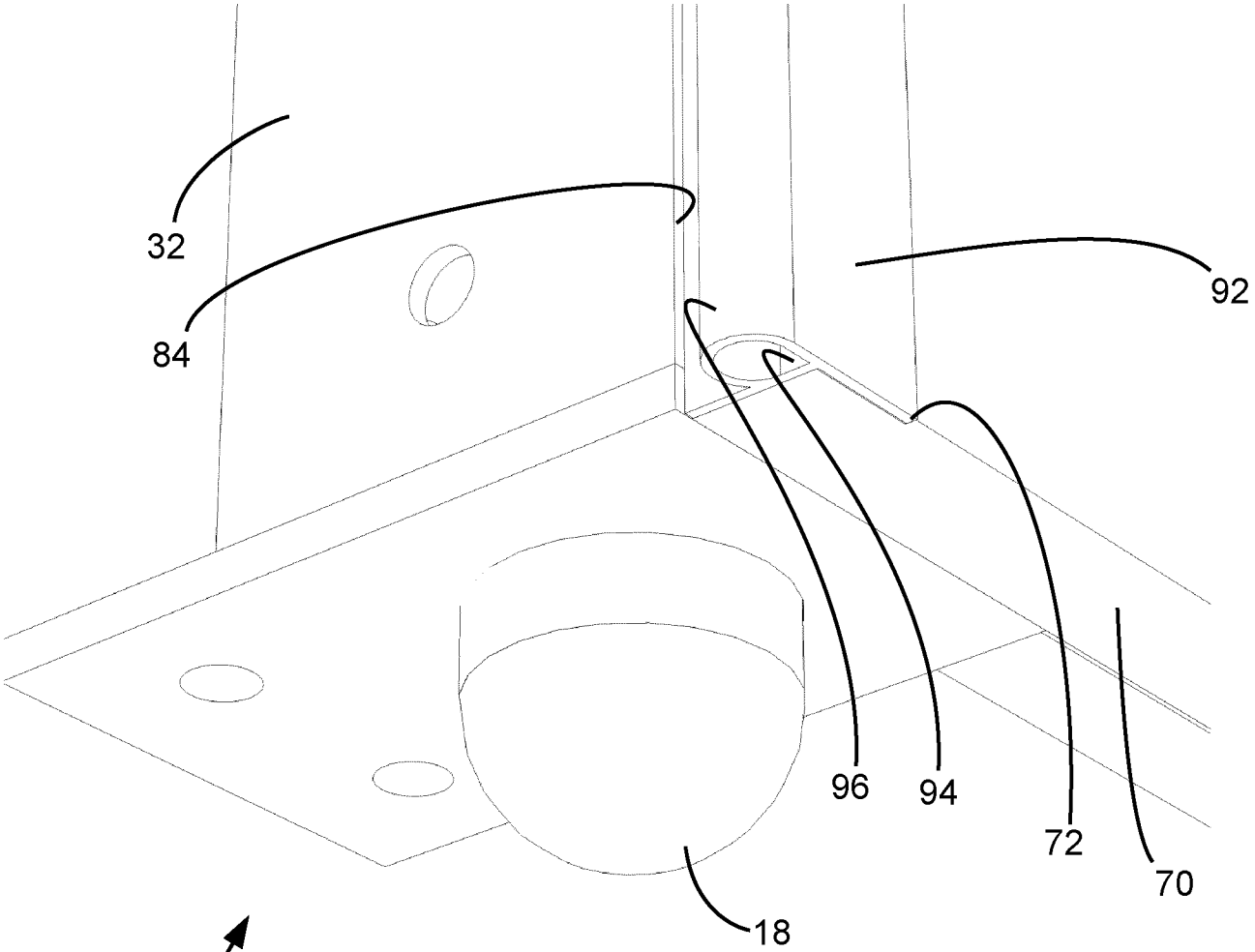
FIG. 17 is a close-up perspective view of the bottom-left corner of the end-frame member shown in FIG. 14, showing from a third perspective angle the vertical membrane gasket extending flush with the bottom of the blocking.

As best seen in FIGS. 15 and 16, the vertical membrane gasket 92 is dimensioned and installed to extend vertically above the blocking 70. In contrast, FIG. 17 shows the vertical membrane gasket 92 extending vertically so as to be flush with the bottom of the blocking 70 according to the first embodiment. In variations of embodiments, the dimensions and placement of the vertical membrane gasket 92 may be varied to suit particular applications. While the vertical membrane gasket 92 is shown in FIGS. 13 to 17 having a particular profile, other profiles are possible and are within the scope contemplated by the present invention.

Referring to FIGS. 18 to 21, a horizontal membrane gasket 98 is fastened, adhered, or otherwise attached to the blocking 70 on at least one exposed face of the blocking 70.

Analogous to the vertical membrane gasket 92 (FIGS. 14 to 17), the horizontal membrane gasket 98 is shown in FIGS. 18 to 21 extends over the blocking 70 on both perpendicular facing exposed surfaces of the blocking 70, including being installed over and entirely filling the cut-out 72. The horizontal membrane gasket 98 preferably also includes a base-and-compressible-loop shape, although other shapes are possible and within the scope contemplated by the present invention.

Figure 18:
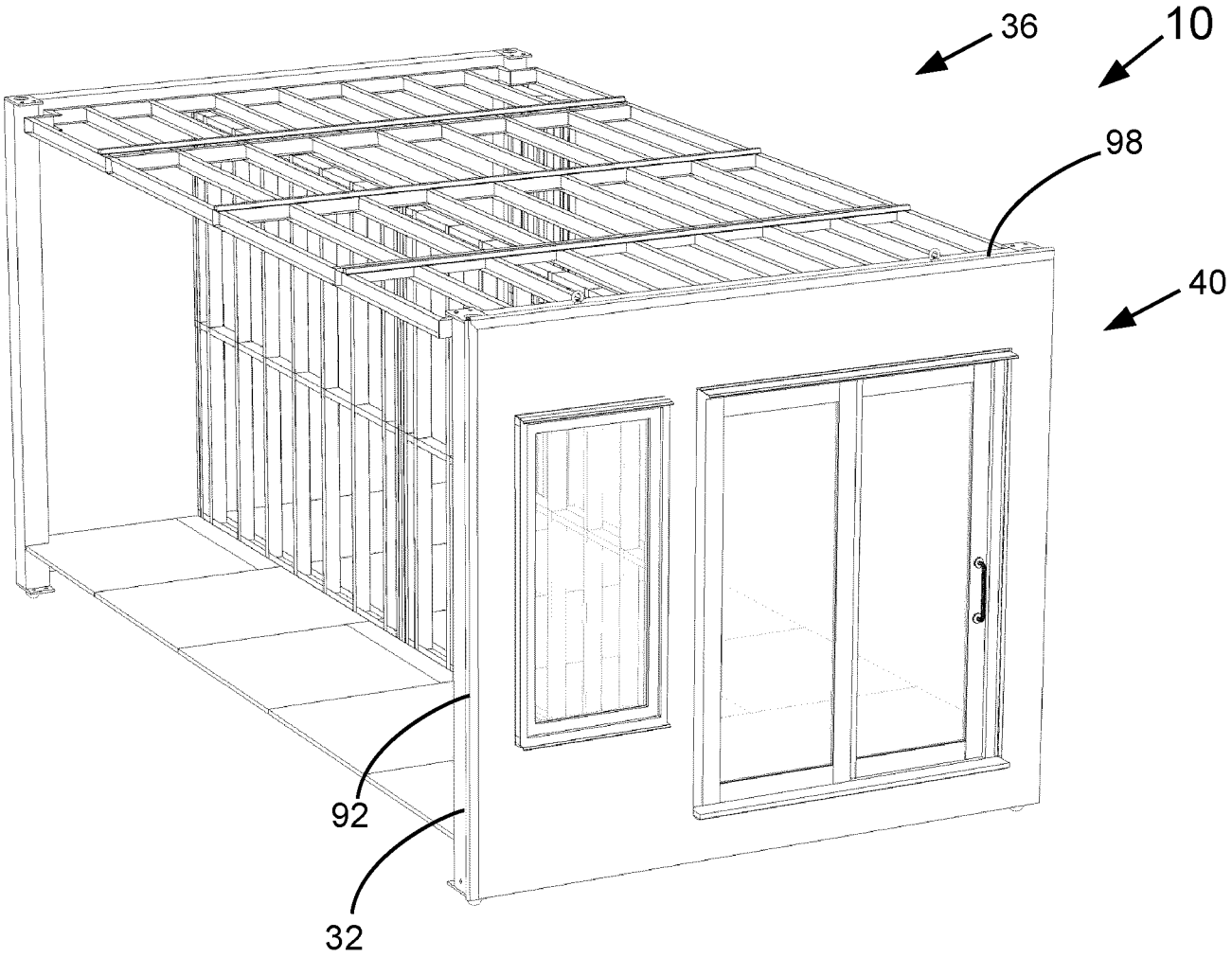
FIG. 18 is a perspective view of the end-frame member shown in FIG. 14, showing the addition of a horizontal membrane gasket.
Figure 19:
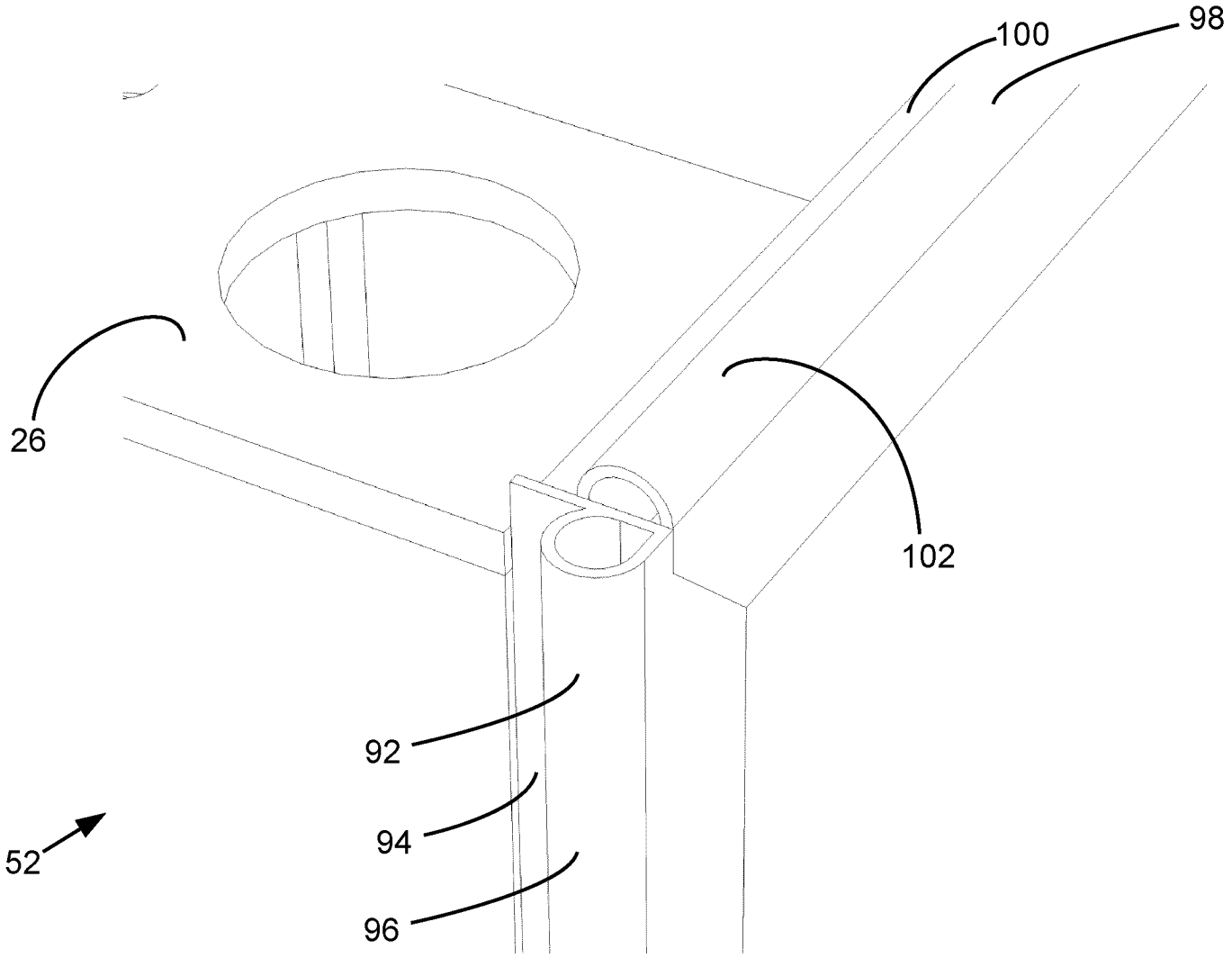
FIG. 19 is a close-up perspective view of the top-left corner of the end-frame member shown in FIG. 18, showing a first end of the horizontal membrane gasket from a first perspective angle.
Figure 20:
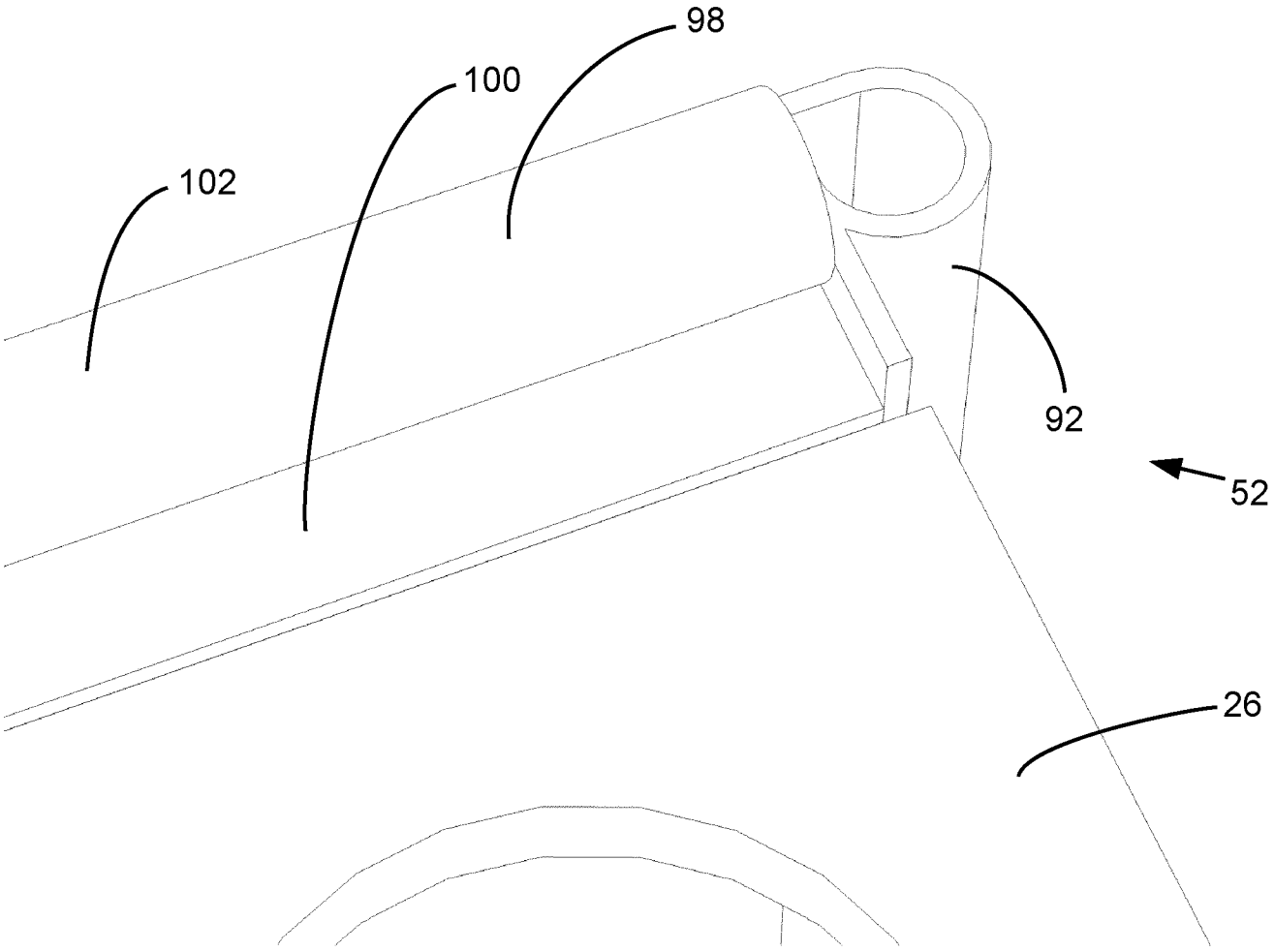
FIG. 20 is a close-up perspective view of the top-left corner of the end-frame member shown in FIG. 18, showing the first end of the horizontal membrane gasket from a second perspective angle.
Figure 21:
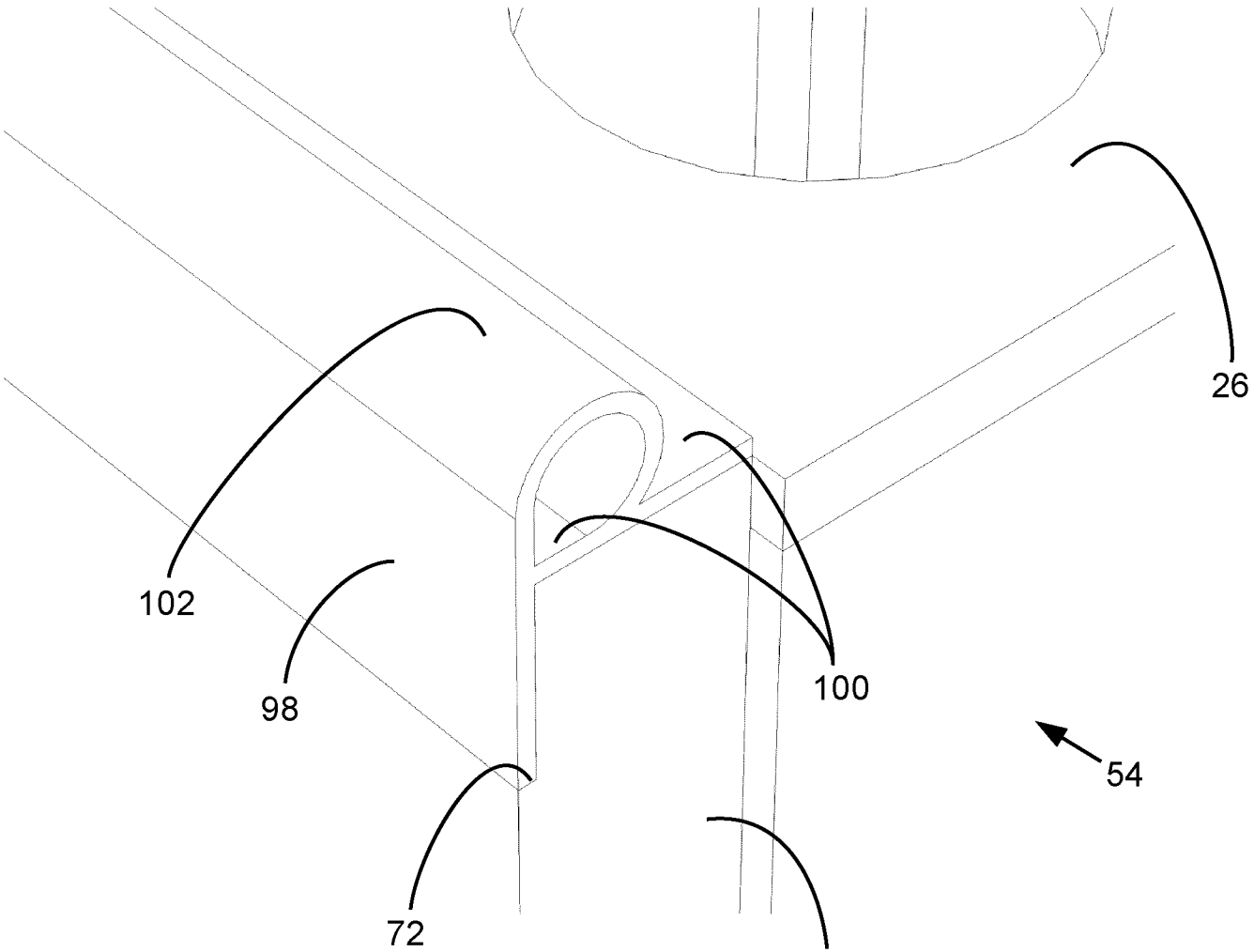
FIG. 21 is a close-up perspective view of the top-right corner of the end-frame member shown in FIG. 18, showing a second end of the horizontal membrane gasket.

FIG. 18 shows the vertical and horizontal membrane gaskets 92 and 98 meeting at the top-left corner 52 (FIG. 5)

of the exterior end-frame member 40. FIGS. 19 and 20 show a close-up view at the top-left corner 52, showing the vertical and horizontal membrane gaskets 92 and 98 from two different and generally opposing perspective angles. As best seen in FIG. 20, the vertical membrane gasket 92 extends vertically above the top of the horizontal gasket base 100 of the horizontal membrane gasket 98, but not above the top of the horizontal gasket loop 102 when it's in its uncompressed state. At the top-right corner 54 (FIG. 5) seen in the close-up view of FIG. 21, the horizontal membrane gasket 98 at its end opposite to that shown in FIGS. 19 and 20 terminates flush with the blocking 70 and entirely fills the cut-out 72. It will be appreciated by those skilled in the art that variations of dimensions and positions of the vertical and horizontal membrane gaskets 92 and 98 can provide effective seals between modules 10 and are within the scope contemplated by the present invention.

The vertical and horizontal membrane gaskets 92 and 98 may be made of any suitable material, including water-resistant and airtight materials such as EPDM (Ethylene Propylene Diene Monomers) rubber, silicone or other similar material, etc. In the first embodiment, the vertical membrane gasket 92 and the horizontal membrane gasket 98 are made of the same material and have the same cross-sectional dimensions such that each gasket 92 and 98 can be cut to size from the same gasket stock.

In some embodiments, an additional envelope membrane 82 may be applied over one or more membrane gaskets 92 and/or 98 and/or applied over the first envelope membrane 82 (FIG. 11), thereby advantageously providing additional protection.

Figure 22:
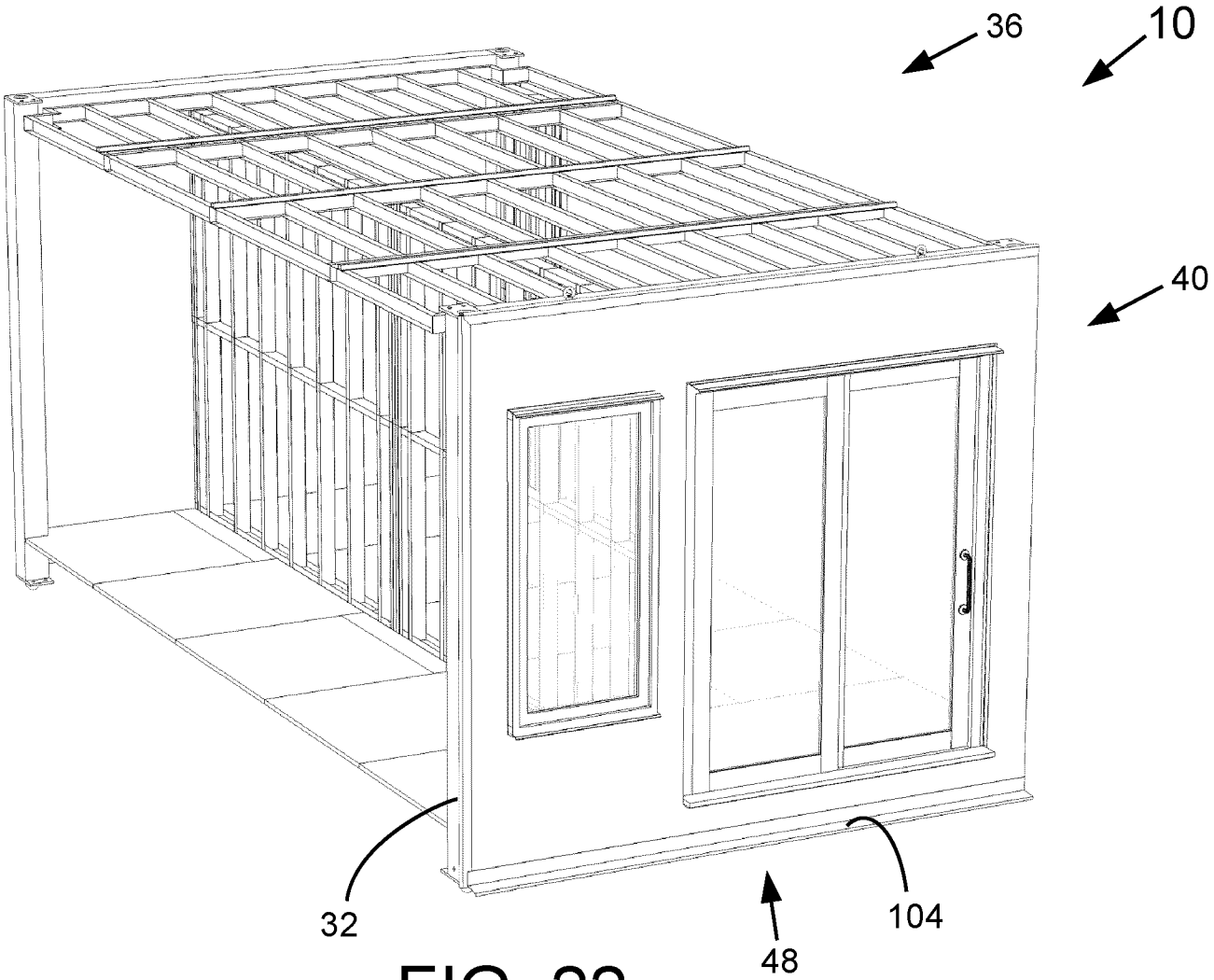
FIG. 22 is a perspective view of the end-frame member shown in FIG. 18, showing the addition of module flashing.

Referring to FIG. 22, module flashing 104 is fastened, adhered or otherwise attached at the bottom side 48 of the module 10. In the first embodiment, the module flashing 104 is applied to the blocking 70 over top of the envelope membrane 82 and over top of a bottom portion of the vertical gasket base 94. Preferably, the module flashing 104 is dimensioned to extend to the vertical edges of the blocking 70. In some embodiments, an additional membrane or similar material is applied onto the module flashing 104 and/or the envelope membrane 82.

Figure 23:
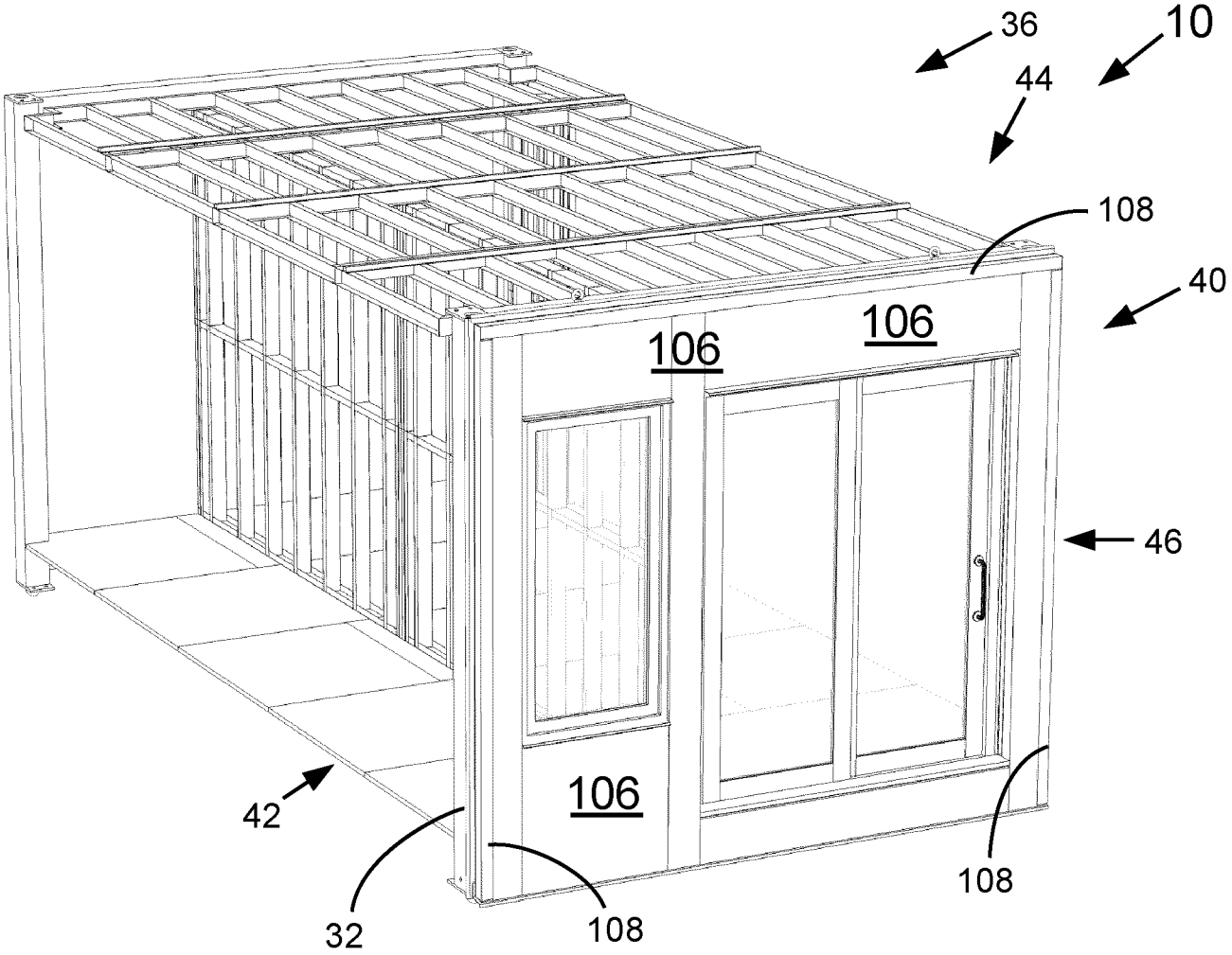
FIG. 23 is a perspective view of the end-frame member shown in FIG. 22, showing the addition of insulation and insulation border.

Referring to FIG. 23, insulation 106 is applied to the exterior end-frame member 40 over top of the envelope membrane 82 and over top of at least a portion of the module flashing 104, thereby advantageously providing outboard and continuous insulation. The insulation 106 of FIG. 23 is board insulation that is relatively non-compressible, although other types of insulation may be suitably employed. In the first embodiment, the insulation 106 is bounded at its border along the left side 42, top side 44 and right side 46 of the exterior end-frame member 40 by an insulation border 108. The insulation border 108 is typically made of a rigid material, and in embodiments wraps around the outer edges of the blocking 70 to form an angle or channel for example.

Figure 24:
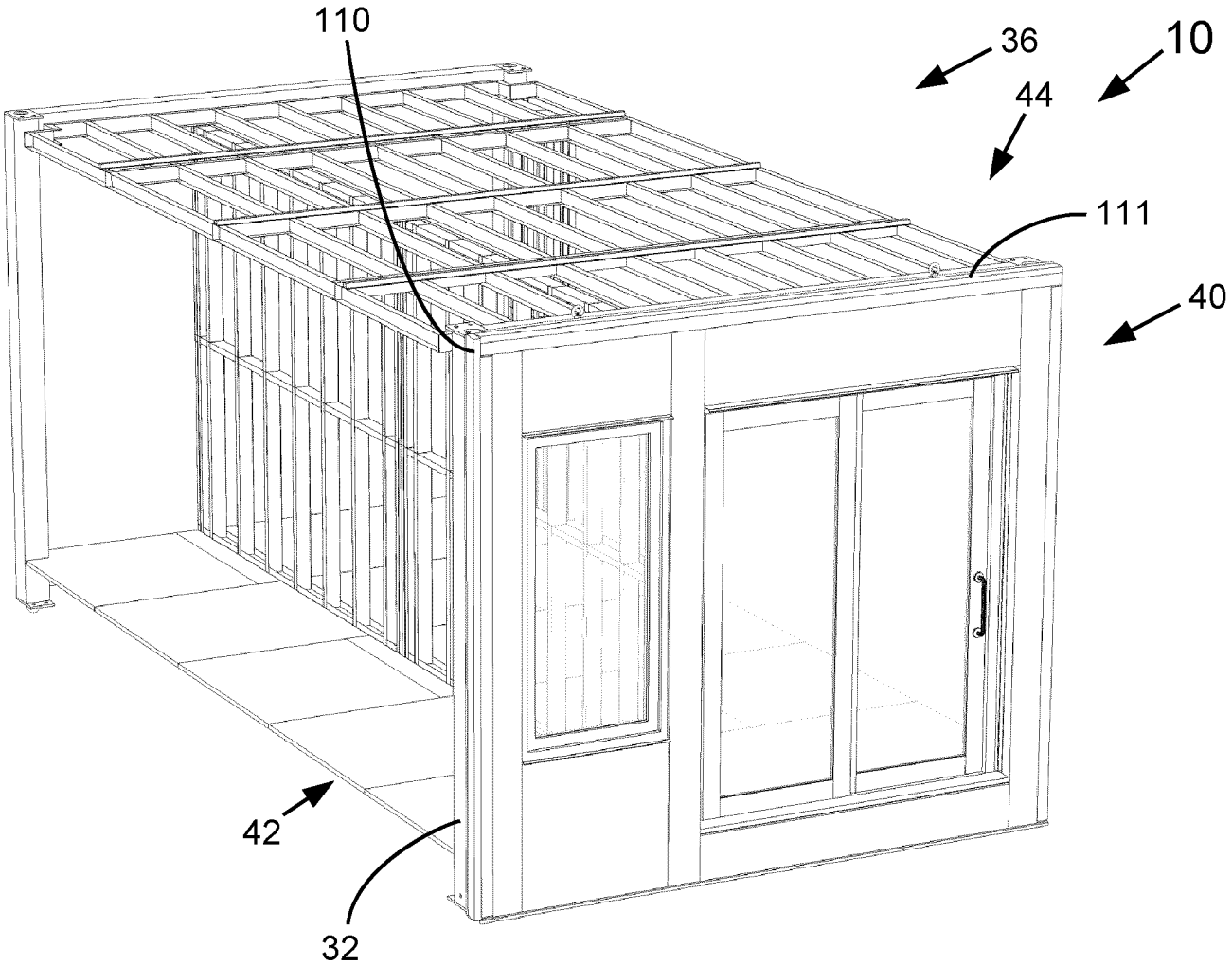
FIG. 24 is a perspective view of the end-frame member shown in FIG. 23, showing the addition of an insulation gasket.

Referring to FIG. 24, one or more insulation gaskets such as the vertical insulation gasket 110 and the horizontal insulation gasket 111 are mounted onto the insulation border 108. The insulation border 108 advantageously provides a clean, smooth surface on which to mount, such as by adhesion, the insulation gaskets 110 and 111. The insulation border 108 can also advantageously provide a clean, smooth surface for receiving insulation gaskets 110 and 111 from an adjacent module 10. Typically, each insulation gasket 110 and 111, when uncompressed, extends slightly beyond the ordinary boundaries of the module 10. In this manner, the insulation gaskets 110 and 111 become compressed to an operative state upon installation of the module 10 in a modular building.

Referring back to FIG. 3, a close-up view of the module 10 shows the horizontal insulation gasket 111 installed along the top side 44 of the module 10 is angled at its top surface relative to the plane of the connector plate 30. Such angled cut of the horizontal insulation gasket 111 facilitates compression of the horizontal insulation gasket 111 upon installation of the module 10 in a modular building. However, any top surface angle is possible including no angle such that the top surface of the horizontal insulation gasket 111 is substantially parallel to the connector plate 30.

The insulation gaskets 110 and 111 may be made of any suitable material, including dense but compressible materials such as neoprene, foam, other similar materials, and any combination thereof for example.

Figure 25:
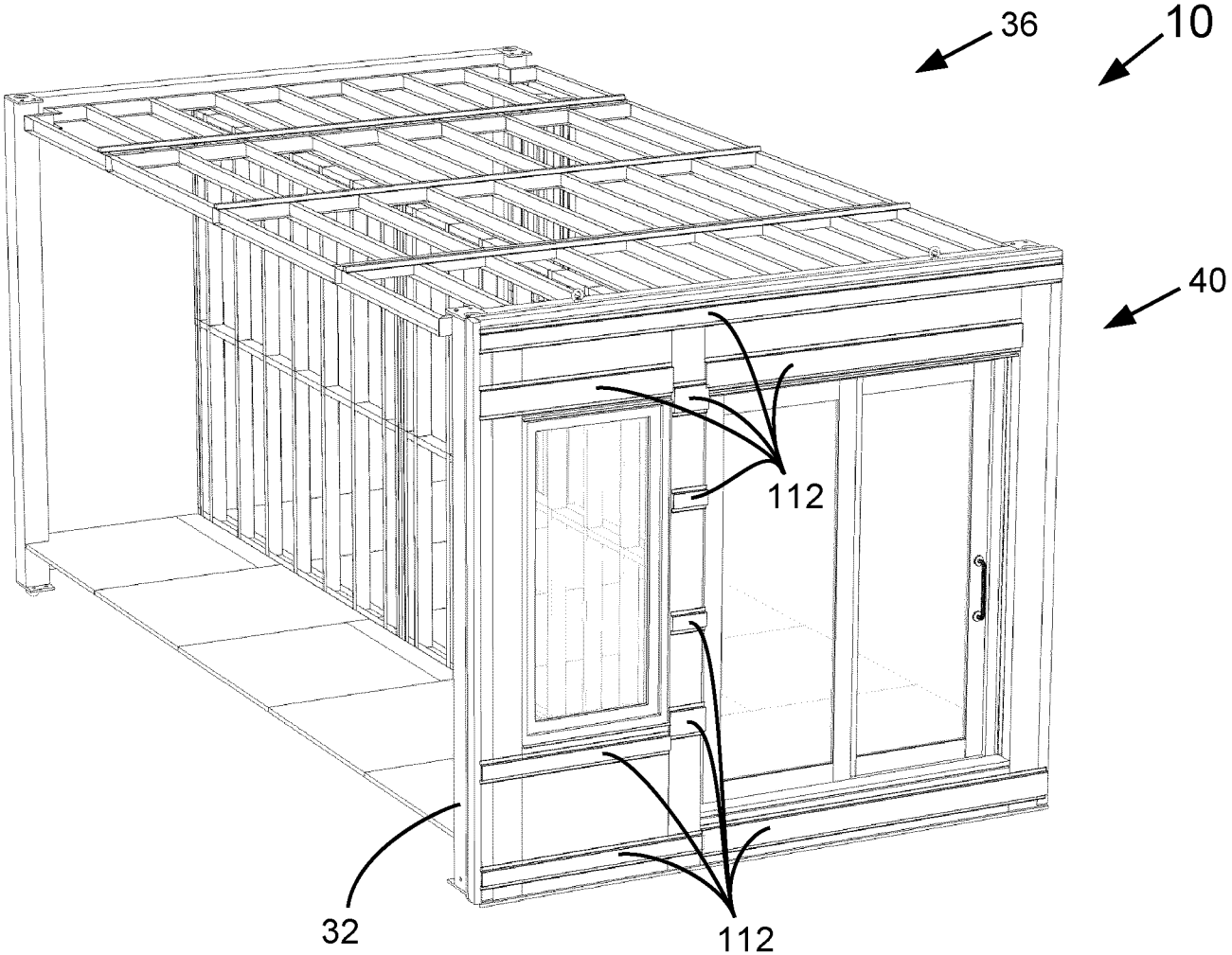
FIG. 25 is a perspective view of the end-frame member shown in FIG. 24, showing the addition of girts.

Referring to FIG. 25, girts 112 are installed over top of the insulation 106 and, typically over the insulation border 108, to further stabilize the exterior end-frame member 40 wall including the insulation 106. The girts 112 may have any suitable dimensions and be made of any suitable material. Although the girts 112 are shown in FIG. 25 as extending horizontally only, in general the girts 112 may extend either or both horizontally and vertically. In the first embodiment, the girts 112 extend nearly but not as far as the outer edges of the insulation border 108. In variations of embodiments, the girts 112 may extend beyond the outer edges of the insulation border 108 or may terminate flush with the outer edges of the insulation border 108.

Figure 26:
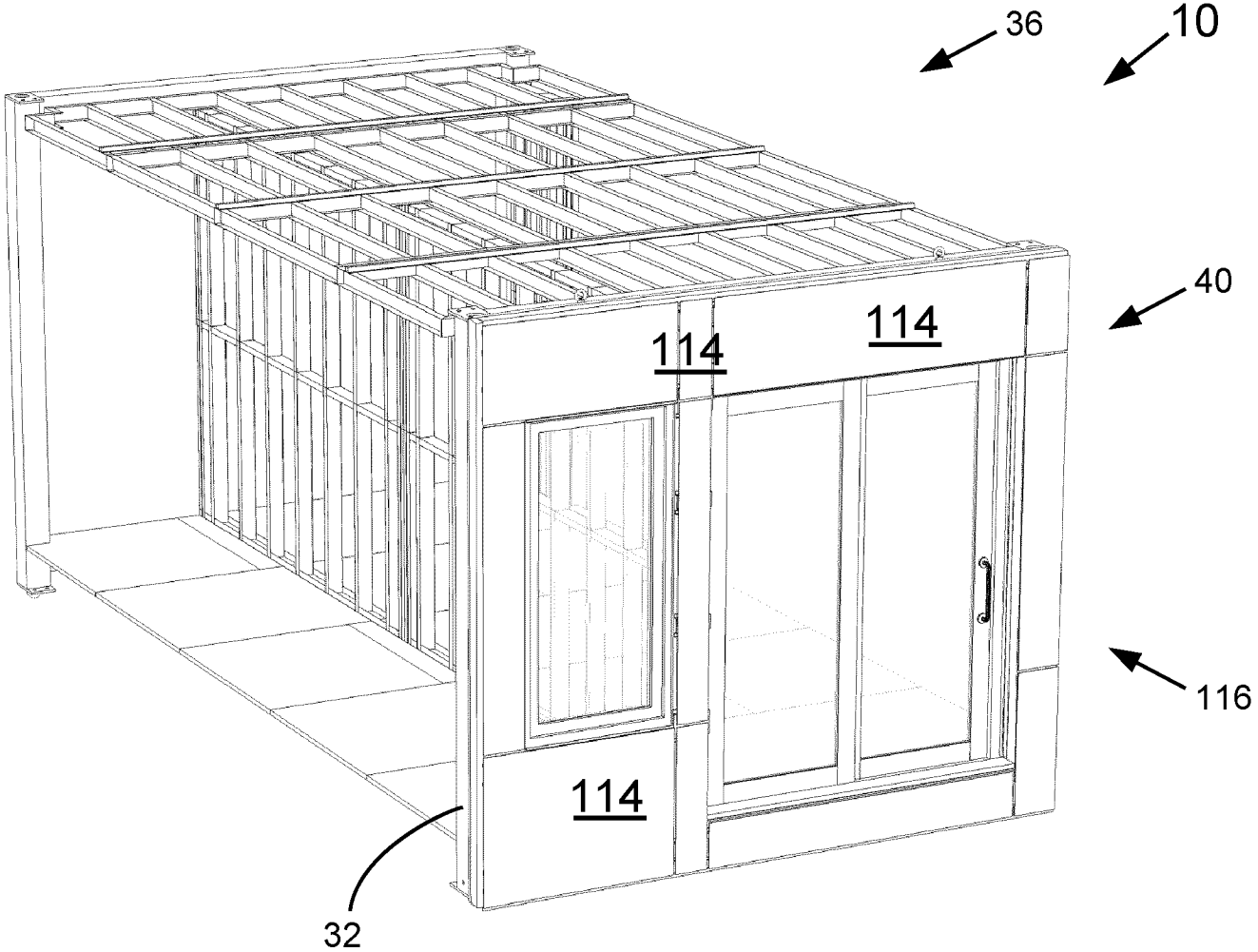
FIG. 26 is a perspective view of the end-frame member shown in FIG. 25, showing the addition of cladding to form an exterior wall.
Figure 27:
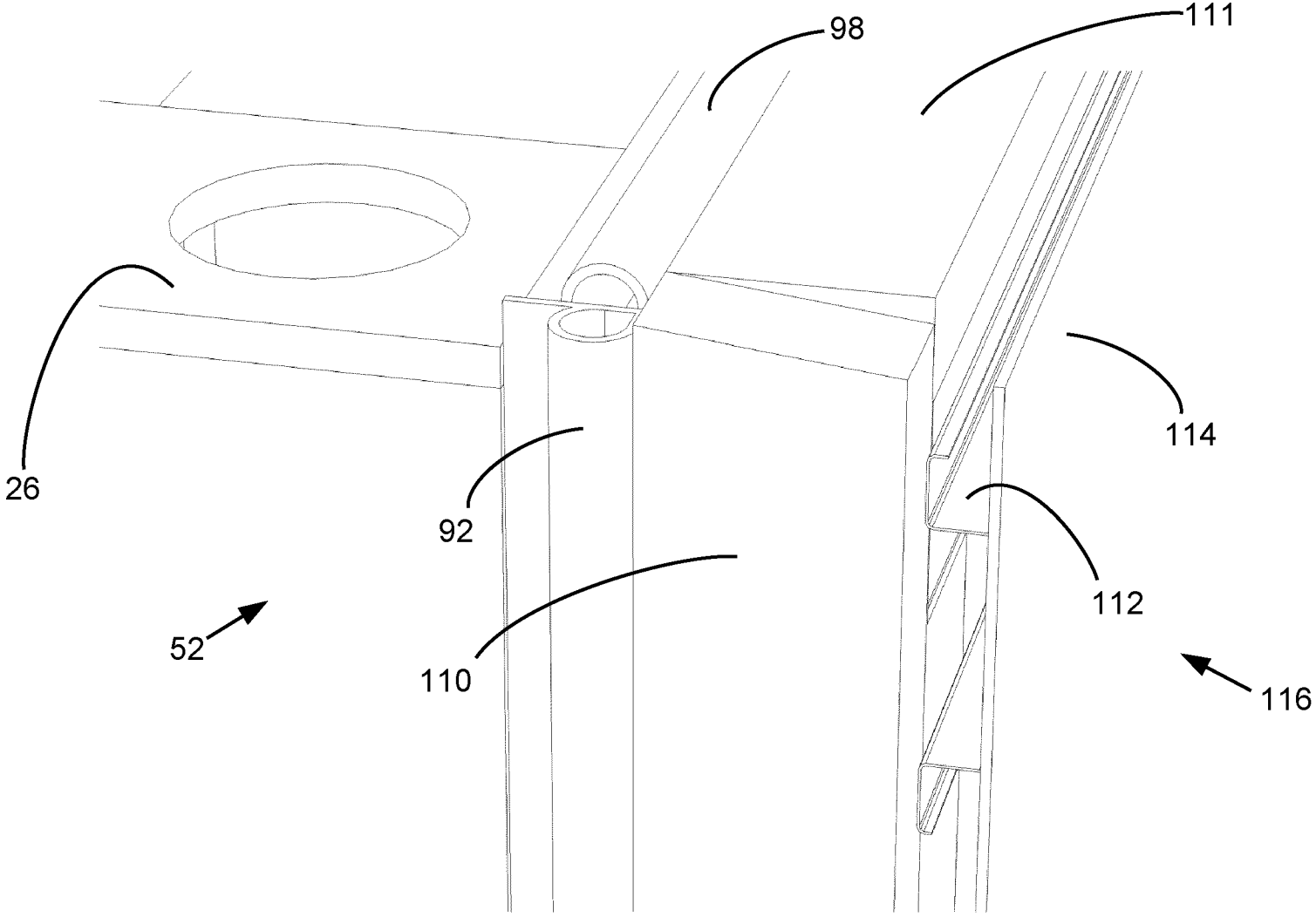
FIG. 27 is a close-up perspective view of the top-left corner of the exterior wall shown in FIG. 26, showing the membrane gaskets, insulation border, insulation gasket, girts and cladding in detail.
Figure 28:
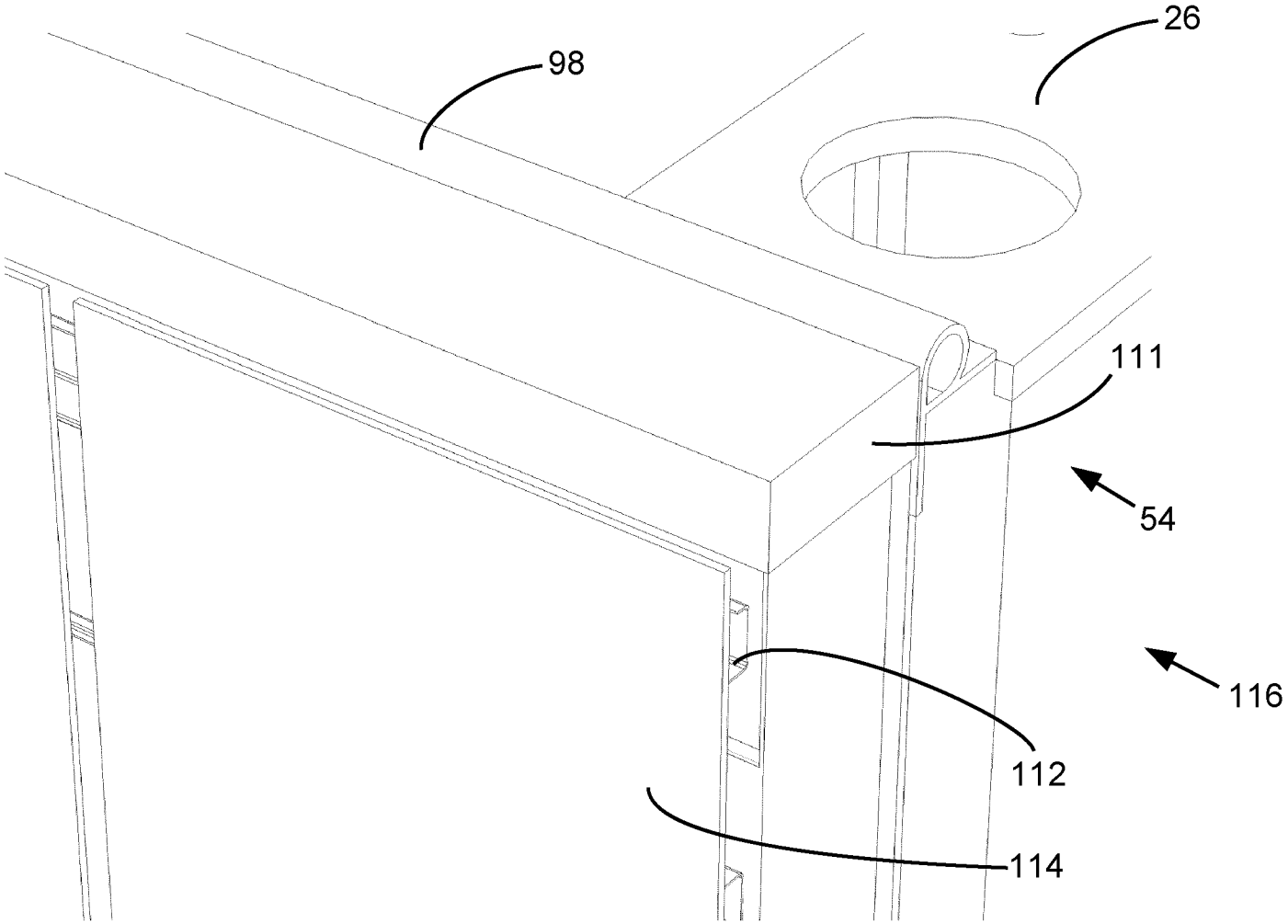
FIG. 28 is a close-up perspective view of the top-right corner of the exterior wall shown in FIG. 26.
Figure 29:
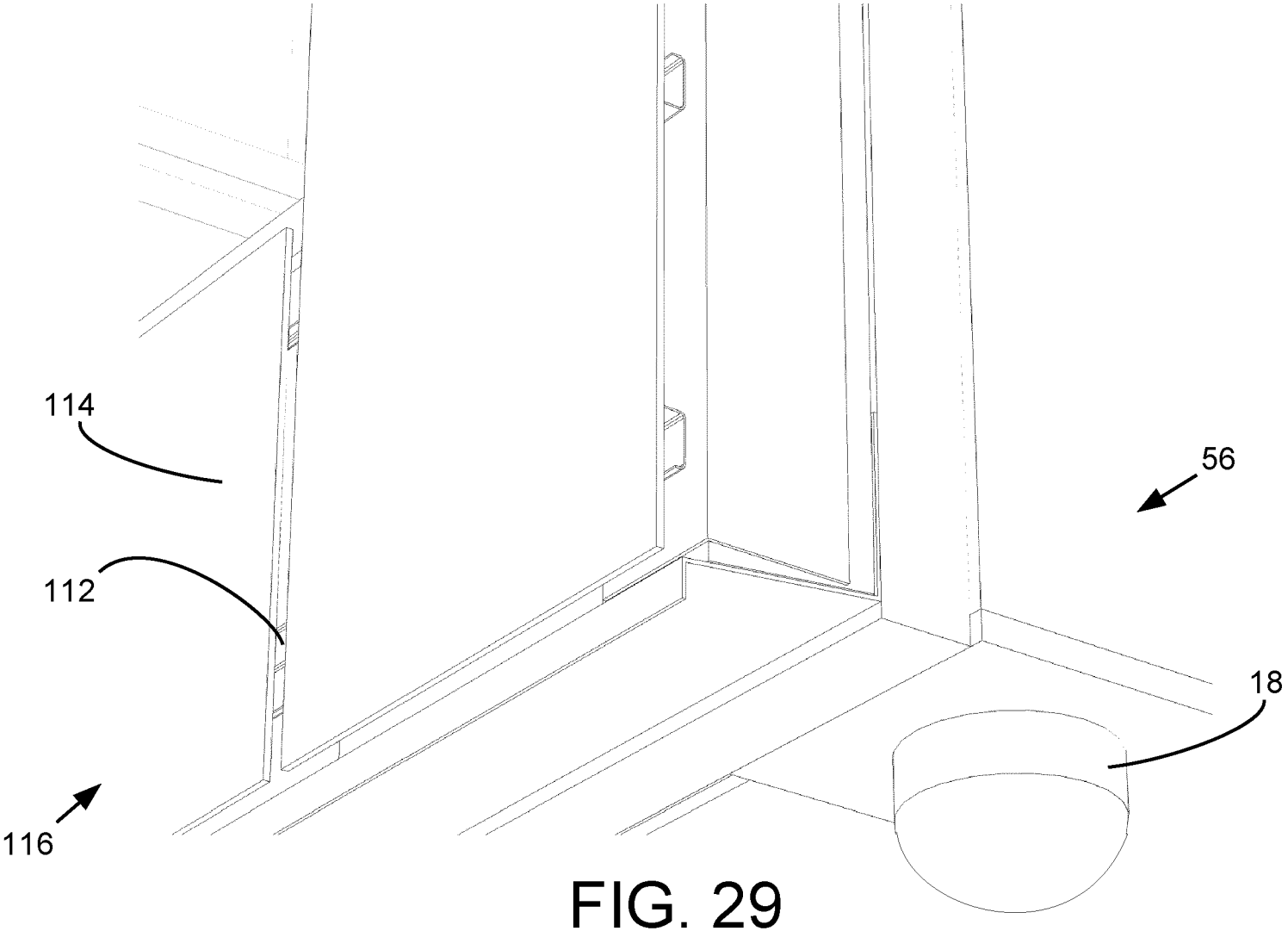
FIG. 29 is a close-up perspective view of the bottom-right corner of the exterior wall shown in FIG. 26.

Referring to FIGS. 26 to 29, cladding 114 is fastened to the girts 112, such that the girts 112 advantageously hold the insulation 106 in place and provide a surface on which to install and fasten the cladding 114, thereby producing a completed exterior wall 116 applied to the end-frame member 40. The cladding 114 advantageously enhances the aesthetic appearance of the wall 116. In variations, the cladding 114 may extend nearly but not as far as the outer edges of girts 112, beyond the outer edges of the girts 112, or may terminate flush with the outer edges of the girts 112. FIGS. 27 to 29 show close-up perspective views of the wall 116 at the top-left corner 52, top-right corner 54 and the bottom-right corner 56, respectively. While the wall 116 is particularly suited to exterior walls, in some embodiments the wall 116 is employed as an interior wall of the modular building. In some embodiments, the wall 116 is employed as an interior wall of the module 10.

The end-frame member 40 and the wall 116 in accordance with the first embodiment are advantageously accompanied by the connectors 18 and 26, and also advantageously accompanied by the membrane gaskets 92 and 98. In the first embodiment, the module 10 as shown in FIG. 26 is advantageously operable to form a sealed modular building by being installed and/or assembled with other modules 10, including possibly variants thereof, using an off-level installation technique described herein further below.

Module Fabrication Example 2

Figure 30:
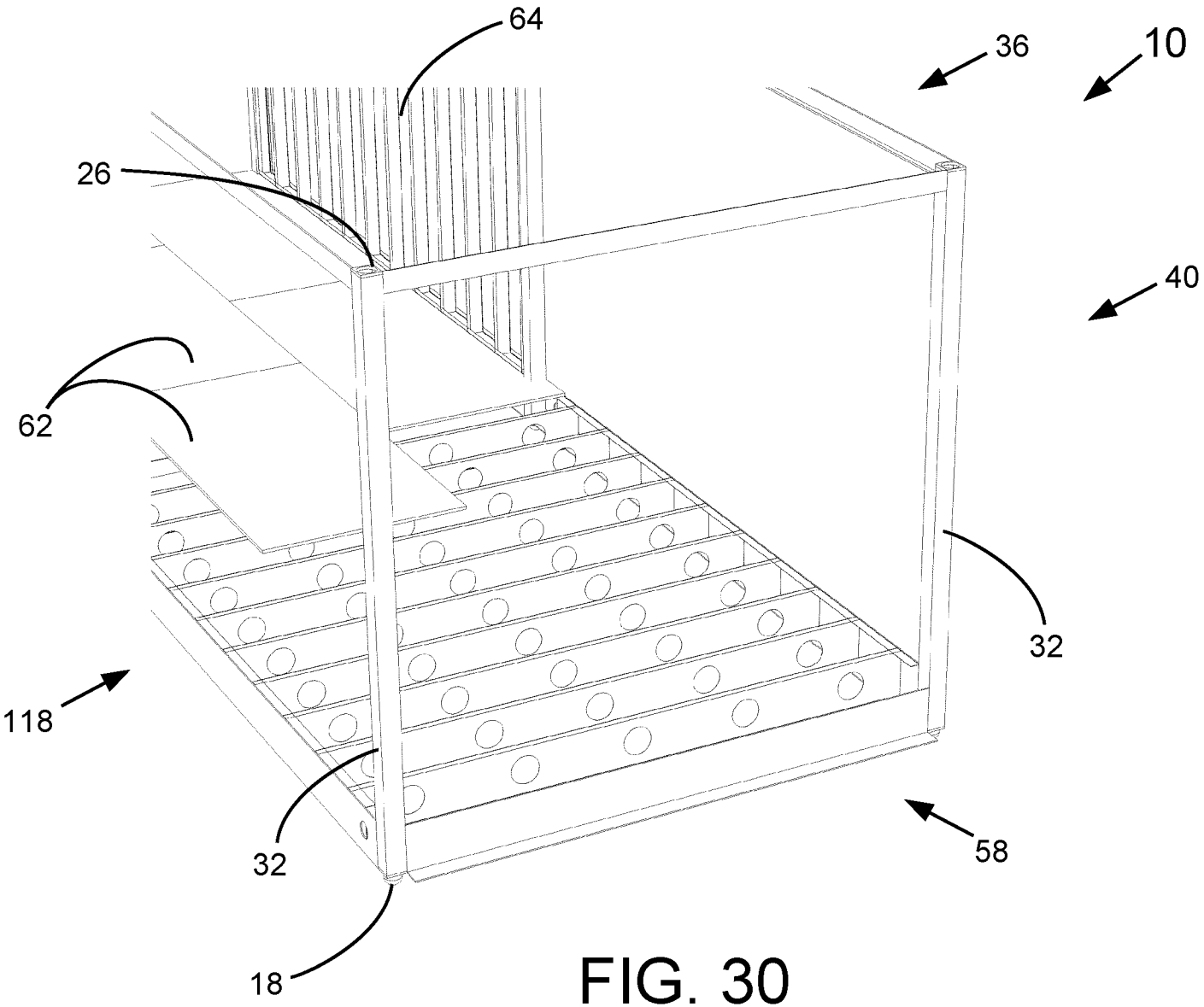
FIG. 30 is a perspective view of the frame shown in FIG. 5, showing a steel flooring structure supporting floor boards and showing the self-aligning connectors attached to the vertical columns of the end-frame member.

Referring to FIG. 30 and in accordance with a second embodiment of the invention, the frame 36 of the module 10 includes the end-frame member 40, which includes the column 32 having male and female connectors 18 and 26 disposed at opposing ends of the column 32.

FIG. 30 shows a steel flooring structure 118 providing support for the floor boards 62 (not all of which are shown) of the floor 58 that extends between the pair of end-frame members 40. The steel flooring structure 118 may employ parallel, spaced-apart heavy steel beams with light gauge steel joists spanning between the heavy steel beams, for example. In general, however, the module 10 of the second embodiment may have any suitable floor and ceiling. A ceiling is not shown in FIG. 30, as the floor 58 can act as a ceiling for a lower module 10 in a multi-level modular building (not shown in FIG. 30), but may or may not be provided in the second embodiment. An exemplary interior wall 64 is shown in FIG. 30, although it will be appreciated by those skilled in the art that any number and types of interior walls 64 may be employed in the module 10 of the second embodiment.

Figure 31:
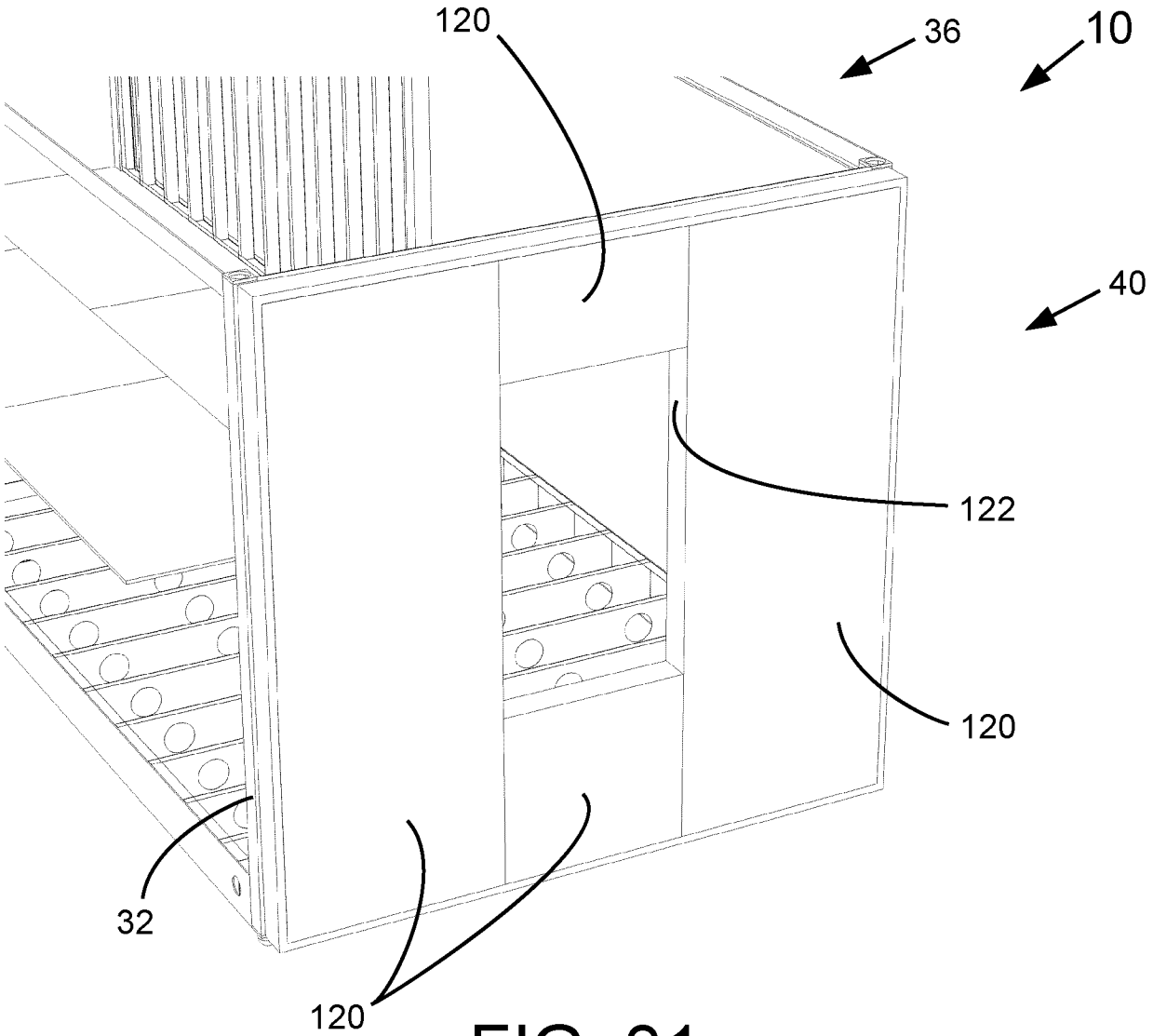
FIG. 31 is a perspective view of the end-frame member shown in FIG. 30, showing the addition of a SIP (Structural Insulated Panel) according to a second embodiment of the invention.

Referring to FIG. 31, a SIP (Structural Insulated Panel) 120 can be applied to the end-frame member 40. A plurality of SIPs 120 is applied to accommodate the window 122, door(s), or other fenestrations. The SIPs 120 may be fastened, adhered or otherwise attached to the end-frame member 40, for example. While the module 10 of the second embodiment is shown in FIG. 31 as having one window 122, it will be appreciated by those skilled in the art that the module 10 can have any number and type of fenestrations in accordance with any desired architectural design. Any suitable type of SIP 120 may be employed, including SIPs made of inner insulation sandwiched between two structural facings such as oriented strand board (OSB), sheet metal panels, or other facings for example. Other SIPs may suitably be employed. In the second embodiment, the SIPs 120 have a thickness of 6 inches (15.2 cm), although other thicknesses may be employed. For example, one or more SIPs 120 having a thickness in the range of 2 inches (5.1 cm) to 12 inches (30.5 cm) or greater may be employed. SIPs 120 having different thicknesses may be employed in the same modular building, in the same module 10, and/or in the same module 10 wall for example.

Figure 32:
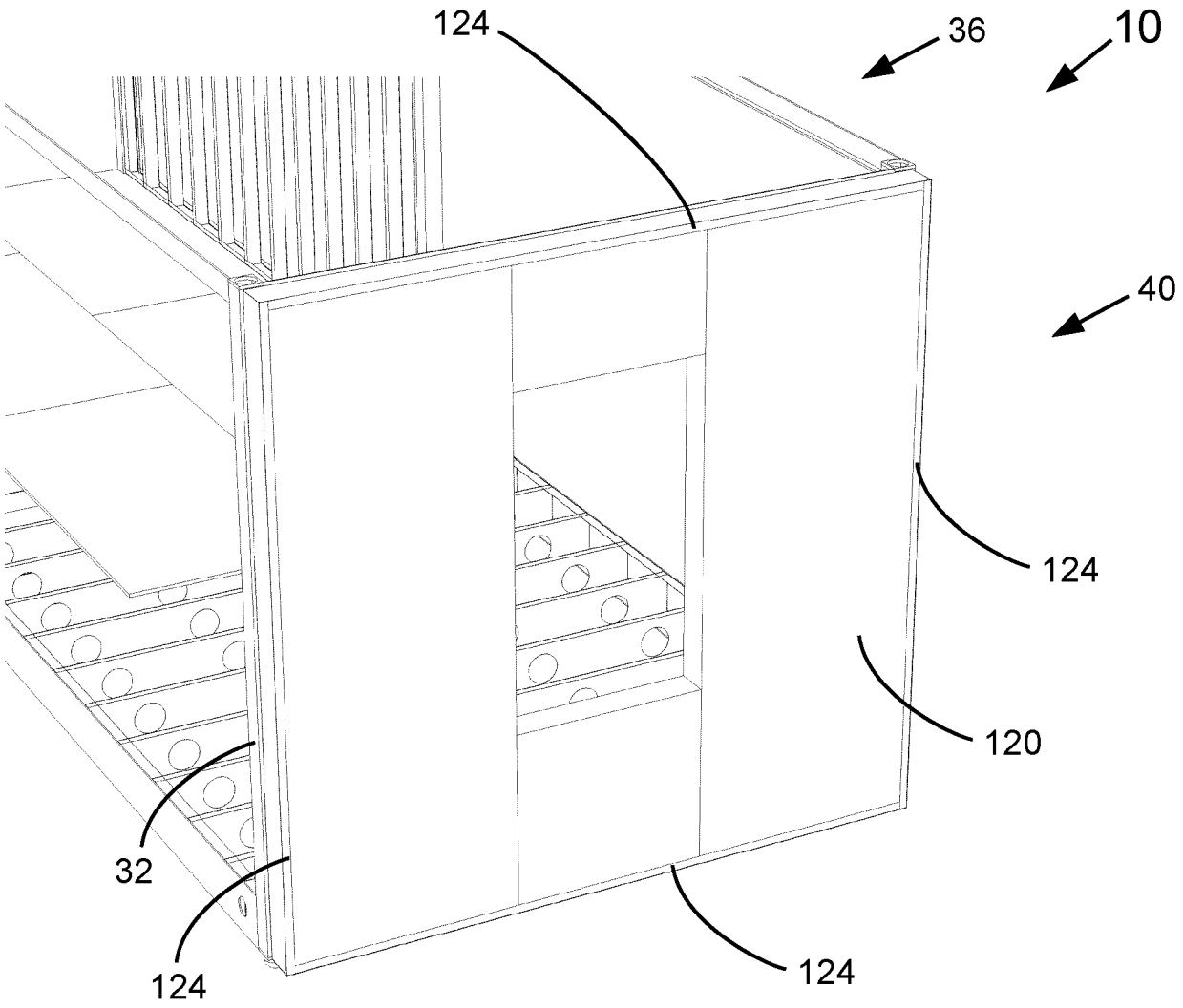
FIG. 32 is a perspective view of the end-frame member shown in FIG. 31, showing the addition of a SIP edging.

Referring to FIG. 32, one or more SIP edgings 124 are installed to the SIPs 120. The SIP edgings 124 are typically metal channels having a U-shape that are capped to the outer perimeter edges of the SIPs 120 at a given face of the module 10. The SIP edgings 124 may be made out of sheet metal (e.g. light gauge steel), for example. The SIP edgings 124 advantageously cap the SIP 120 insulation within the SIPs 120 and advantageously facilitate the fastening of building components (described herein below) to the SIPs 120. In some embodiments (not shown), one or more SIP edgings 124 are installed to frame the window 122, doors or other fenestrations, such as by being installed inside the fenestration opening for example.

Figure 33:
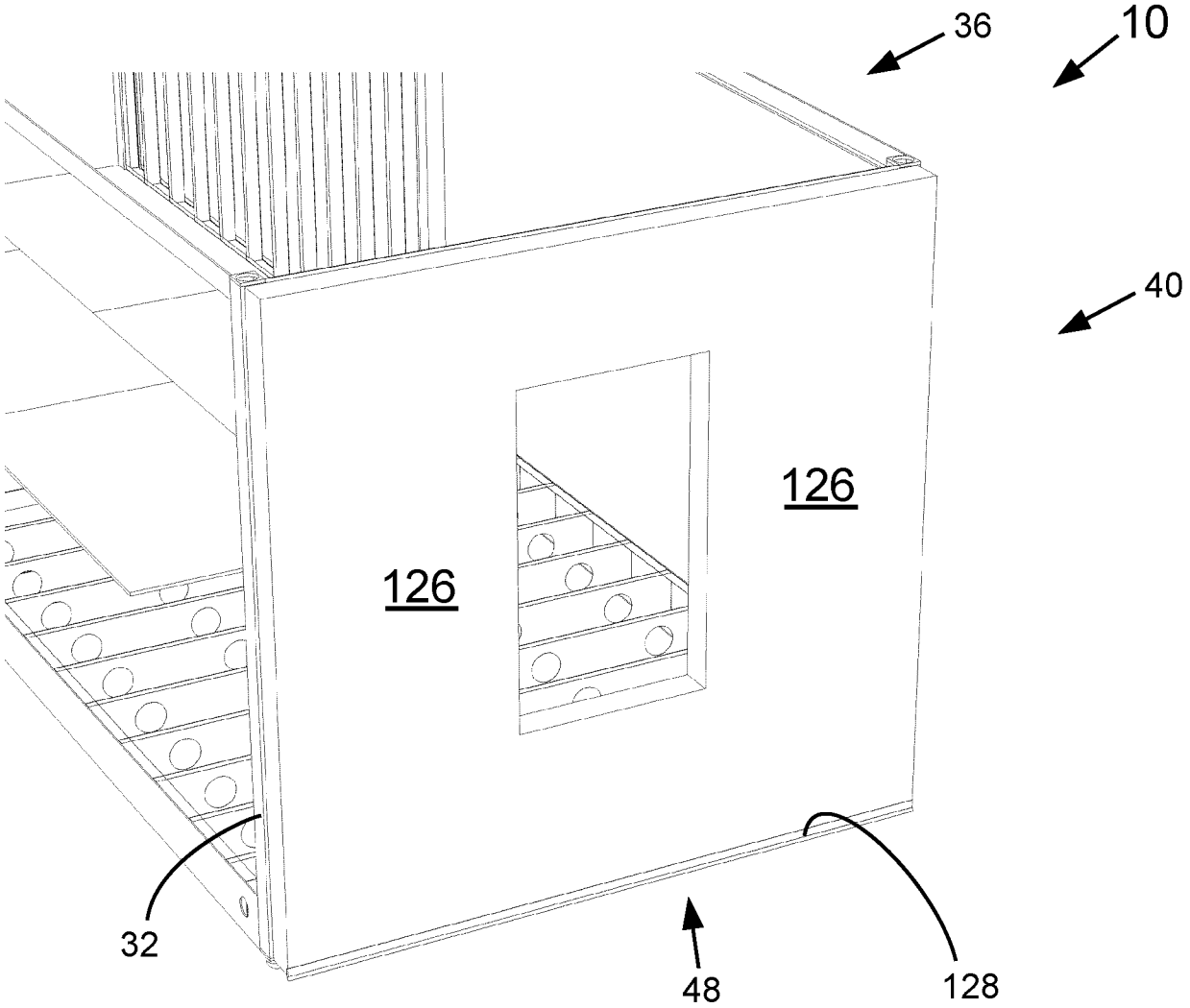
FIG. 33 is a perspective view of the end-frame member shown in FIG. 32, showing the addition of a SIP envelope membrane and a SIP flashing.

Referring to FIG. 33, a SIP envelope membrane 126 is applied over top of the SIPs 120 and the SIP edgings 124. The SIP envelope membrane 126 can be any suitable membrane, including being identical, similar or analogous to the envelope membrane 82 (FIG. 11), for example. FIG. 33 also shows the installation of a SIP flashing 128 along the bottom side 48 of the end-frame member 40. Any suitable SIP flashing 128 may be employed, including flashing that is identical, similar or analogous to the module flashing 104 (FIG. 22).

Figure 34:
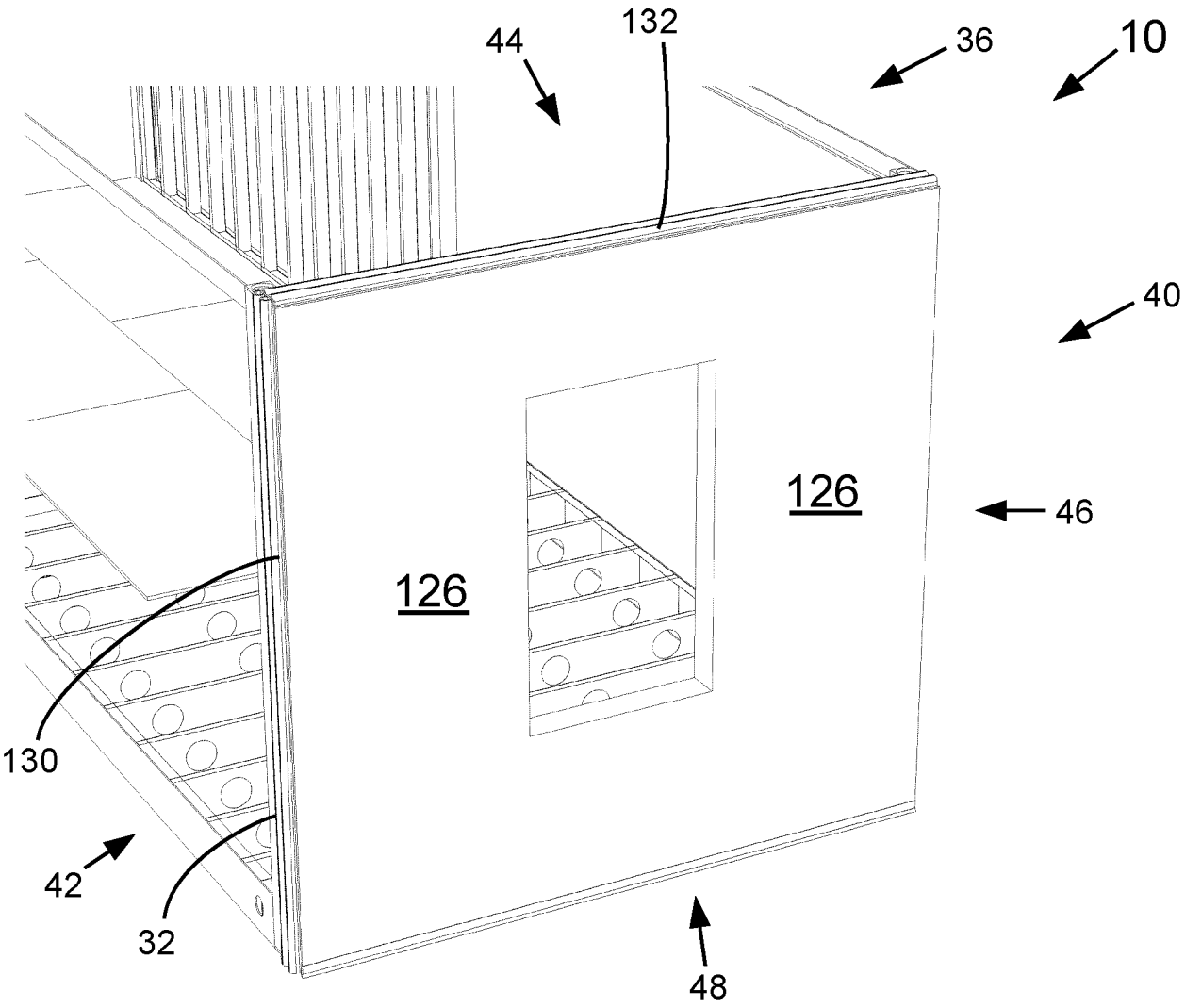
FIG. 34 is a perspective view of the end-frame member shown in FIG. 33, showing the addition of vertical and horizontal SIP gaskets.

Referring to FIG. 34, at least one vertical SIP gasket 130 is installed along the left side 42 of the end-frame member 40, and at least one horizontal SIP gasket 132 is installed along the top side 44 of the end-frame member 40. In the second embodiment, each SIP gasket 130 and 132 includes a base and two loop sections in a manner analogous to, but different from, the membrane gaskets 92 and 98 (FIGS. 14 to 21). The outer loop section advantageously provides a water seal and airtightness, while the inner loop section advantageously provides additional airtightness and additional thermal insulation by creating additional air pockets or cavities between the two loop sections of each SIP gasket 130 and 132. In some embodiments, one or more SIP gaskets 130 and/or 132 may be installed to frame the windows 122, doors or other fenestrations, such as by being installed inside the fenestration opening for example. Such SIP gaskets 130 and/or 132 may be combined with corresponding SIP edgings 124, for example. Such SIP gaskets 130 and/or 132 advantageously provide for self-sealing of such fenestrations and to assist leveled installation of windows, etc.

The SIP gaskets 130 and 132 may be made of material(s) that are identical, similar or different from those of the membrane gaskets 92 and 98, for example. In variations of the second embodiment, any number and dimensions of SIP gaskets 130 and 132 may be employed in any suitable arrangement.

Figure 35:
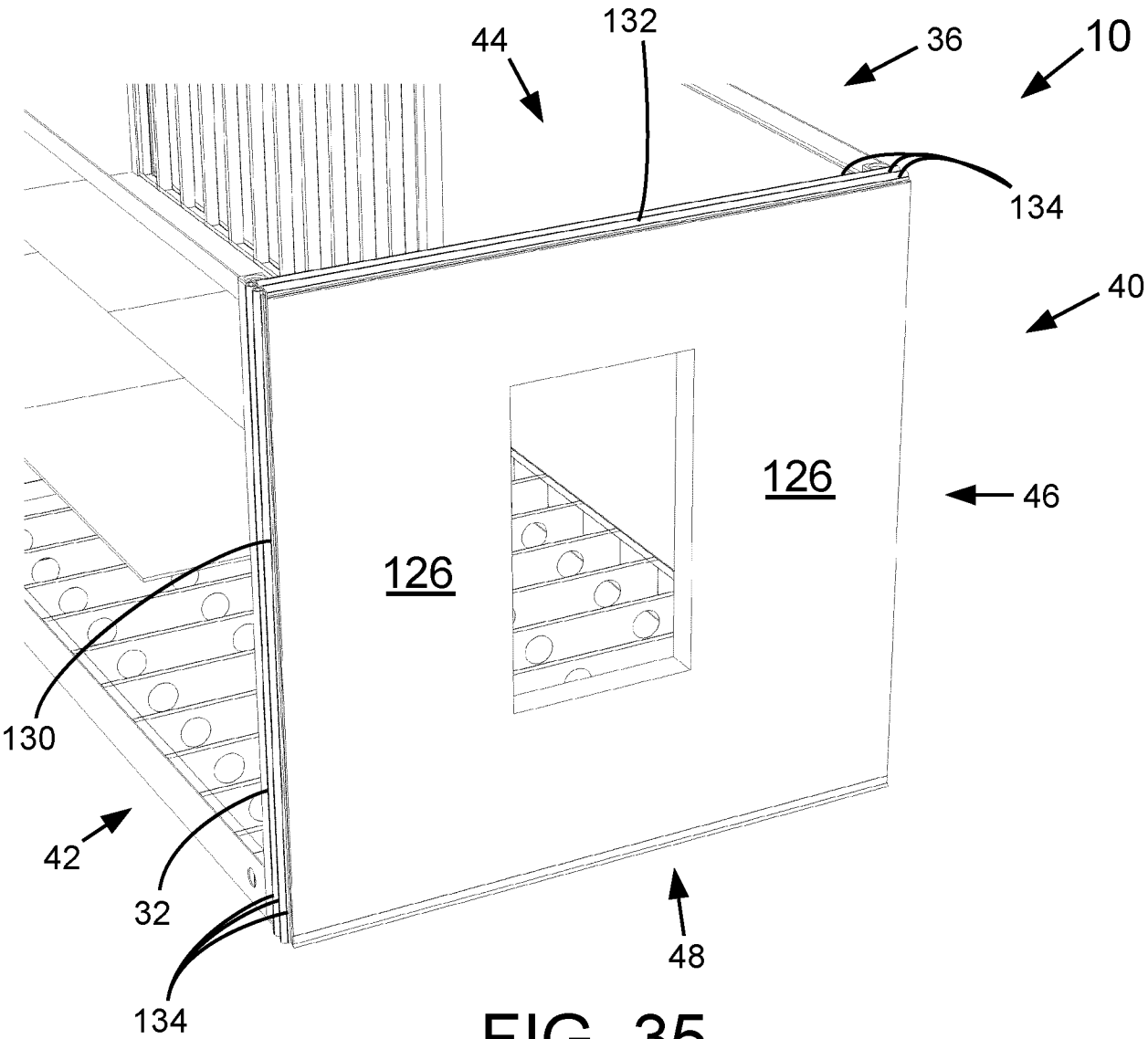
FIG. 35 is a perspective view of the end-frame member shown in FIG. 34, showing the addition of gasket channels.
Figure 36:
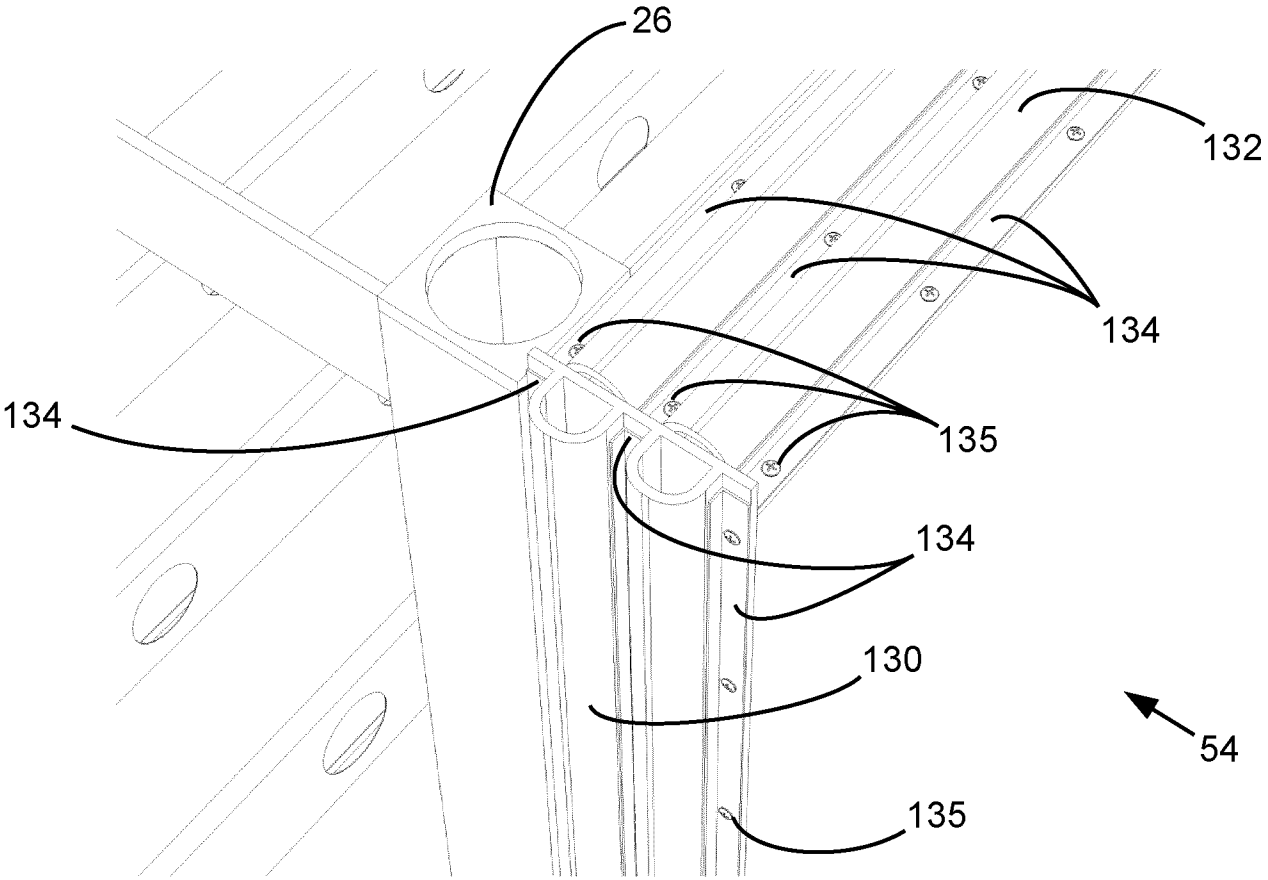
FIG. 36 is a close-up perspective view of the top-left corner of the end-frame member shown in FIG. 35, showing the gasket channels attached by fasteners.

Referring to FIGS. 35 and 36, gasket channels 134 are installed onto the base and loop edges of the vertical and horizontal SIP gaskets 130 and 132. The gasket channels 134 are preferably made of a rigid or semi-rigid material such as sheet metal (e.g. light gauge steel), plastic or similar for example. FIG. 36 shows in a close-up view the SIP gaskets 130 and 132 and the gasket channels 134 at the top-left corner 52 of the end-frame member 40. As can be best seen in FIG. 36, the vertical SIP gasket 130 extends vertically above the gasket channels 134 associated with both the vertical and horizontal SIP gaskets 130 and 132.

As can be seen in FIG. 36, fasteners such as screws 135 are used in the second embodiment to fasten the gasket channels 134 to the SIP edgings 124 through the base of the SIP gaskets 130 and 132, such that the SIP gaskets 130 and 132 are pressure fitted to the SIPs 120. In variations of embodiments, the SIP gaskets 130 and 132 can be adhered to the SIP edgings 124 or adhered directly to the SIPs 120 edges. Thus, the SIP edgings 124 are optional in some embodiments. In some embodiments, the SIP gaskets 130 and 132 are both adhered and fastened in place. In a further variation (not shown), the SIP gaskets 130 and 132 may be pressure fit into a groove established along the outer perimeter of the SIPs 120, for example.

Figure 37:
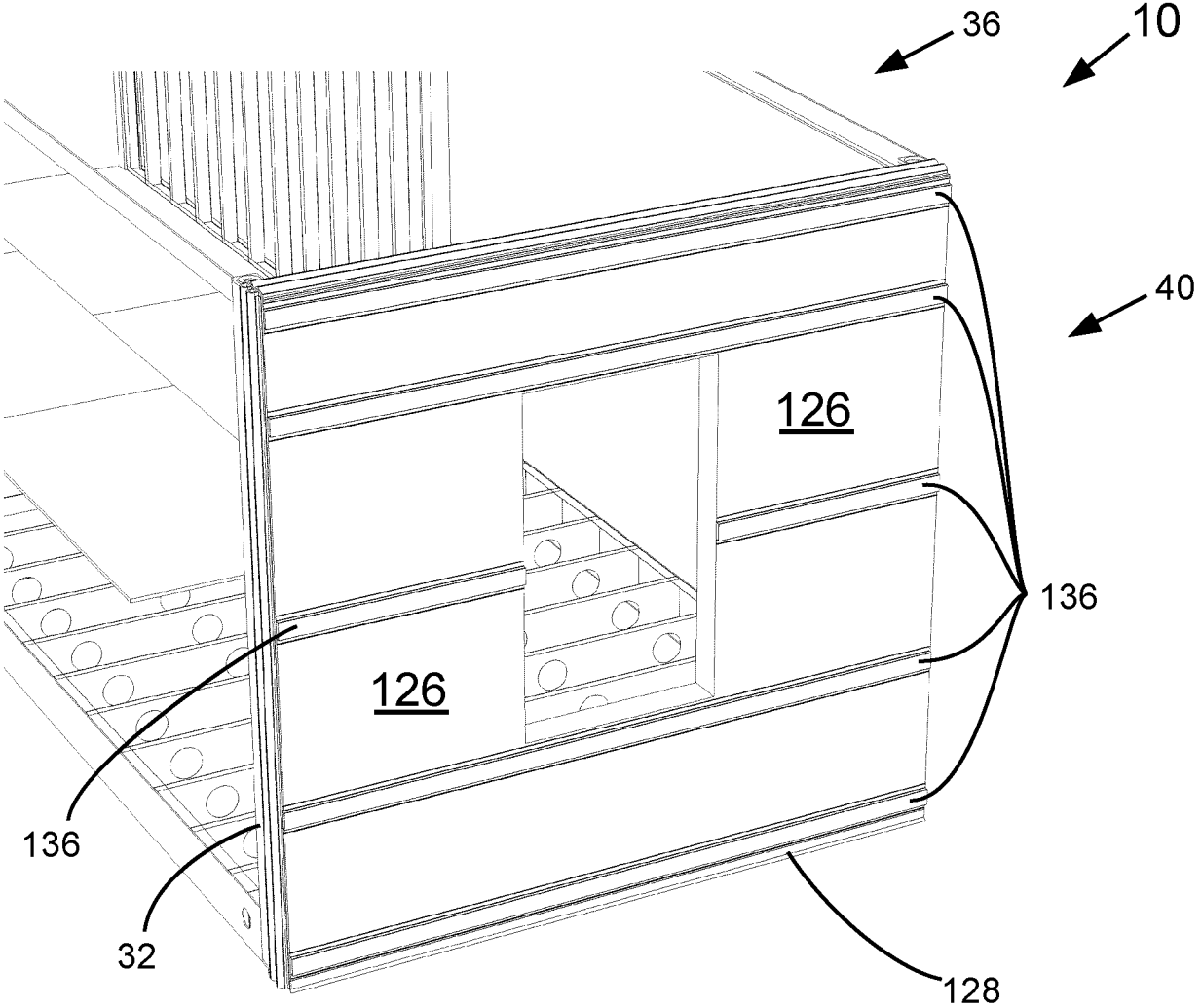
FIG. 37 is a perspective view of the end-frame member shown in FIG. 33, showing the addition of girts.

Referring to FIG. 37, SIP-mountable girts 136 are installed over the SIP envelope membrane 126 and the SIP flashing 128. The SIP girts 136 may be identical, similar or different from the girts 112 shown in FIG. 25. Typically, the SIP girts 136 are fastened to the SIP 120 and/or its SIP edging 124, but may be adhered or otherwise attached for example.

Referring to FIGS. 38 to 42, cladding panels 138 are installed over the girts 136 to form a completed SIP-type exterior wall 140. The cladding panels 138 may be identical, similar or different from the cladding 114 (FIG. 26), for example. FIGS. 39 to 42 show close-up perspective views of the SIP-type wall 140 at the bottom-left corner 50, top-left corner 52, top-right corner 54 and the bottom-right corner 56, respectively. While the SIP-type wall 140 is particularly suited to exterior walls, in some embodiments the SIP-type wall 140 is employed as an interior wall of the modular building. In some embodiments, the SIP-type wall 140 is employed as an interior wall of the module 10.

Figure 38:
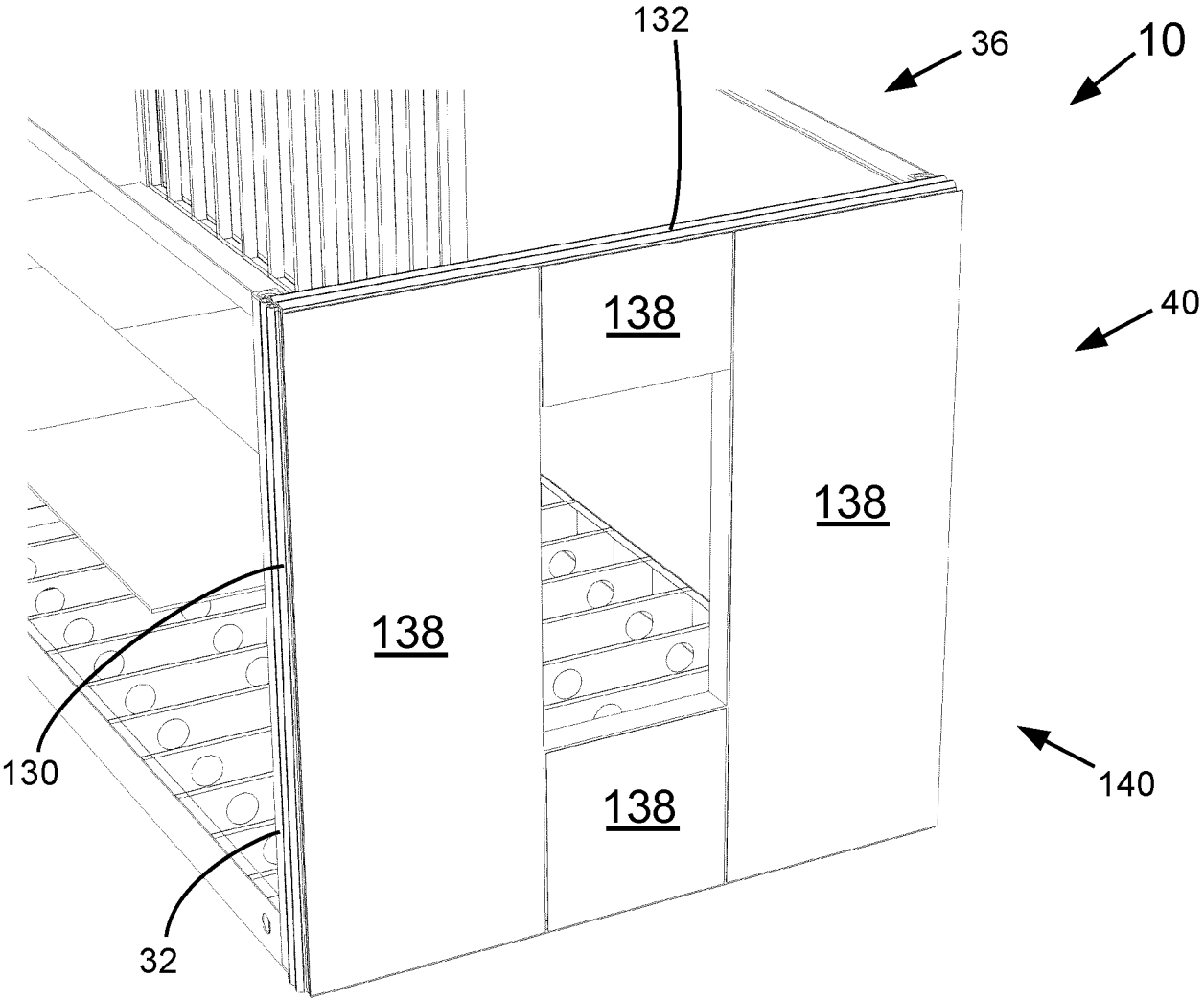
FIG. 38 is a perspective view of the end-frame member shown in FIG. 37, showing the addition of cladding panels to form a SIP-type exterior wall.
Figure 39:
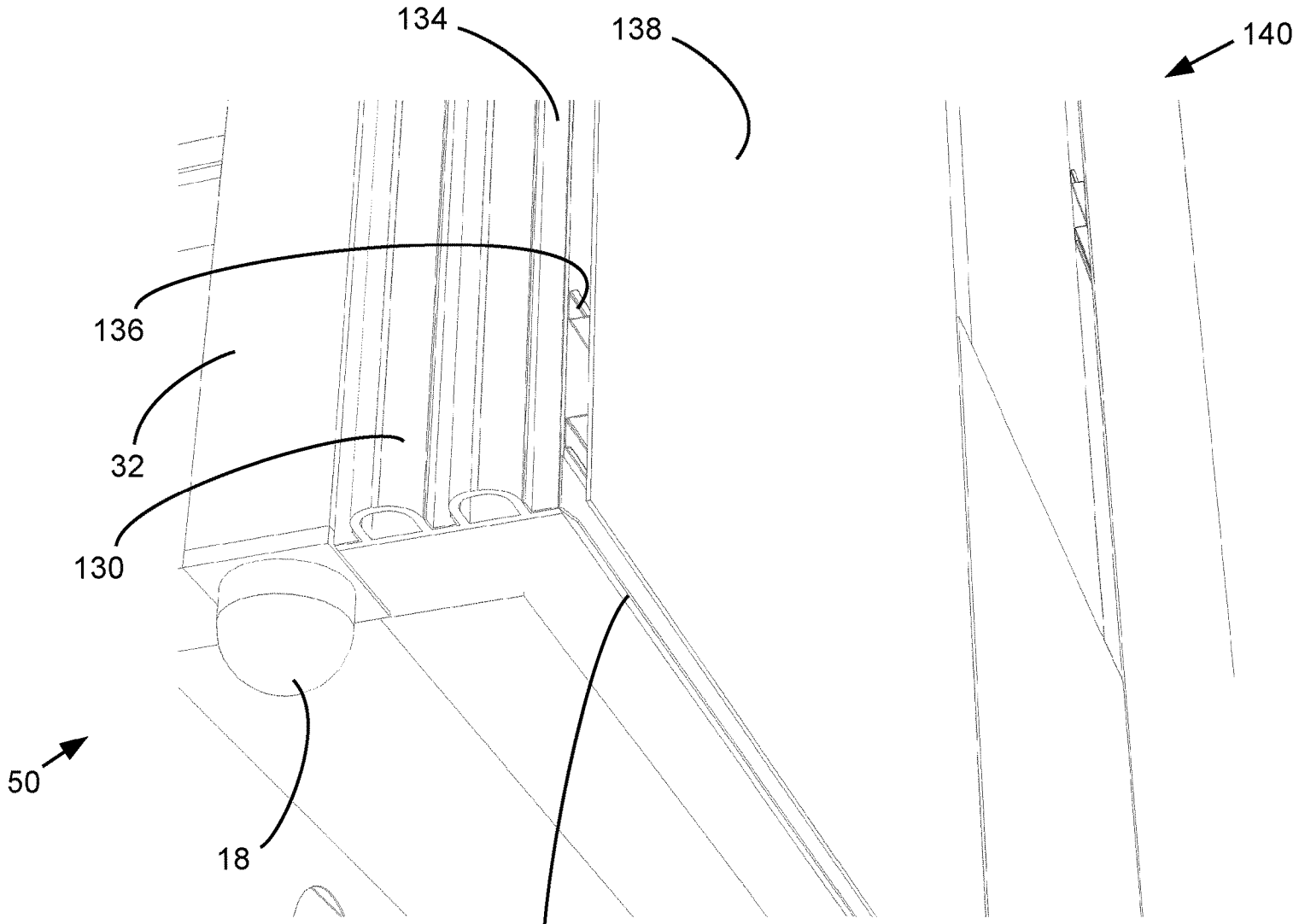
FIG. 39 is a close-up perspective view of the bottom-left corner of the SIP-type wall shown in FIG. 38, showing the vertical SIP gasket, gasket channels, girts and cladding panel in detail.
Figure 40:
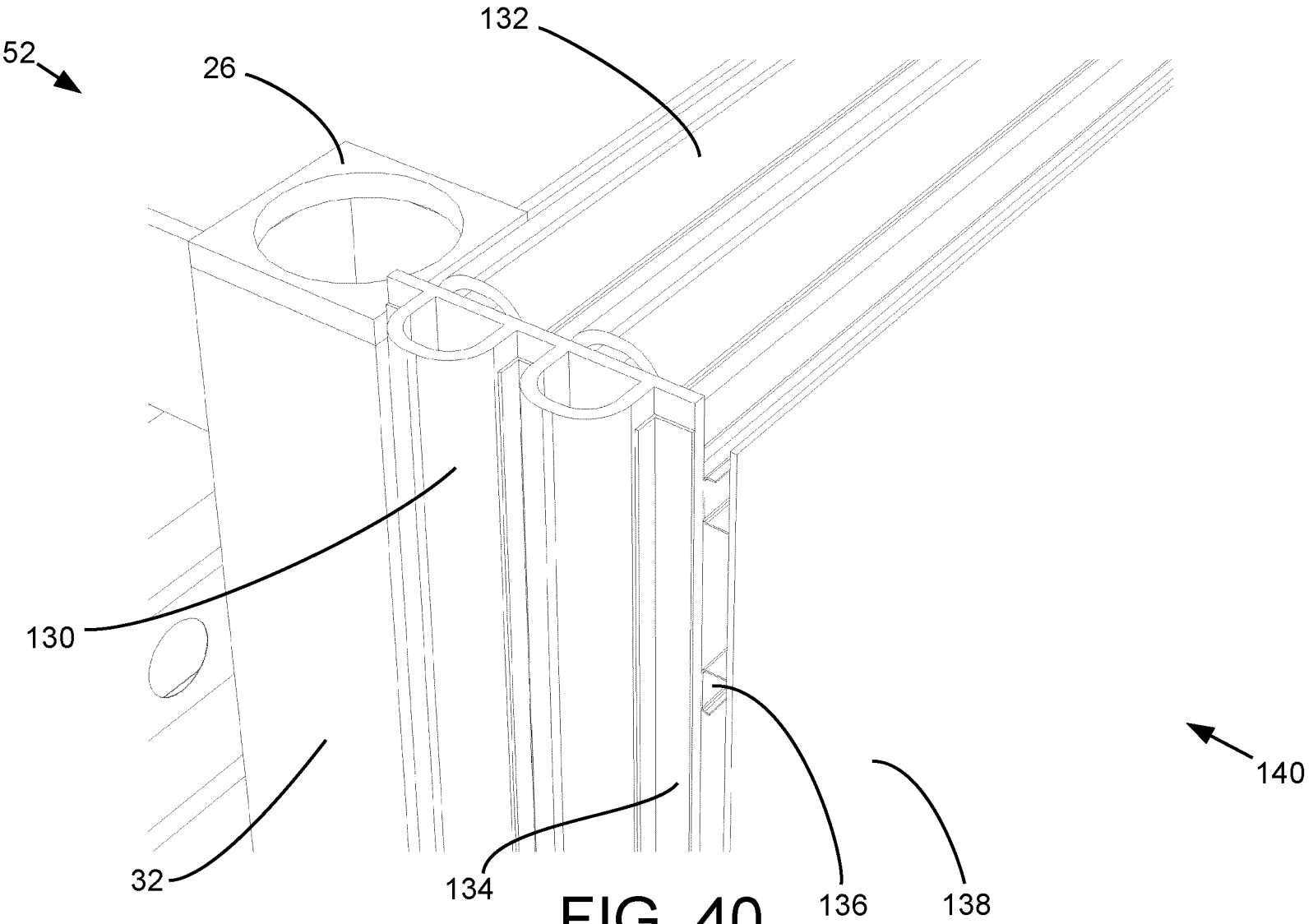
FIG. 40 is a close-up perspective view of the top-left corner of the SIP-type wall shown in FIG. 38.
Figure 41:
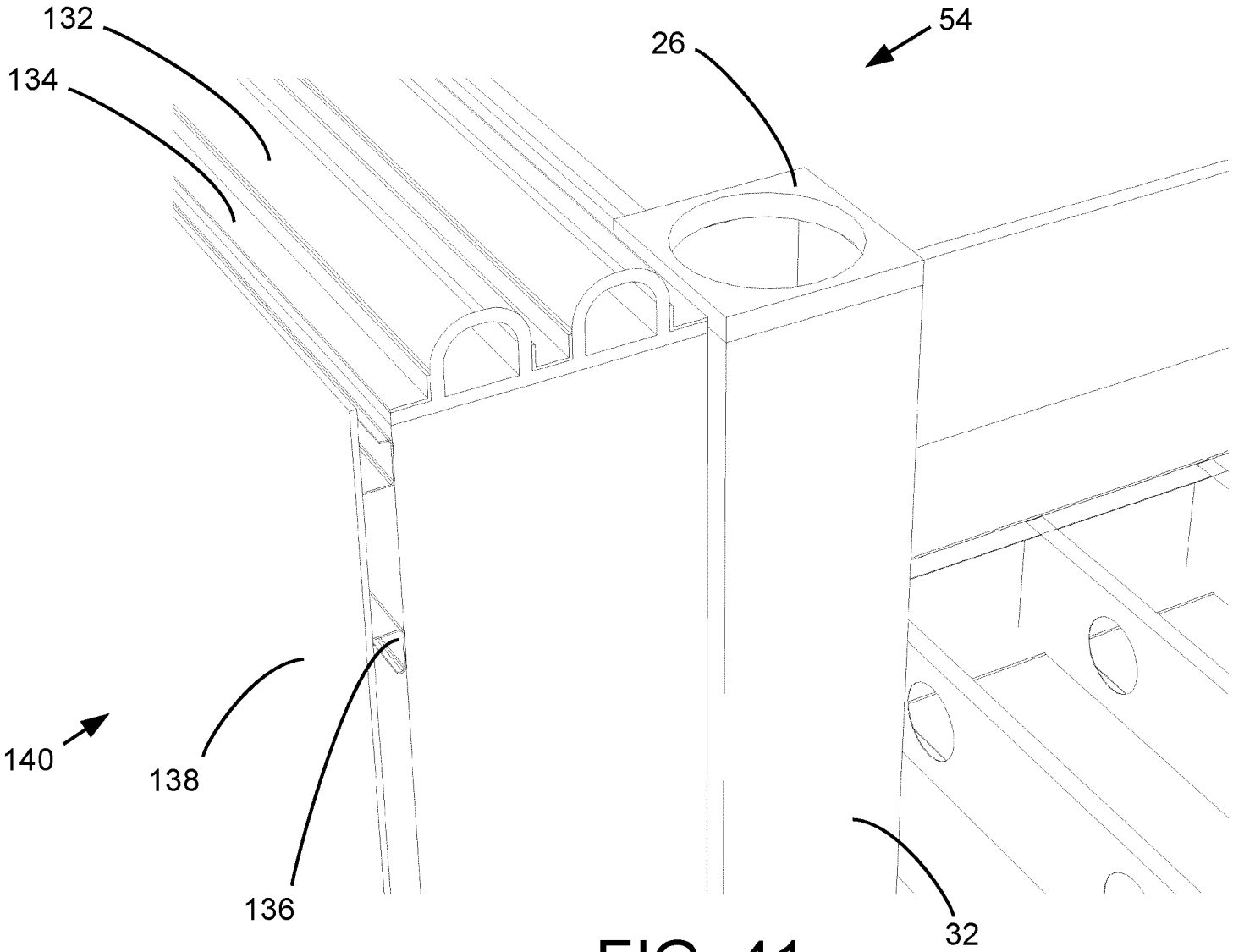
FIG. 41 is a close-up perspective view of the top-right corner of the SIP-type wall shown in FIG. 38.
Figure 42:
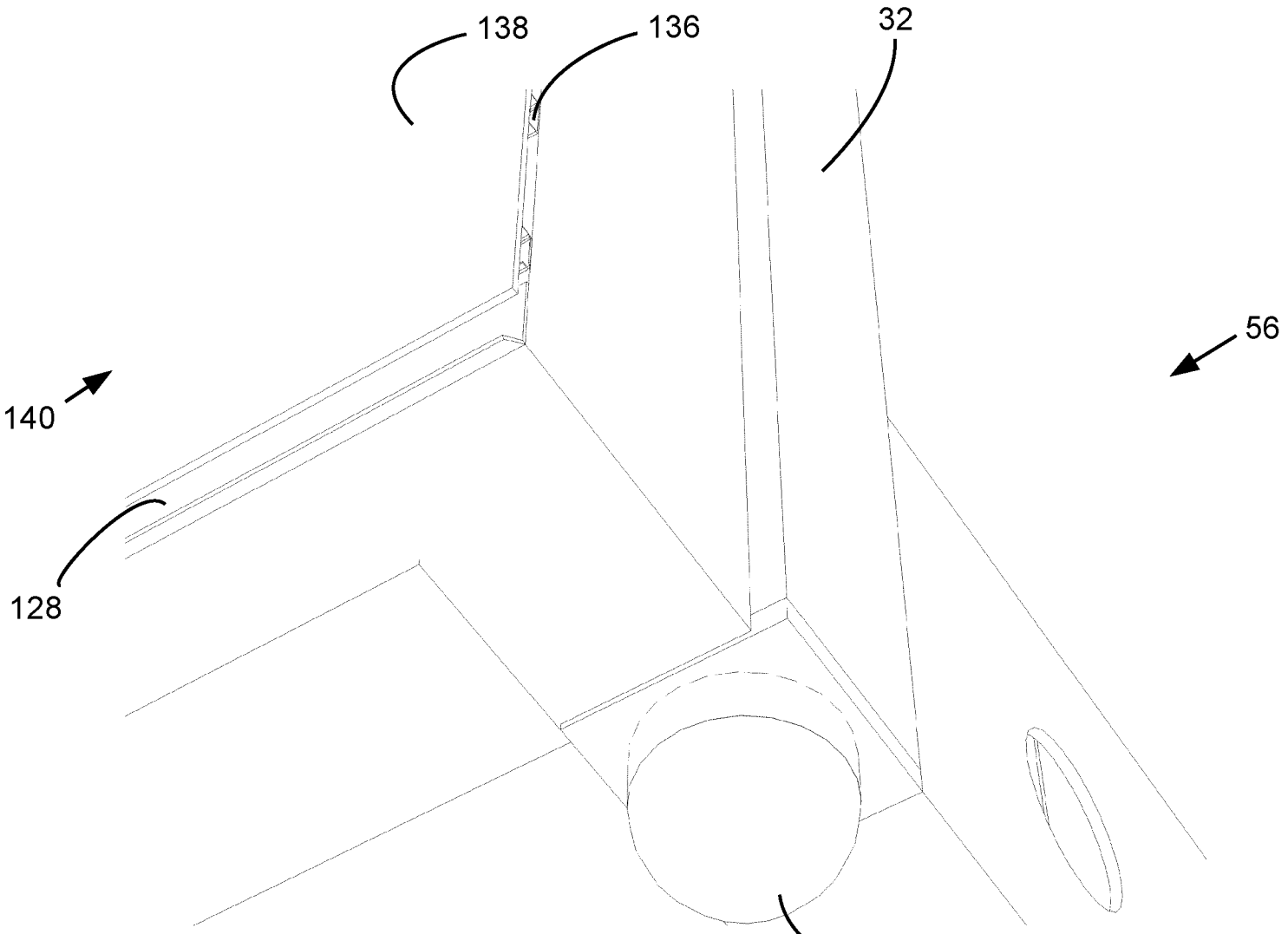
FIG. 42 is a close-up perspective view of the bottom-right corner of the SIP-type wall shown in FIG. 38.

The end-frame member 40 and exterior wall 140 of the second embodiment are advantageously accompanied by the connectors 18 and 26, and also advantageously accompanied by the SIP gaskets 130 and 132. In the second embodiment, the module 10 as shown in FIG. 38 is advantageously operable to form a sealed modular building by being installed and/or assembled with other modules 10, including possibly variants thereof, using an off-level installation technique described herein further below.

Module Installation

Figure 43:
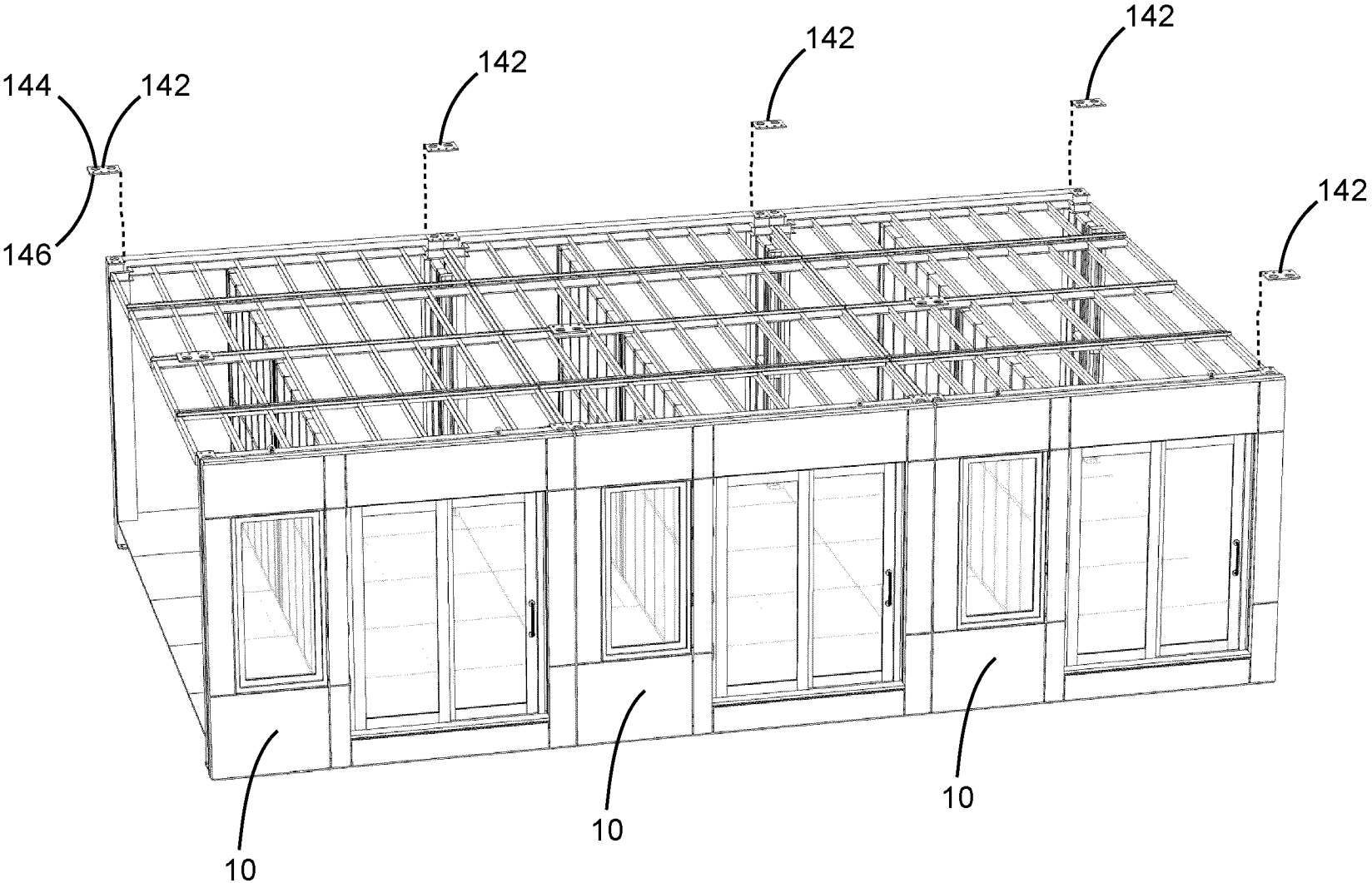
FIG. 43 is a perspective view of three modules assembled horizontally adjacent to each other, showing the assembly of spacer plates onto the three modules.

Referring to FIG. 43, any number of modules 10 in accordance with any embodiment can be connected horizontally and vertically to assemble a modular building, such as after being delivered to an assembly site. Modules 10 on the lowest level of a modular building can be installed onto a foundation (not shown) having recesses for receiving the male connectors 18 of the lowest level modules 10. In variations of embodiments, modules 10 on the lowest level of a modular building having female connectors 26 or other recesses can be installed onto a foundation (not shown) having upwardly projecting male connectors 18.

When stacking modules 10 vertically, a spacer plate 142 is advantageously employed to connect and accurately position horizontally adjacent modules 10 to each other by vertically connecting the spacer plate 142 to its associated female connector(s) 26. Each spacer plate 142 shown in FIG. 43 has two spacer apertures 144 dimensioned to correspond to the apertures 28 (see also FIG. 3) of the female connectors 26. In the first embodiment, the spacer plate 142 is bolted to the female connector 26 via the bolt holes 146 of the spacer plate 142 and the bolt holes 34 of the female connector 26. In variations of embodiments, the spacer plate 142 can be attached to the male connector 18 at the bottom of a given module 10 prior to assembling the given module 10 onto another module 10 of a modular building. While FIG. 43 shows the spacer plate 142 as having two spacer apertures 144, typically each spacer plate 142 includes either one, two, three or four spacer apertures 144 depending on the location of the spacer plate 142 within the given modular building. For example, a spacer plate (not shown) having four spacer apertures 144 can be employed to horizontally attach a set of four horizontally adjacent modules 10. As further examples, a spacer plate 142 having a single aperture 144 may be attached to a male connector 18 at the bottom of a given module 10 when there will be no other module 10 adjacent to the given module 10 in the modular building; and a spacer plate 142 having two or more apertures 144 may be attached to a female connector 26 at the top of the given module 10 when there will be other modules 10 adjacent to the given module 10 in the modular building.

Figure 44:
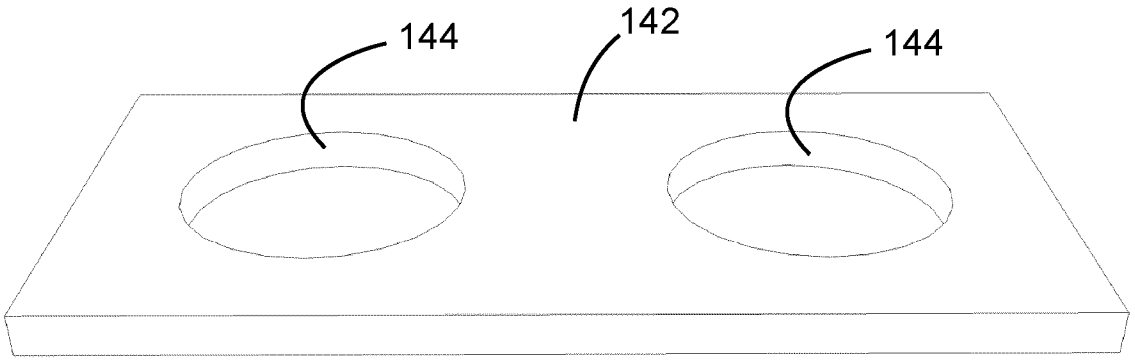
FIG. 44 is a close-up perspective view of one spacer plate shown in FIG. 43, showing single-diameter apertures.
Figure 45:
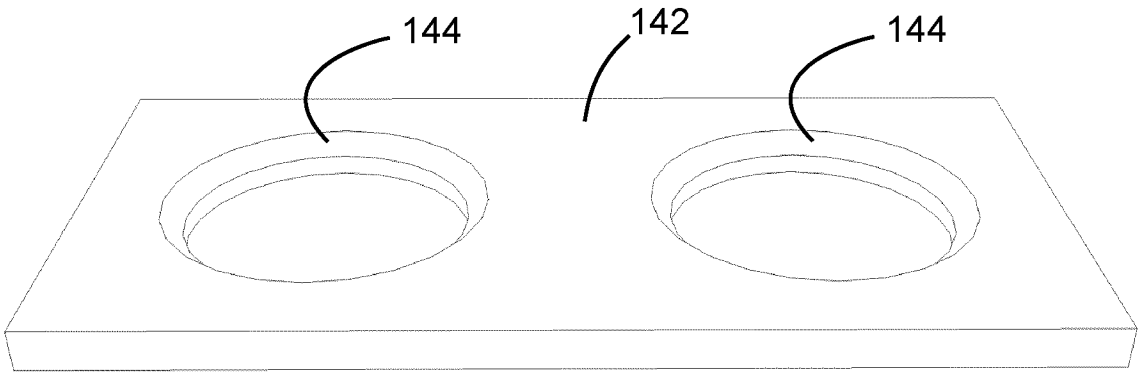
FIG. 45 is a close-up perspective view of an alternative spacer plate from that shown in FIG. 44, showing beveled apertures.

Referring to FIGS. 44 and 45, the spacer plate 142 in the first embodiment has single-diameter spacer apertures 144. However, in some embodiments, the spacer apertures 144 are beveled, thereby advantageously facilitating the self-correcting nature of the male connector 18. For ease of illustration, the bolt holes 146 of the spacer plates 142 are not visible in FIGS. 44 and 45. In some embodiments, such as the third embodiment illustrated in FIGS. 64 to 67 described herein below, the spacer plates 142 do not need to include the bolt holes 146.

Figure 46:
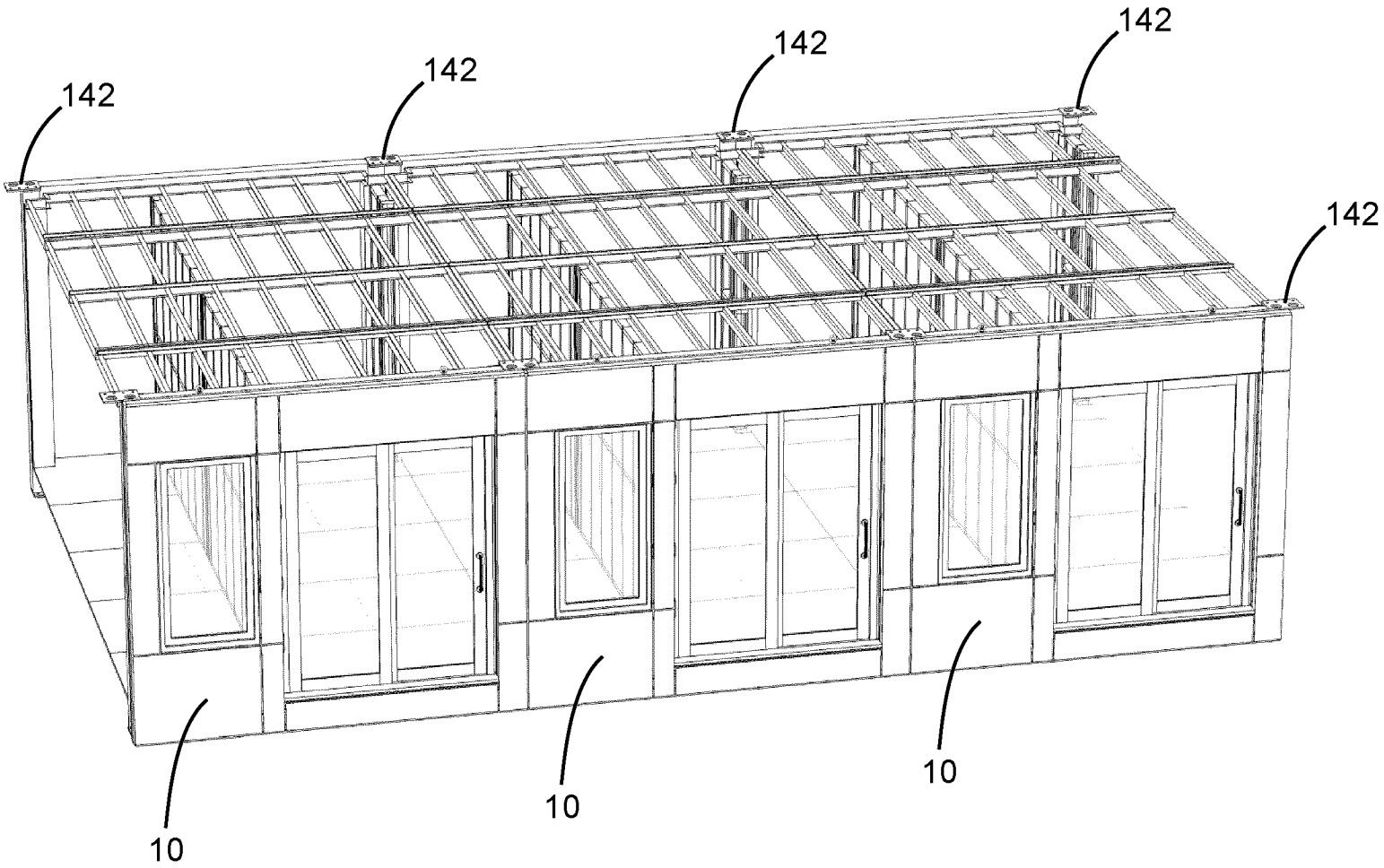
FIG. 46 is a perspective view of the three modules shown in FIG. 43, showing the spacer plates assembled onto the modules.
Figure 47:
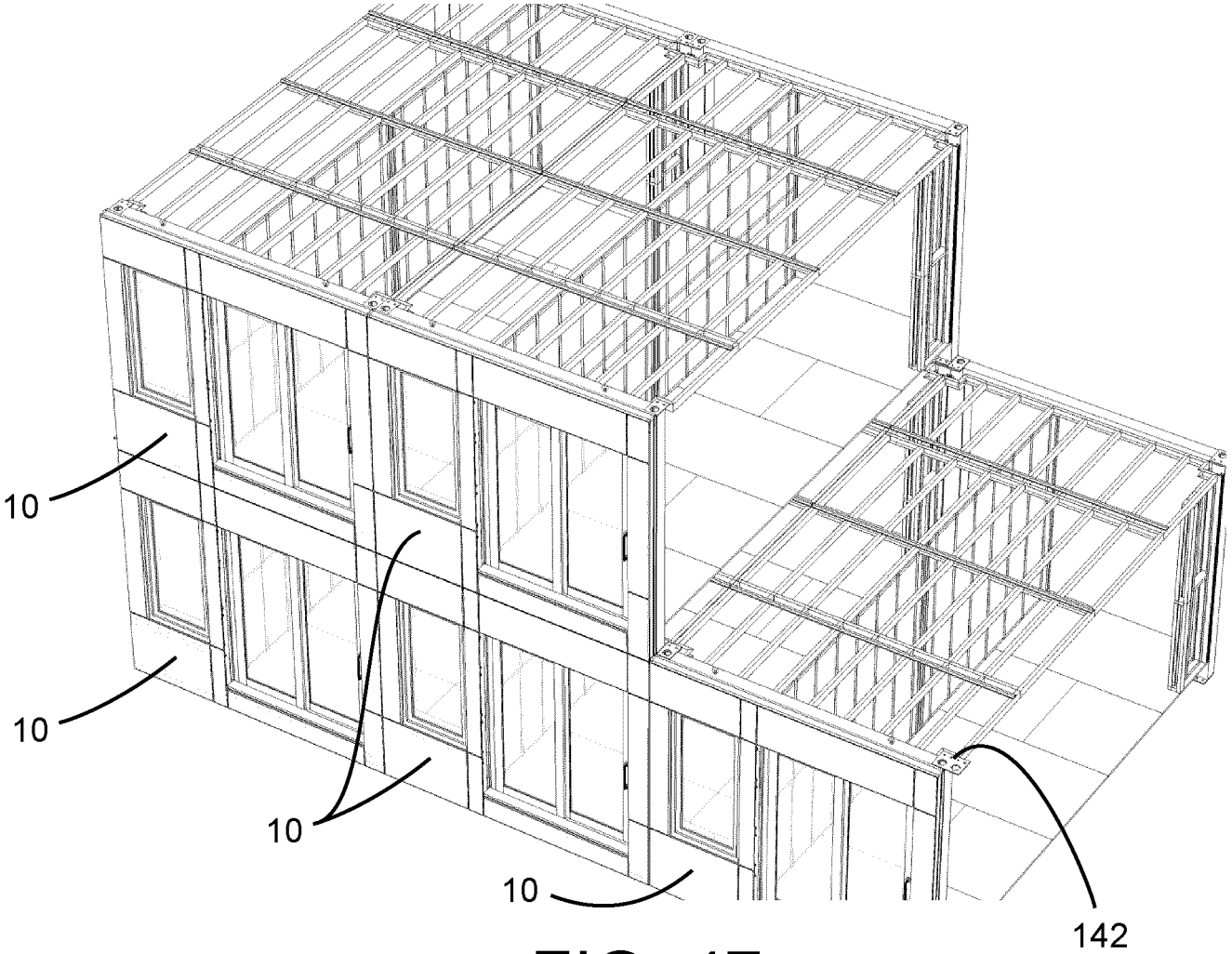
FIG. 47 is a perspective view of the three modules shown in FIG. 46, showing the addition of two modules assembled at a second level above the three modules of FIG. 46.
Figure 48:
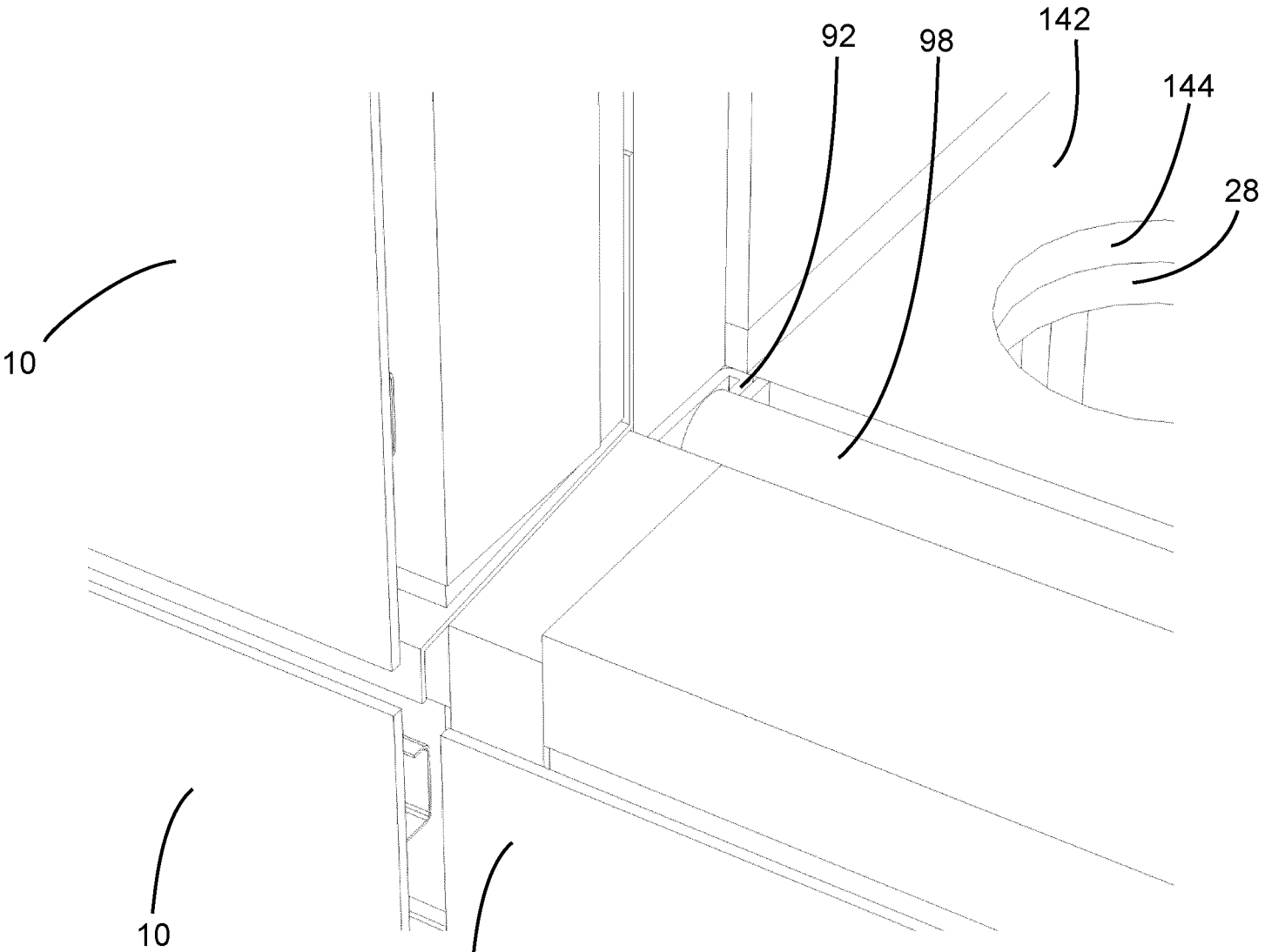
FIG. 48 is a close-up perspective view of a junction of three of the five modules shown in FIG. 47, showing the top-left corner of a rightmost lower-level assembled module.

Referring to FIGS. 46 to 48, the spacer plates 142 are placed in alignment with the connector plates 30 of the lowest level modules 10 to receive male connectors 18 of upper level modules 10. A lower-level left module 10, a lower-level middle module 10, and a lower-level right module 10 are visible in FIG. 46. In comparison, FIG. 47 shows the three lower-level modules 10 plus a second-level left module 10 and a second-level middle module 10. The close-up view in FIG. 48 shows the top-left corner 52 of the lower-level right module 10, the top-right corner 54 of the lower-level middle module 10, and the bottom-right corner 56 of the second-level middle module 10.

Referring to FIGS. 43, 46 and 47, the spacer plates 142 in some embodiments are attached to the connector plates 30 of the female connectors 26 prior to assembly into a modular building, such as by being integrally attached, fastened, welded or otherwise attached. In variations, the spacer plates 142 may be attached to the connector plates 30 of the male connector(s) 18 prior to assembly, and may be integrally attached, fastened, welded or otherwise attached. In procedural variations, the spacer plates 142 may be attached on-site prior to being lifted for assembly into a modular building, upon being lifted prior to assembly, or may be attached at a factory location prior to delivery to an assembly site for example. If so attached, then it is desirable to select a convenient order in which to assemble horizontally adjacent modules 10. While FIGS. 43, 46 and 47 show three horizontally adjacent modules 10 with identical spacer plates 142 being employed, different spacer plates 142 may be employed for different applications. For example, the modules 10 being assembled at the ends of a modular building may have spacer plates 142 with only one spacer aperture 144 so as to terminate flush (not shown) with the remainder of the modular building.

In the first embodiment shown in FIG. 48, the vertical membrane gasket 92 of the lower-level right module 10 is compressed by the lower-level middle module 10. However, absent a second-level right module 10 the horizontal membrane gasket 98 of the lower-level right module 10 is not compressed. By way of comparison, in the second embodiment shown in FIG. 49 the vertical SIP gasket 130 of the lower-level right module 10 is compressed by the lower-level middle module 10, and the horizontal SIP gasket 132 of the lower-level right module 10 is not compressed.

Figure 49:
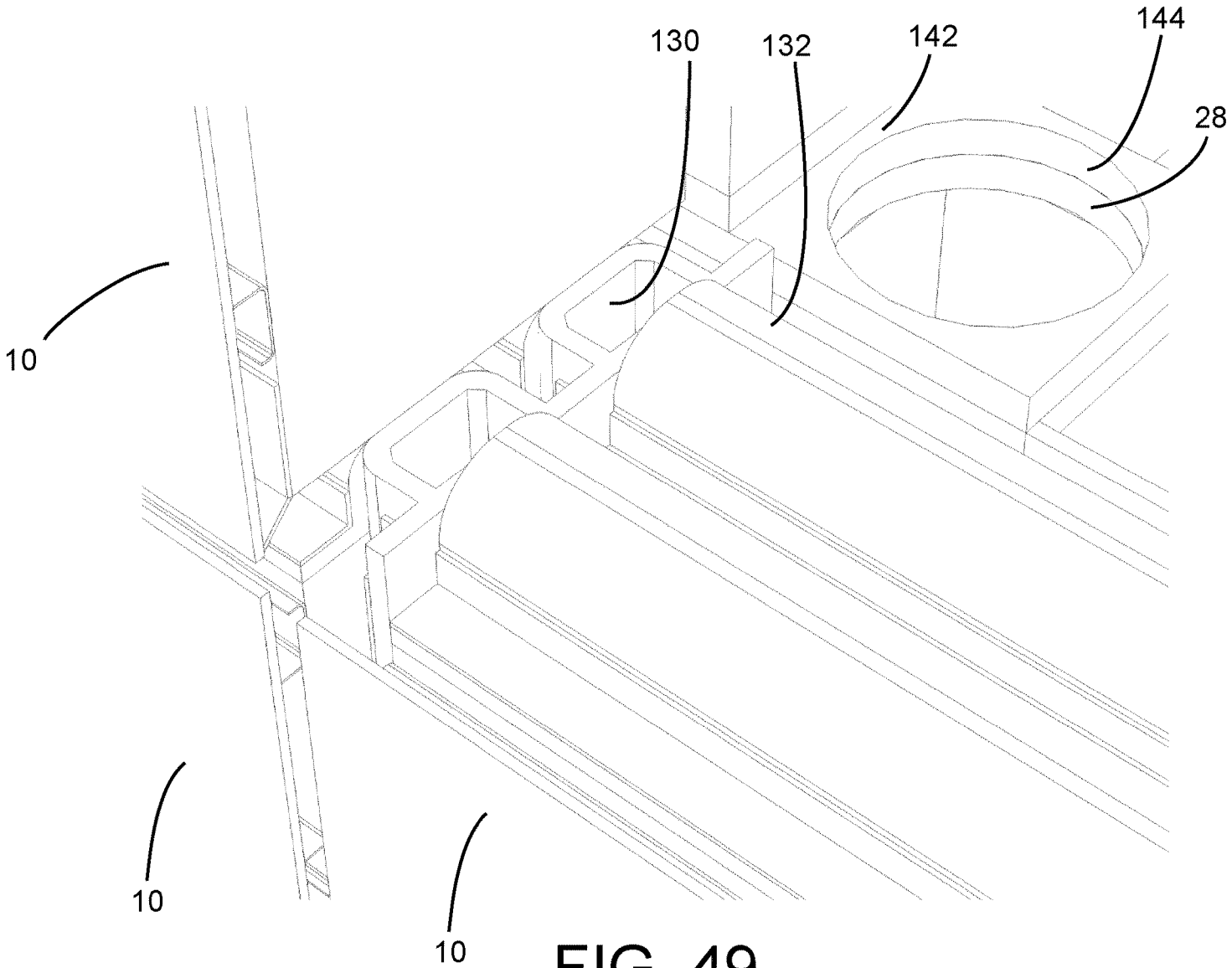
FIG. 49 is a close-up perspective view of an alternative to the junction shown in FIG. 47, showing assembled modules fabricated according to the second embodiment.

Alignment of the aperture 28 of the female connector 26 of the lower-level right module 10 and the spacer aperture 144 can be seen in both FIGS. 48 and 49 in accordance with both the first and second embodiments of the present invention.

In the first and second embodiments of the invention, the projecting length of the projection member 22 (FIG. 2) of the male connector 18 is preferably equal to at least the sum of the thicknesses of the spacer plate 142 and the connector plate 30 to advantageously maintain alignment of adjacent modules 10 when the male connector 18 is fully received by the female connector 26 through the spacer plate 142. In specific instances of the first and second embodiments, the thickness of the spacer plate 142 is 0.5 inches (12.7 mm), the thickness of the connector plate 30 is 0.5 inches (12.7 mm), and the projecting length of the projection member 22 is 1.0 inches (25.4 mm). However, in variations of embodiments, the thickness of the spacer plate 142 may be in the range of 0.2 inches (5.1 mm) to 2 inches (50.8 mm), the thickness of the connector plate 30 may be in the range of 0.2 inches (5.1 mm) to 2 inches (50.8 mm), and the projecting length of the projection member 22 may be in the range of 0.4 inches (10.1 mm) to 4 inches (110 mm) for example.

Figure 50:
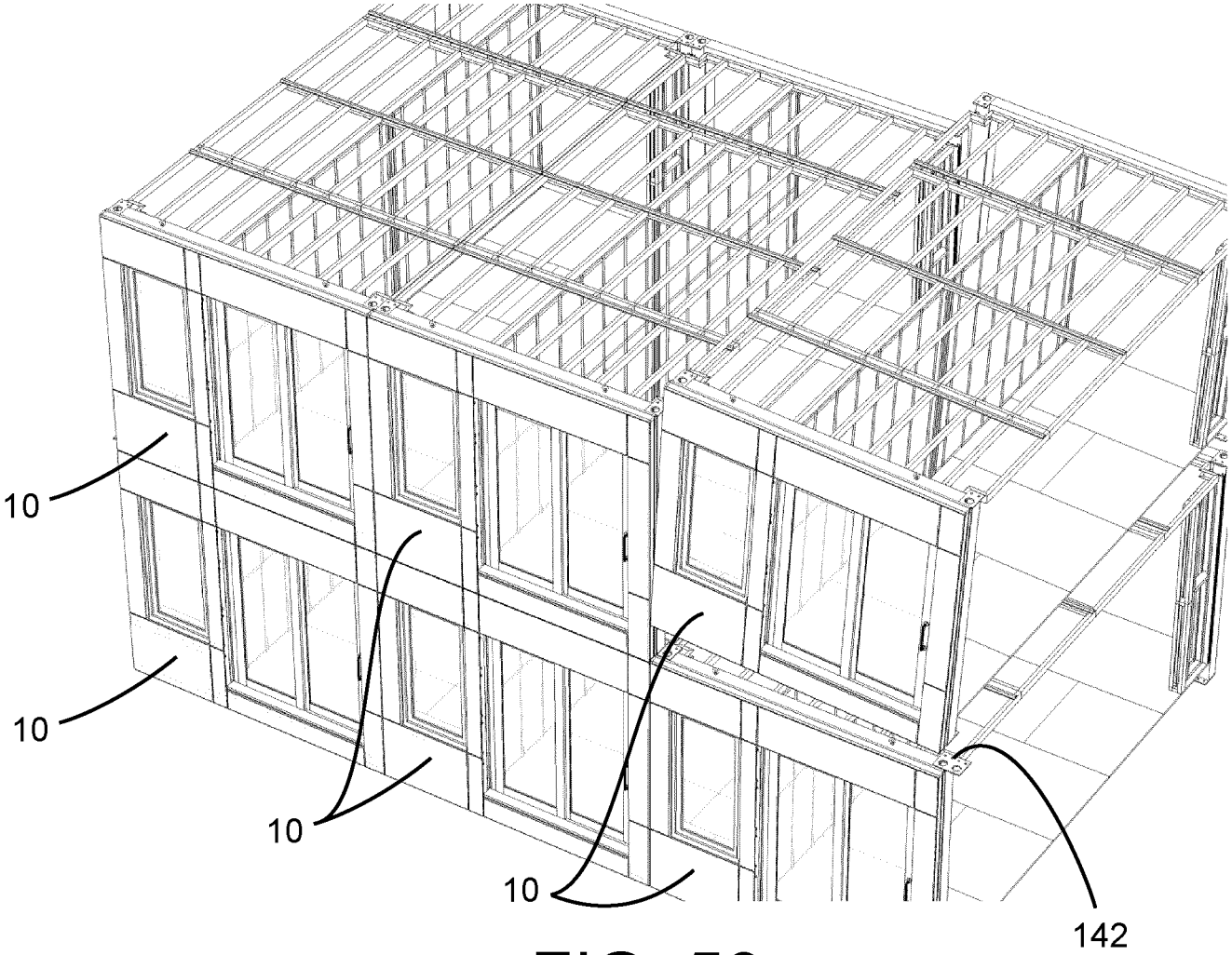
FIG. 50 is a perspective view of the five modules shown in FIG. 47, showing the addition of a sixth module in preparation for off-level installation thereof.

Referring to FIG. 50, a second-level right module 10 is lowered off-level at an angle relative to the other modules 10 that are already installed. Off-level installation permits the male and female connectors 18 and 26 along one side of the lower-level and second-level right modules 10 to be aligned during the descent of the second-level right module 10 while advantageously avoiding or minimizing sliding contact between the vertical membrane gasket 92 or the vertical SIP gasket 130 of the second-level right module 10 and the right side 46 of the second-level middle module 10. The off-level angle shown in FIG. 50 is approximately three (3) degrees, although a range of angles can be accommodated.

Figure 51:
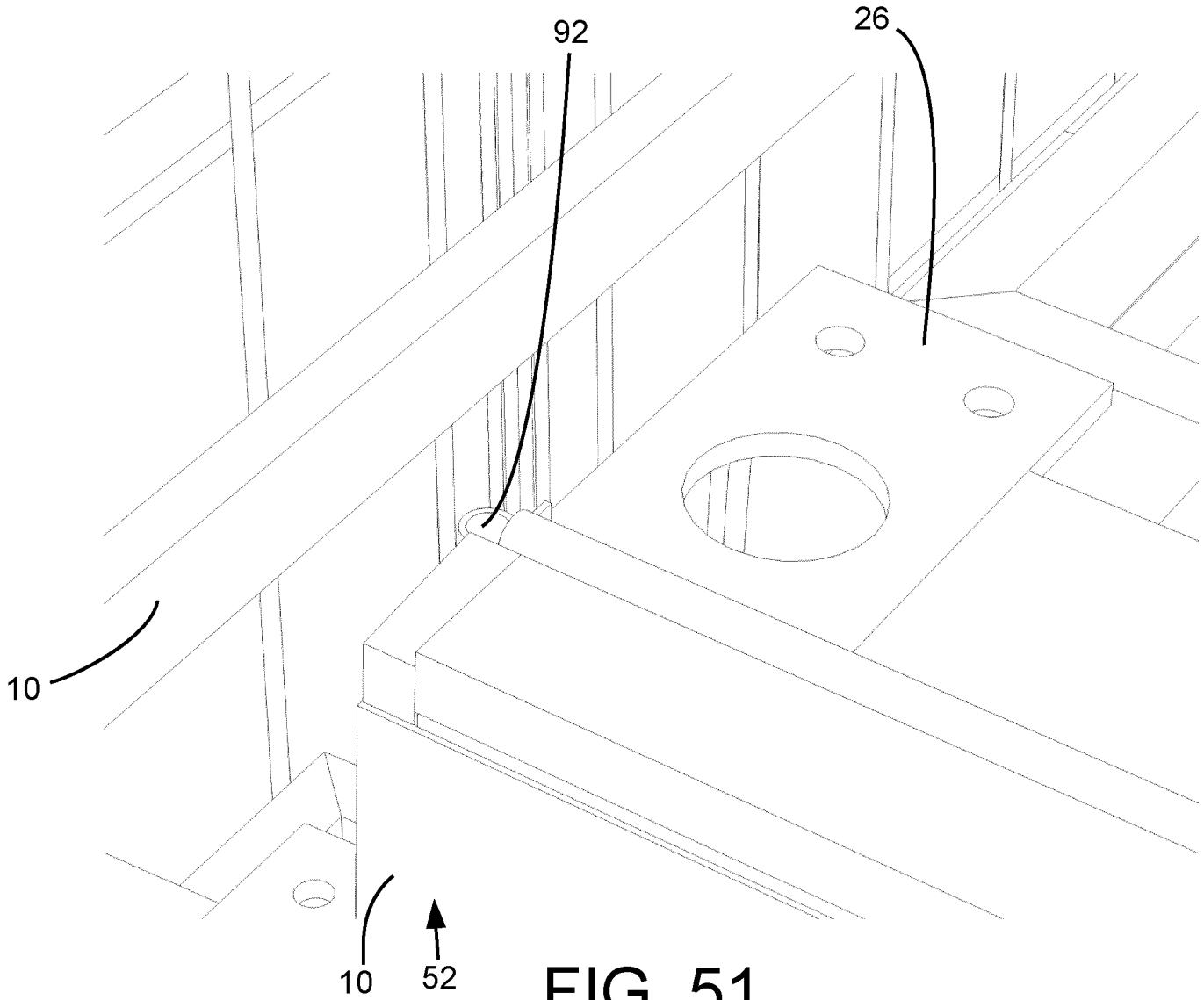
FIG. 51 is a close-up perspective view of the six modules shown in FIG. 50, showing a gap between the top-left corner of the sixth module and its adjacent module.

Referring to FIG. 51, the top-left corner 52 of the second-level right module 10 (i.e. the module 10 descending for assembly) is separated from the second-level middle module 10 such that the vertical membrane gasket 92 of the second-level right module 10 is uncompressed.

Figure 52:
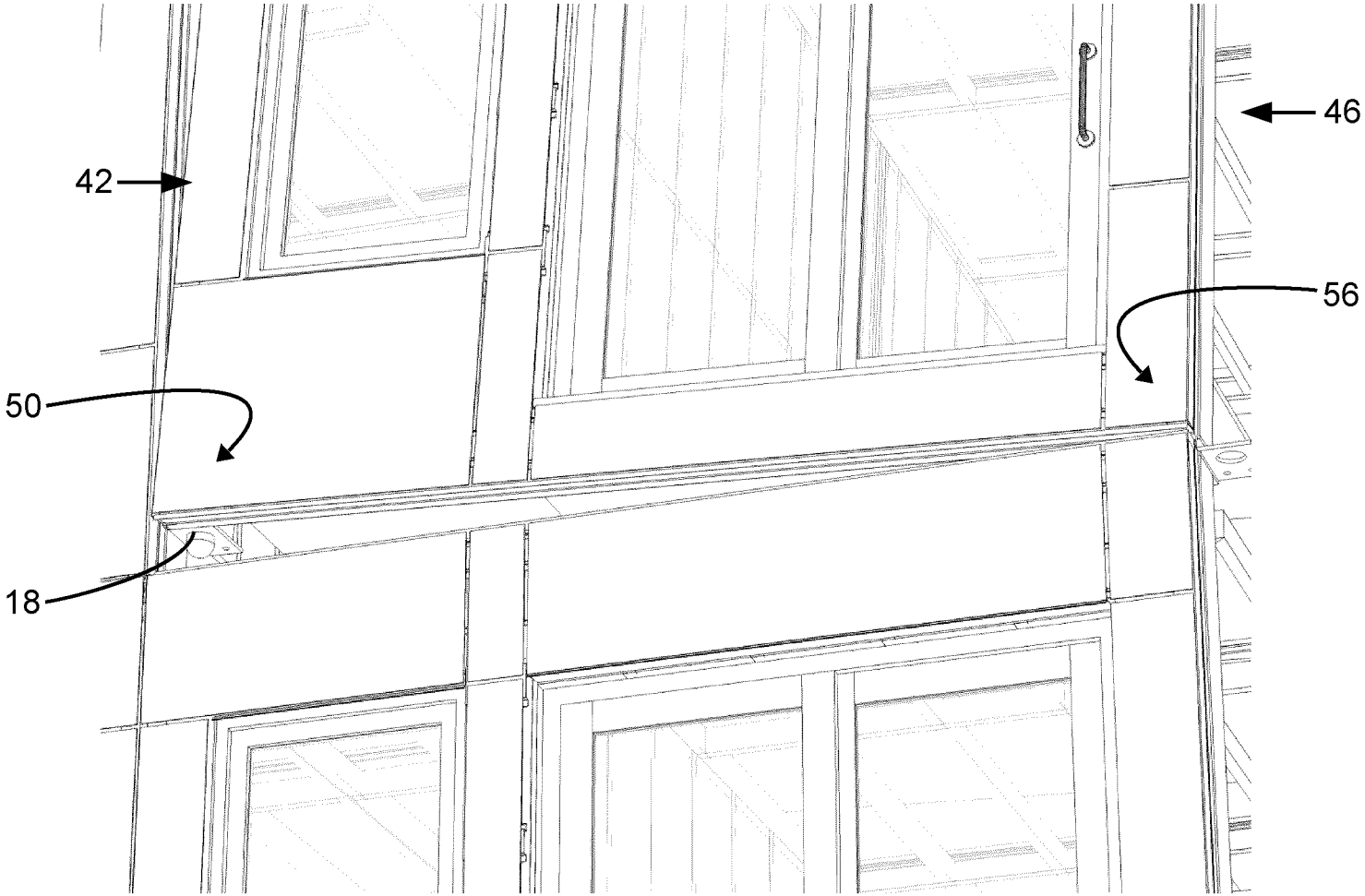
FIG. 52 is a perspective view of the six modules showing in FIG. 50, showing a gap between the bottom-left corner of the sixth module and its adjacent modules.
Figure 53:
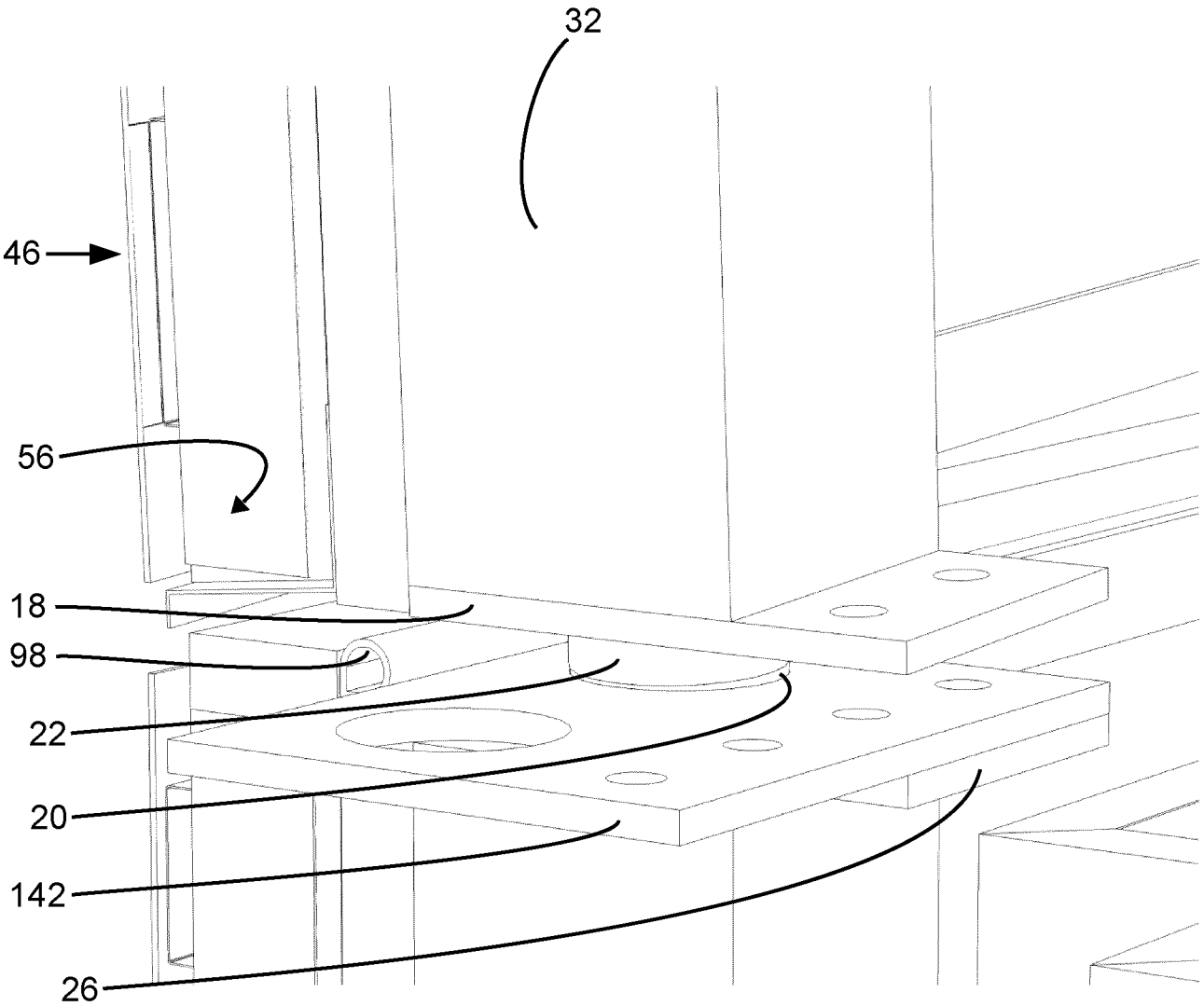
FIG. 53 is a close-up perspective view of the bottom-right corner of the sixth module shown in FIG. 52, showing off-level contact between a male connector of the sixth module and a female connector of an adjacent module.

Referring to FIGS. 52 and 53, the right side 46 of the second-level right module 10 makes contact first with the lower-level right module 10 at the connectors 18 and 26, while the left side 42 of second-level right module 10 has not yet made contact with any other module 10. The off-level angle of the second-level right module 10 is still pronounced as the terminus 20 of the second-level right module 10 is moveable within the aperture 28 of the female connector 26 of the lower-level right module 10.

Figure 54:
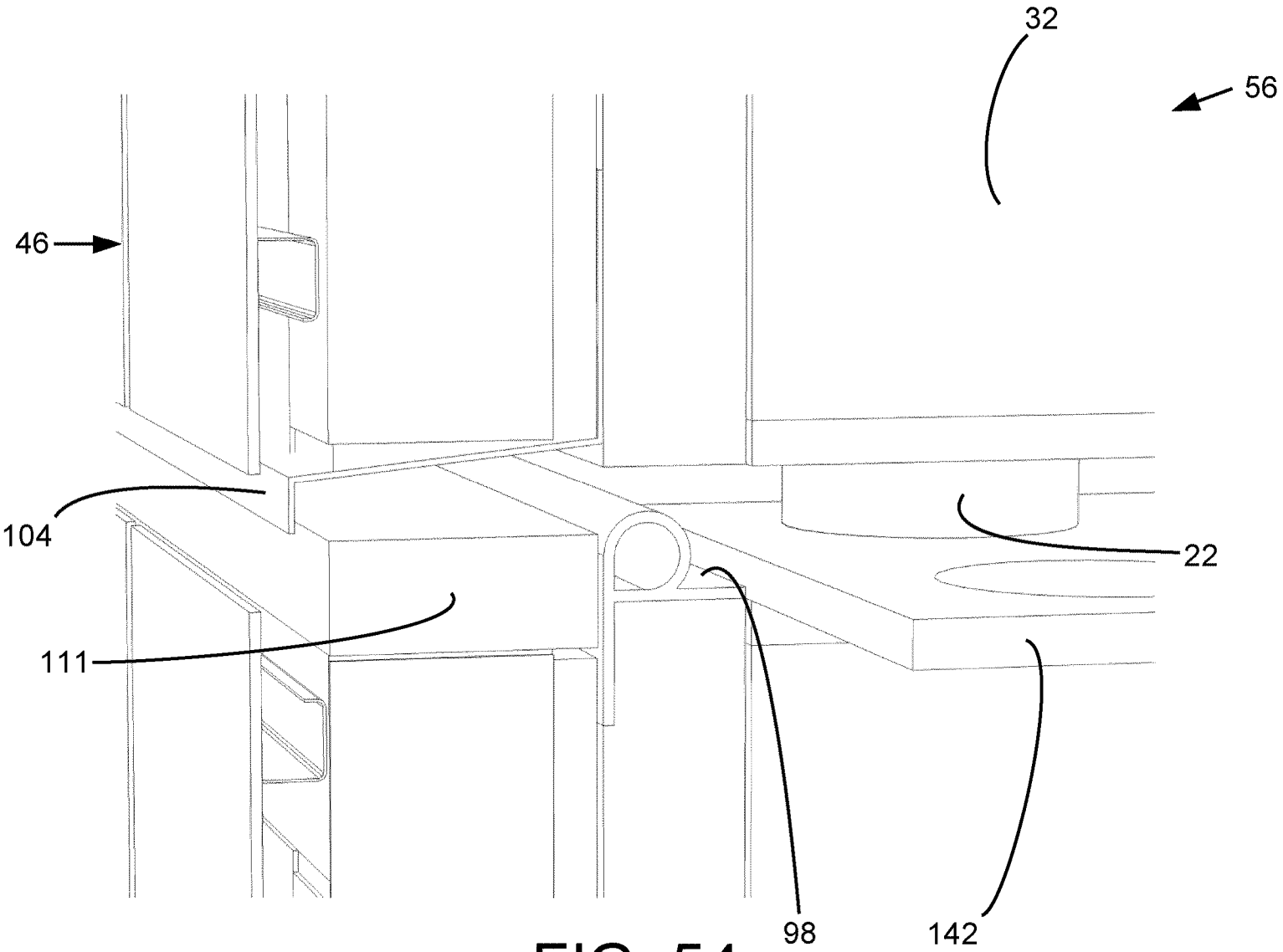
FIG. 54 is a close-up perspective view of the bottom-right corner shown in FIG. 53, showing a projection member of the male connector of FIG. 53 in vertical alignment with the female connector of FIG. 53.
Figure 55:
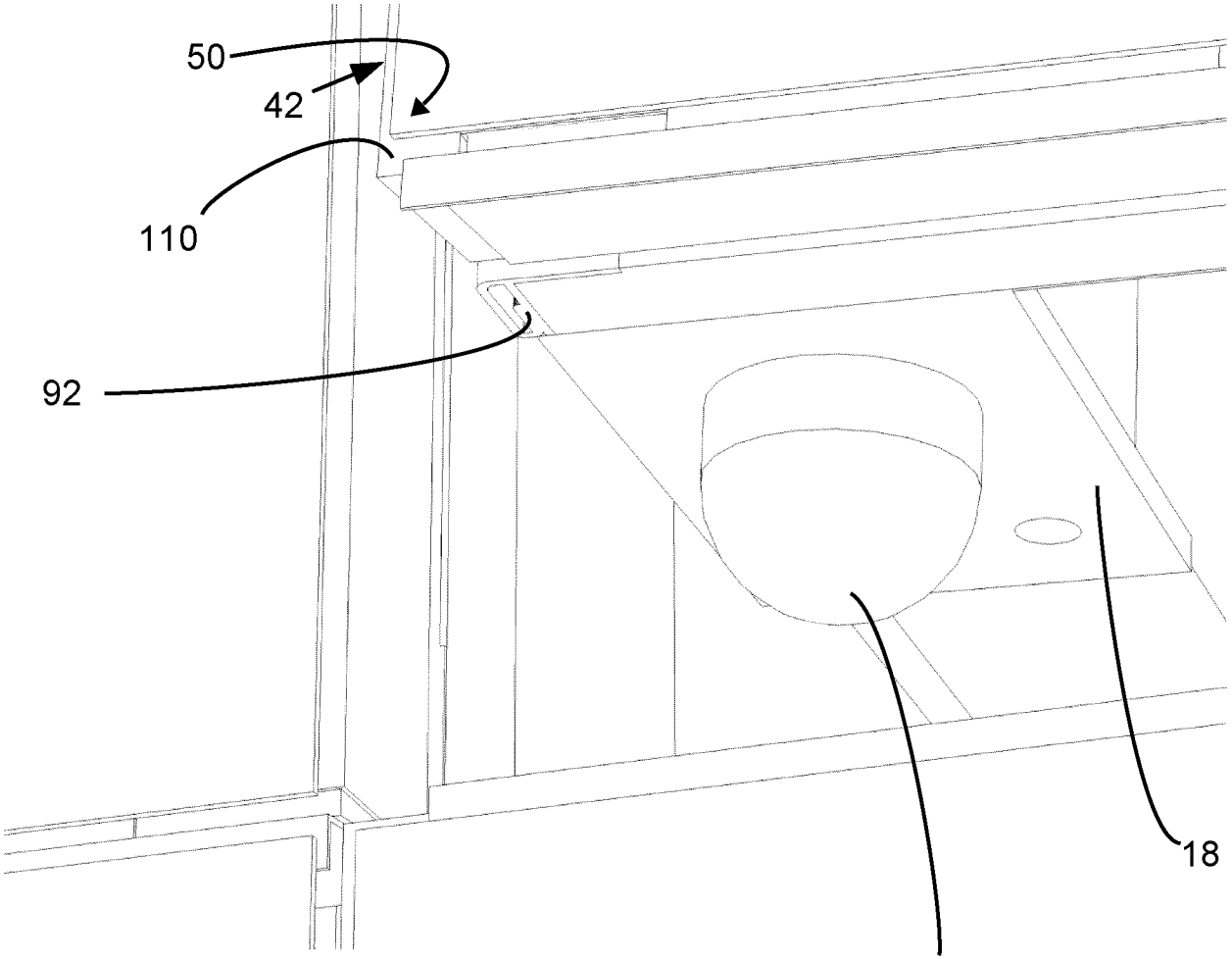
FIG. 55 is a close-up perspective view of the bottom-left corner shown in FIG. 52, showing minimal compression of a vertical membrane gasket and a vertical insulation gasket of the sixth module.

Referring to FIGS. 54 and 55, as the second-level right module 10 is lowered, it reaches a point where the male connector 18 at the right side 46 will no longer descend off-level. Thus, the terminus 20 of the male connector 18 operates as a pivot point for leveling of the second-level right module 10. As the second-level right module 10 self aligns by pivoting, the male connector 18 at the left side 42 of the second-level right module 10 lowers and the vertical membrane gasket 92 and the vertical insulation gasket 110 begin to compress. Initially, the vertical membrane gasket 92 and the vertical insulation gasket 110 compress at the bottom-left corner 50 of the second-level right module 10 and then upward along the left side 42 of the second-level right module 10. Thus, the distance that the vertical membrane gasket 92 and the vertical insulation gasket 110 must slide vertically while compressed is minimized, thereby advantageously minimizing sliding friction and wear on the vertical membrane gasket 92 and the vertical insulation gasket 110 during installation of the module 10.

Figure 56:
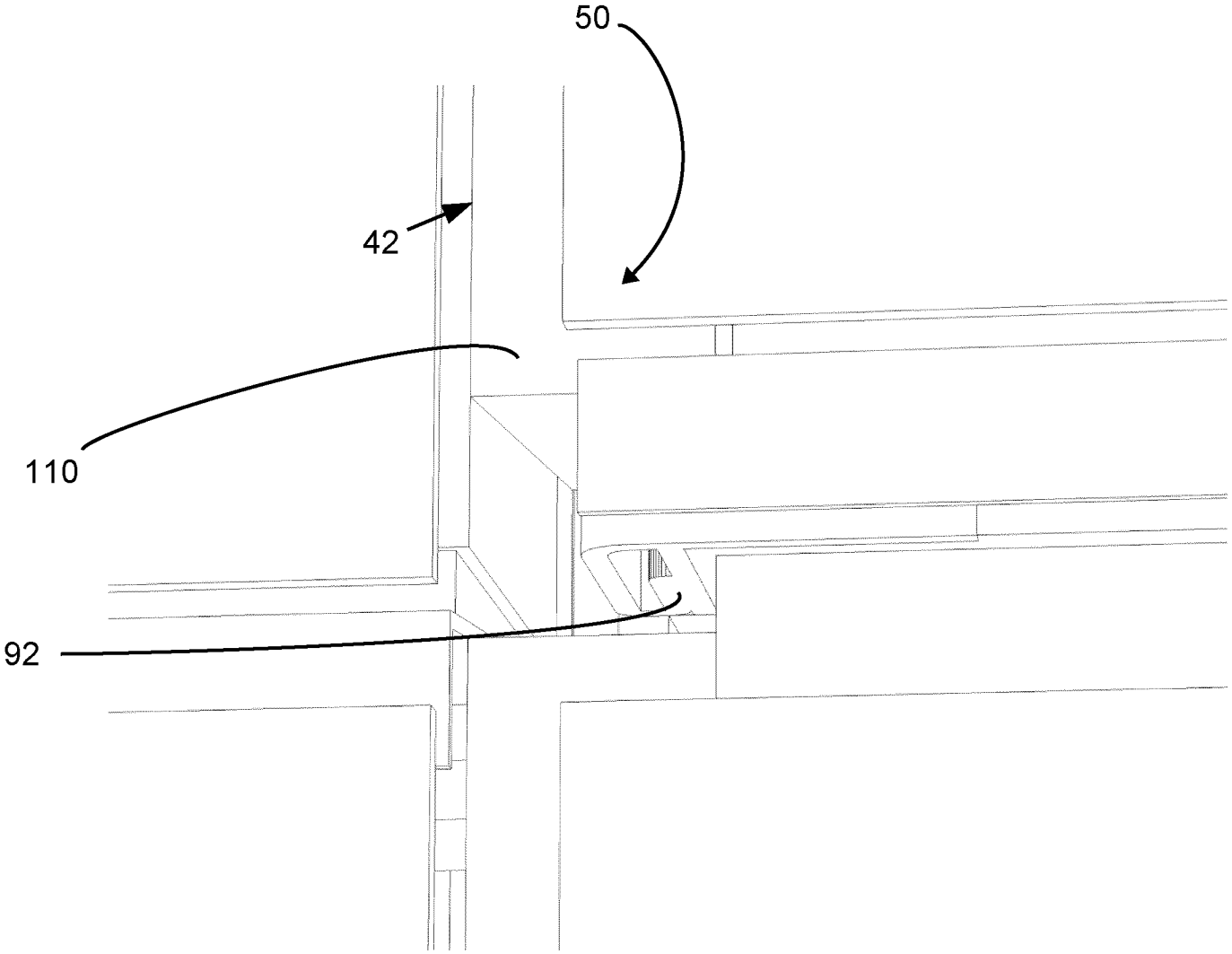
FIG. 56 is a close-up perspective view of the bottom-left corner shown in FIG. 55, showing further compression of the vertical membrane gasket and the vertical insulation gasket.

Referring to FIG. 56, the vertical membrane gasket 92 and the vertical insulation gasket 110 are almost completely compressed as the bottom-left corner 50 of the second-level right module 10 is almost in its final position. Even in this nearly final position, the horizontal membrane gasket 98 (not visible in FIG. 56) and the horizontal insulation gasket 111 of the lower-level right module 10 are not yet compressed at all, as can be seen in contrast to the horizontal insulation gasket 111 of the lower-level middle module 10.

Figure 57:
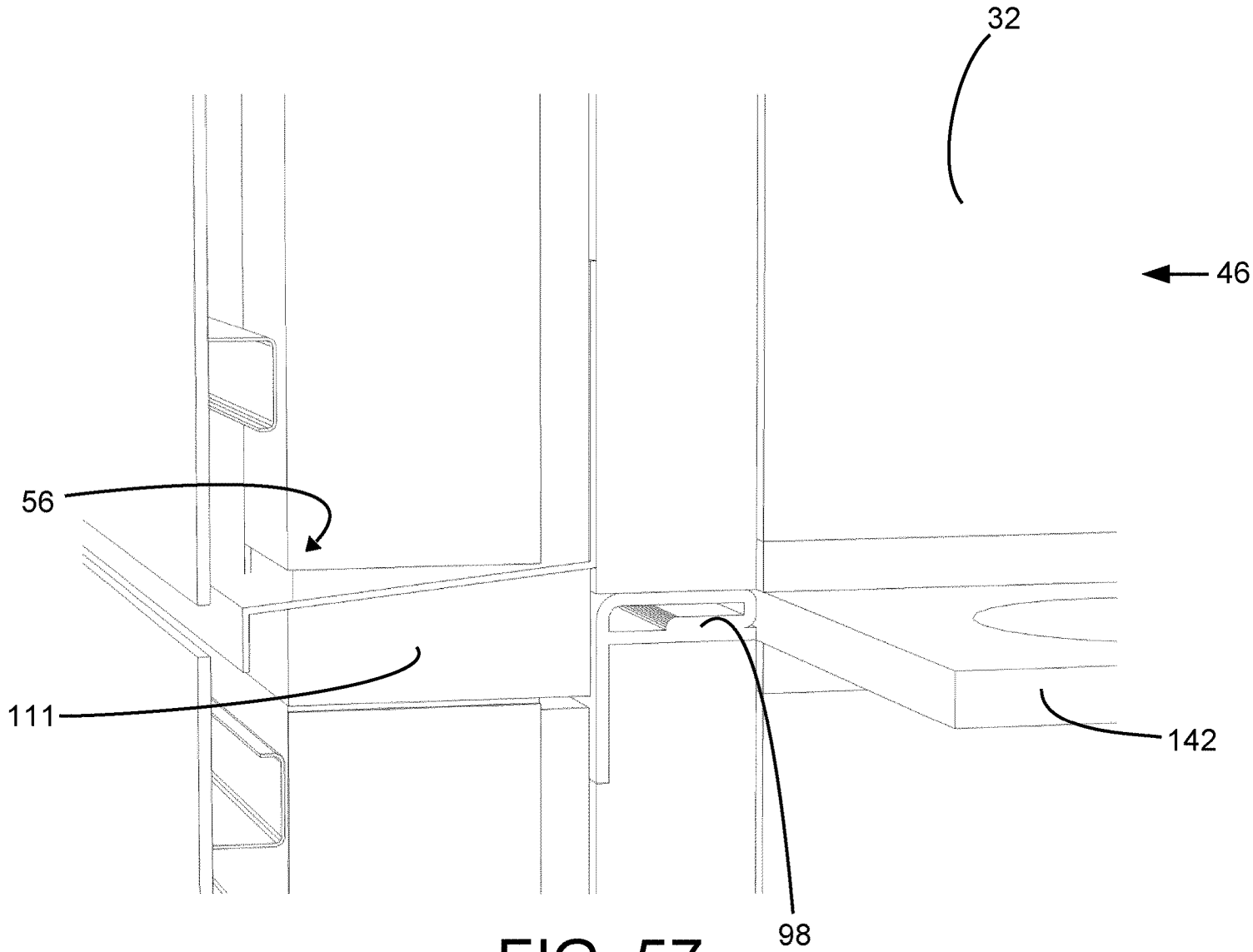
FIG. 57 is a close-up perspective right-side view of the sixth module shown in FIG. 50, showing compression of the horizontal membrane gasket and the horizontal insulation gasket of the sixth module upon assembly of the sixth module.

Referring to FIG. 57 and in accordance with the first embodiment, when the second-level right module 10 is in its final position the horizontal membrane gasket 98 and the horizontal insulation gasket 111 of the lower-level right module 10 are fully compressed, as seen from the right-side view of the lower- and second-level right modules 10.

Figure 58:
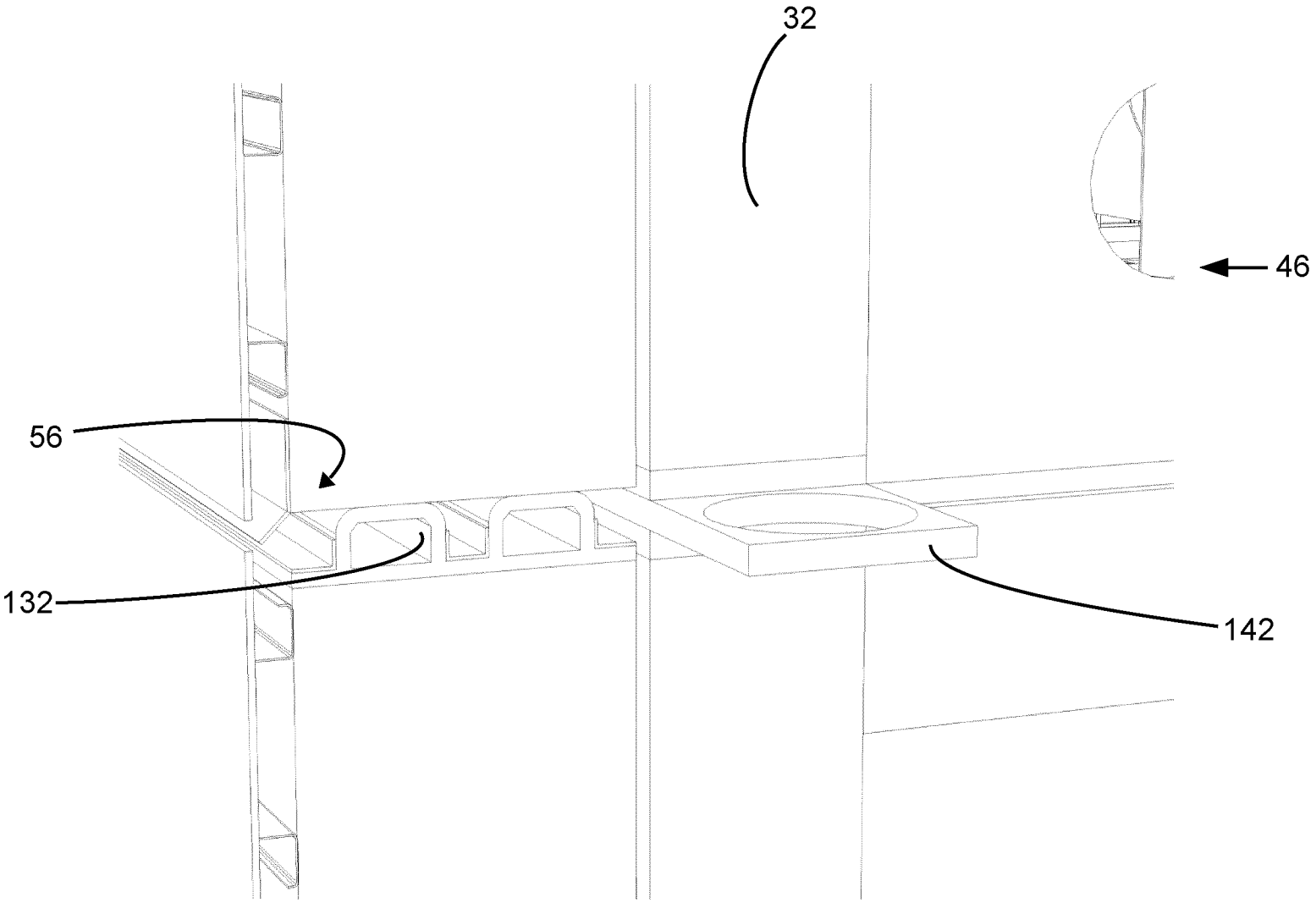
FIG. 58 is a close-up perspective right-side view of an alternative to the sixth module shown in FIG. 57, showing compression of a horizontal SIP gasket according to the second embodiment.

FIG. 58 shows the same right-side view of the compressed horizontal SIP gasket 132 in accordance with the second embodiment.

Figure 59:
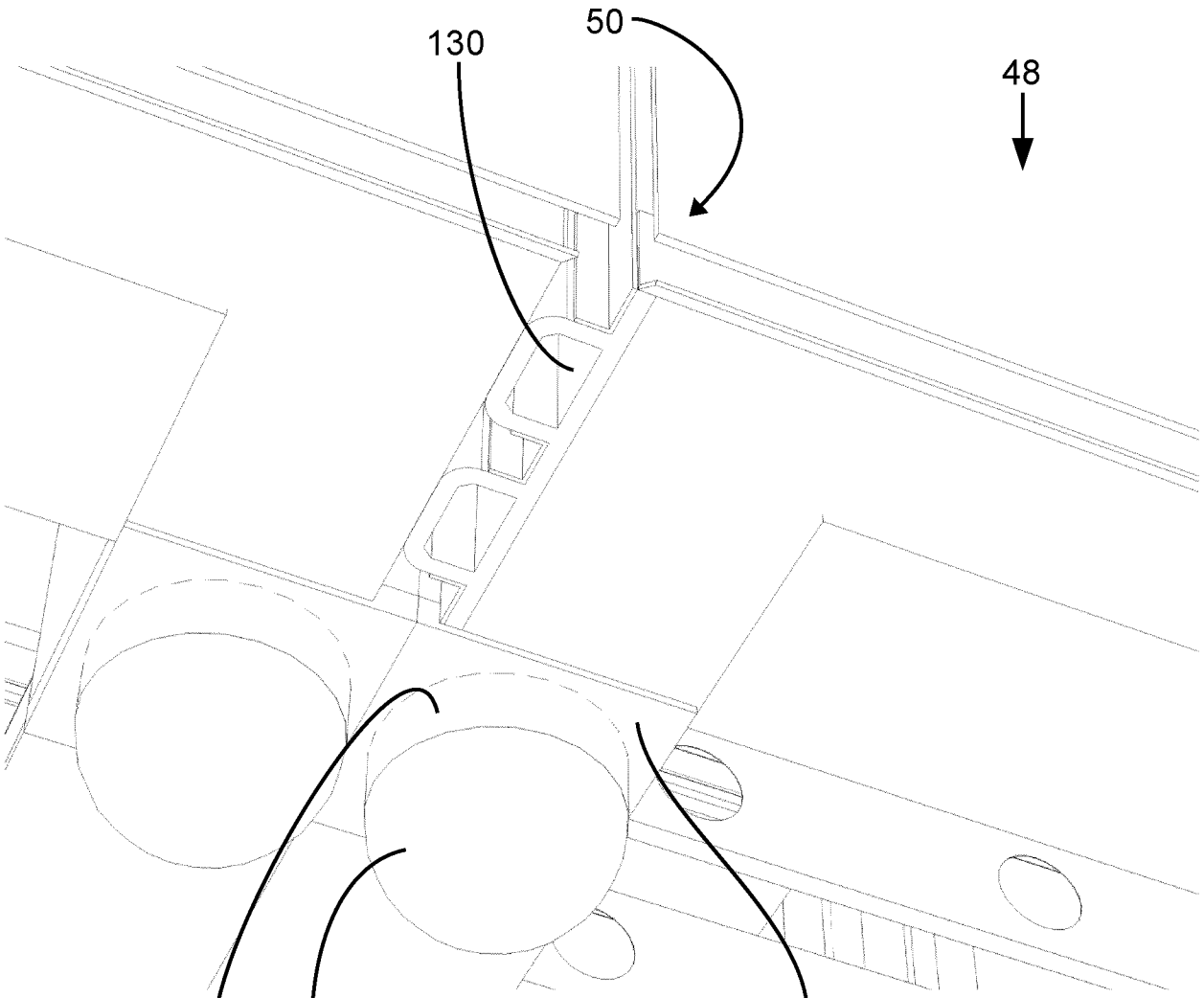
FIG. 59 is a close-up perspective bottom view of the alternative sixth module shown in FIG. 58, showing compression of a vertical SIP gasket at the bottom-left corner of the alternative sixth module.

Referring to FIG. 59 and in accordance with the second embodiment, when the second-level right module 10 is in its final position the vertical SIP gasket 130 of the second-level right module 10 is fully compressed, as seen from the bottom-side view of the second-level middle and right modules 10. For clarity of illustration the lower-level modules 10, including their respective female connectors 26, are not shown in FIG. 59.

Figure 60:
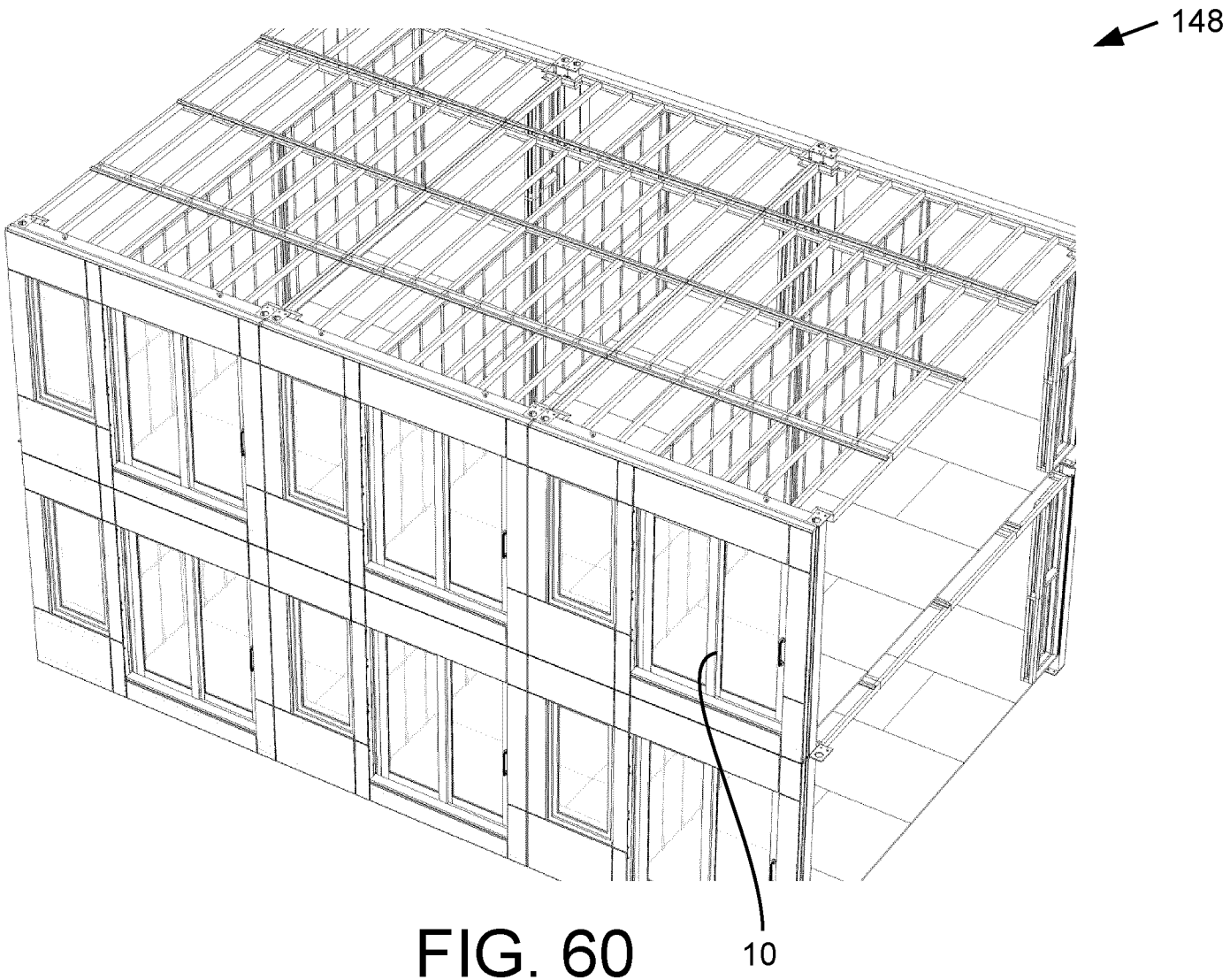
FIG. 60 is a perspective view of the six modules shown in FIG. 50, showing the sixth module assembled to its adjacent modules to form a modular building.

FIG. 60 shows the second-level right module 10 according to the first embodiment in its final position horizontally adjacent to the second-level middle module 10 and vertically adjacent to the lower-level right module 10, so as to form the modular building 148. For ease of illustration, identical modules 10 are shown; in practice, different placement of outside doors 88 can be used on the second level of the modular building 148 than is used on the first level. While not shown in FIG. 60, other modules 10 can be added to increase the size and utility of the modular building 148. For example, roofing modules described herein below may be added.

Figure 61:
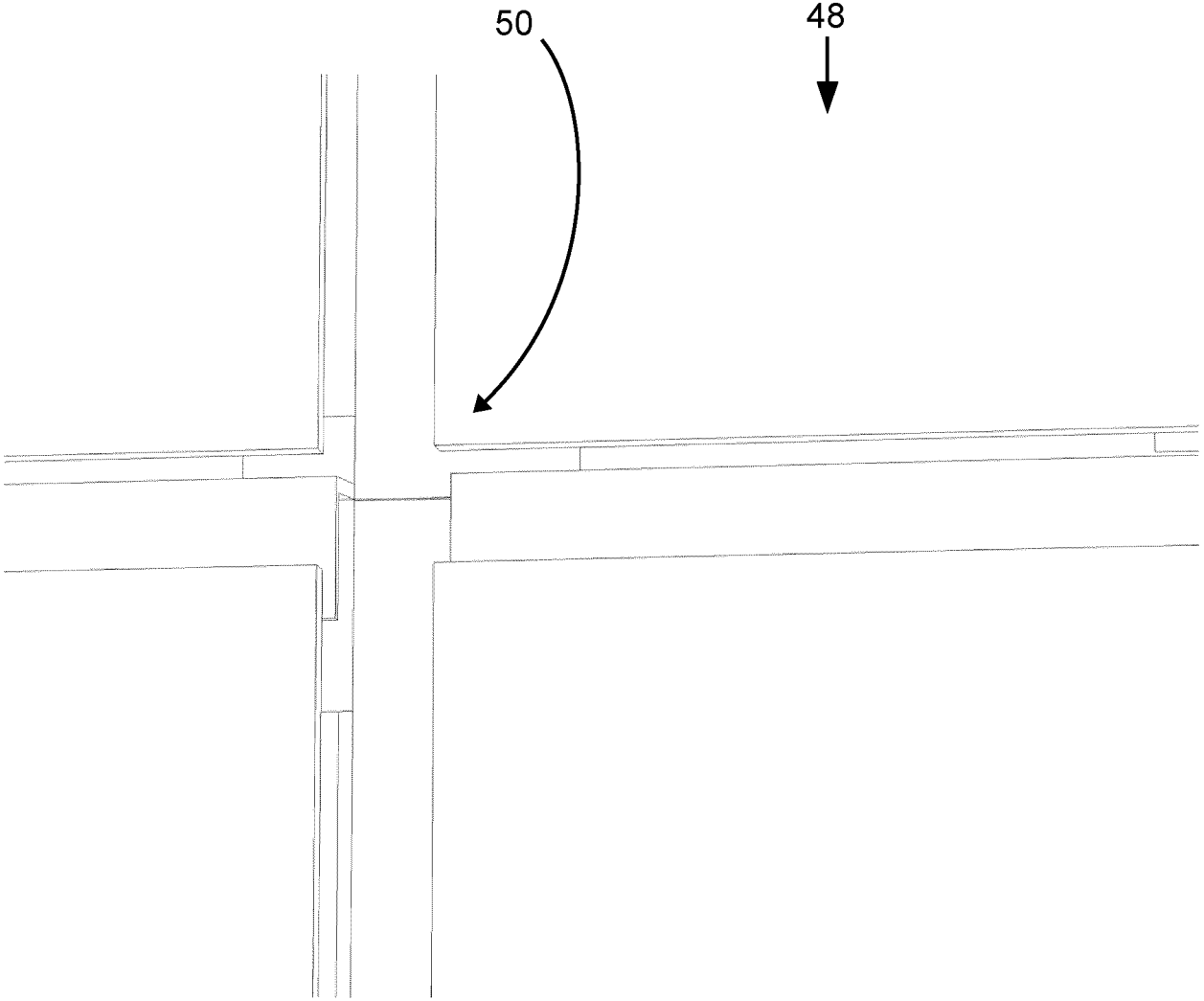
FIG. 61 is a close-up perspective view of the modular building shown in FIG. 60, showing a vertical junction of four adjacent modules of the modular building from a first perspective angle.

Referring to FIG. 61 and in accordance with modules 10 of the first embodiment, the 4-way connecting region of the lower-level and second-level middle and right modules 10 is shown. When the modules 10 are connected to each other, the insulation gaskets 110 and 111 are all compressed. Although not entirely visible in FIG. 61, the membrane gaskets 92 and 98 are also compressed when the modules 10 are connected to each other.

Figure 62:
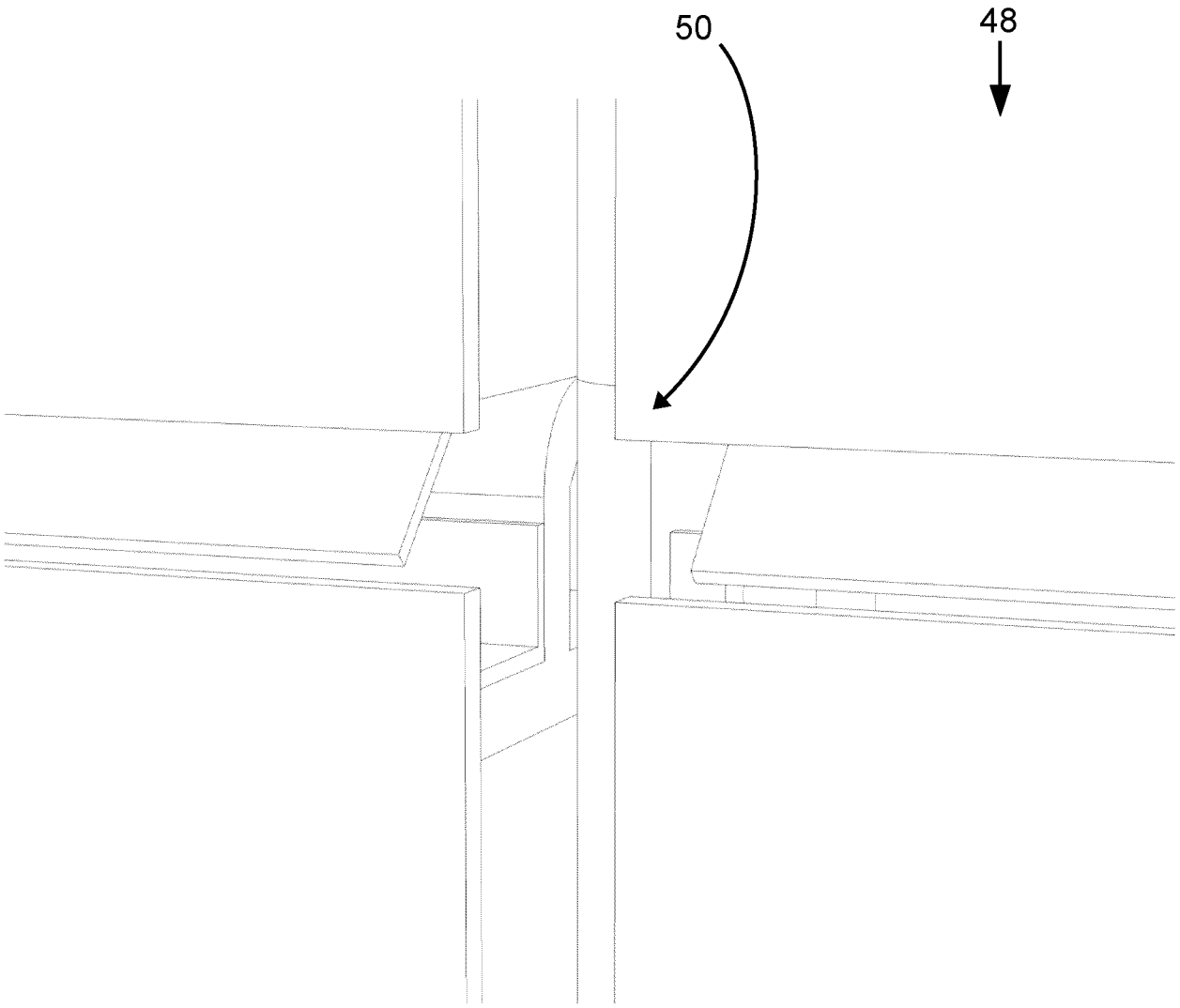
FIG. 62 is a close-up perspective view of an alternative to the vertical junction shown in FIG. 61, showing the alternative vertical junction according to the second embodiment from a second perspective angle.
Figure 63:
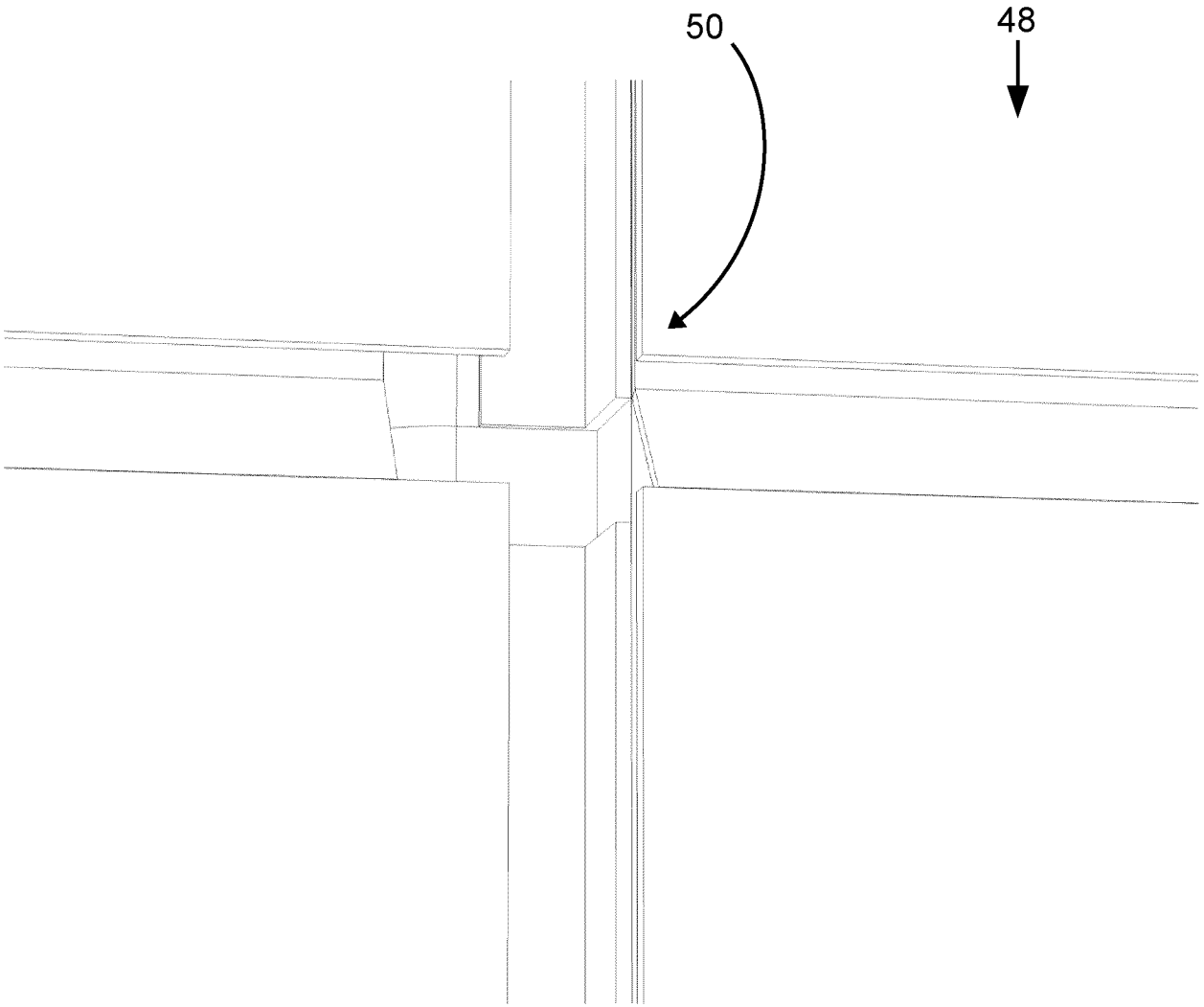
FIG. 63 is a close-up perspective view of the alternative vertical junction shown in FIG. 62, showing the alternative vertical junction according to the second embodiment from a third perspective angle.

Referring to FIGS. 62 and 63 and in accordance with modules 10 of the second embodiment, the 4-way connecting region of the lower-level and second-level middle and right modules 10 is shown from slightly different perspective angles of view. Although not entirely visible in FIGS. 62 and 63, the SIP gaskets 130 and 132 are compressed when the modules 10 are connected to each other. FIG. 62 shows the 4-way connecting region from further rightward than shown in FIG. 61, and FIG. 63 shows the 4-way connecting region from a slightly leftward perspective relative to the perspective angle of FIG. 61.

Although not visible in FIGS. 61 to 63, in accordance with the first and second embodiments bolts (not shown) are inserted through the bolt holes 24 of the male connector 18, the bolt holes 146 of the spacer plate 142, and through the bolt holes 34 of the female connector 26 and then fastened by corresponding nuts (not shown) to connect adjacent modules 10 together.

Third Embodiment

Figure 64:
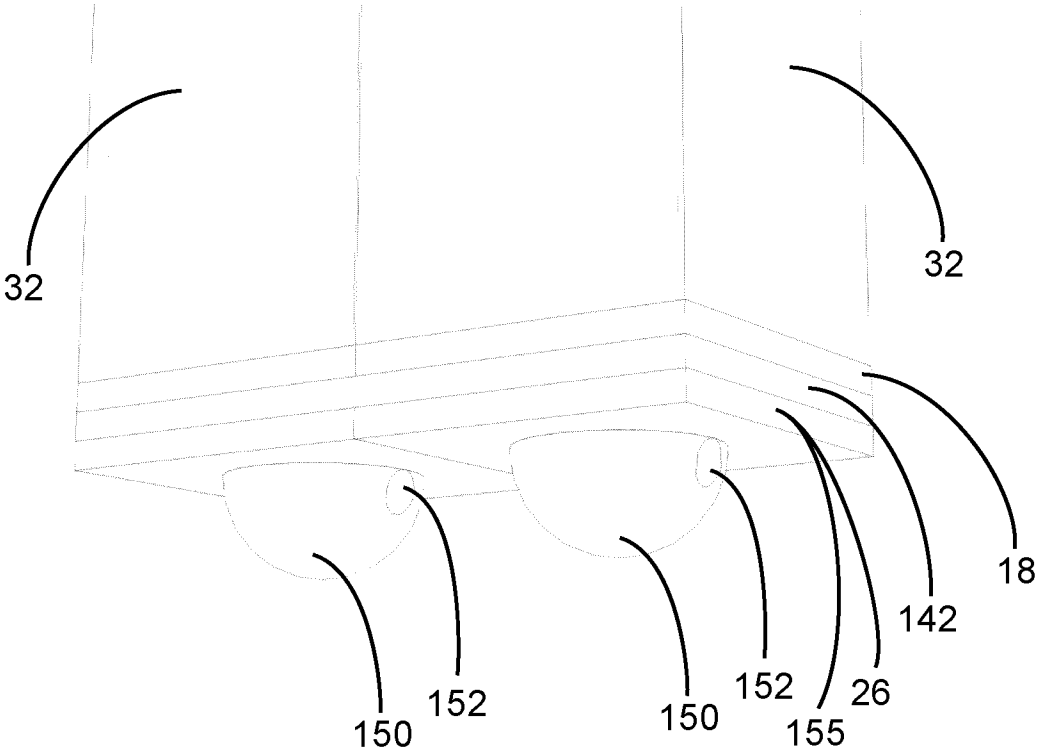
FIG. 64 is a perspective view of a male connector according to a third embodiment of the invention, showing a horizontal bolt hole through terminuses of a pair of the male connectors.
Figure 65:
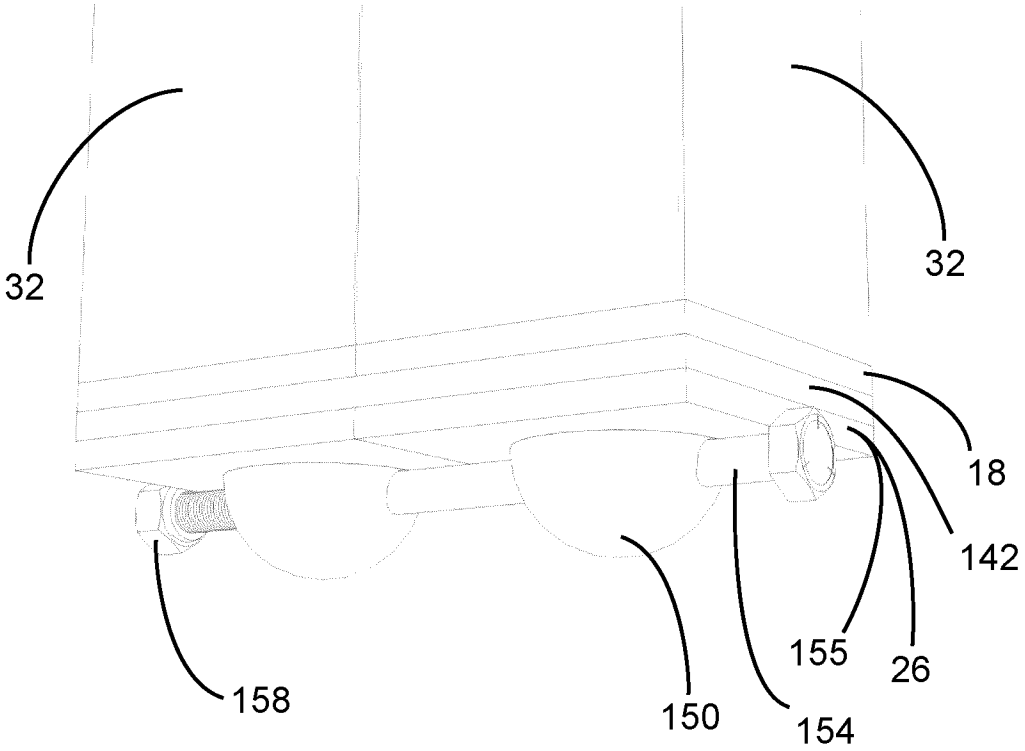
FIG. 65 is a perspective view of the pair of male connectors shown in FIG. 64, showing a bolt extending through the horizontal bolt hole and a nut fastened to the bolt.

Referring to FIGS. 64 to 67 in which certain module 10 features are omitted for clarity of illustration, the male connector 18 has a terminus 150 in accordance with a third embodiment of the invention. The terminus 150 is similar to the terminus 20 (FIG. 2) of the first and second embodiments. However, the terminus 150 includes a horizontally oriented terminus bolt hole 152 for receiving a terminus bolt 154. In this manner, a given module 10 becomes connected to its vertically and horizontally adjacent modules 10 with a single terminus bolt 154 that spans between a pair of adjacent terminuses 150. The terminus bolt 154 typically, but not necessarily, spans horizontally. FIGS. 64 and 65 show upper end caps 155 (of lower connection columns that are not otherwise visible in FIGS. 64 and 65 below the upper connection columns 32 so as to reveal the bolt holes 152 and terminus bolt 154 within the lower connection columns).

Figure 66:
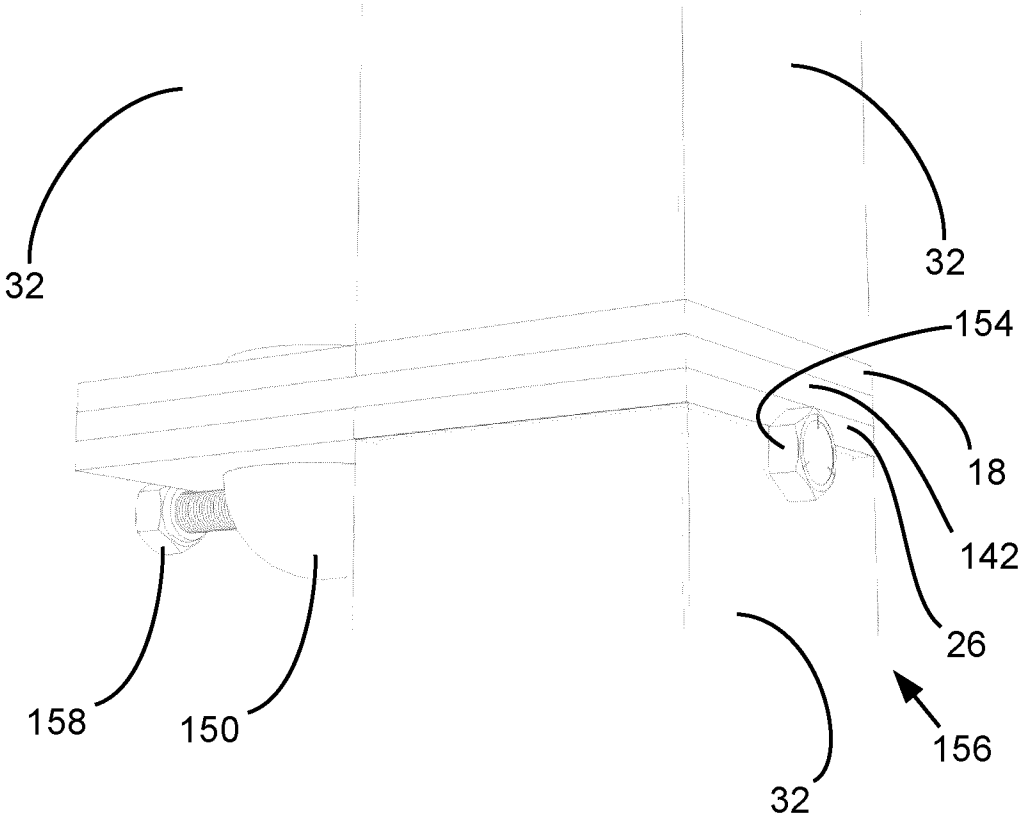
FIG. 66 is a perspective view of the bolt shown in FIG. 65, showing the bolt extending through a first lower column.
Figure 67:
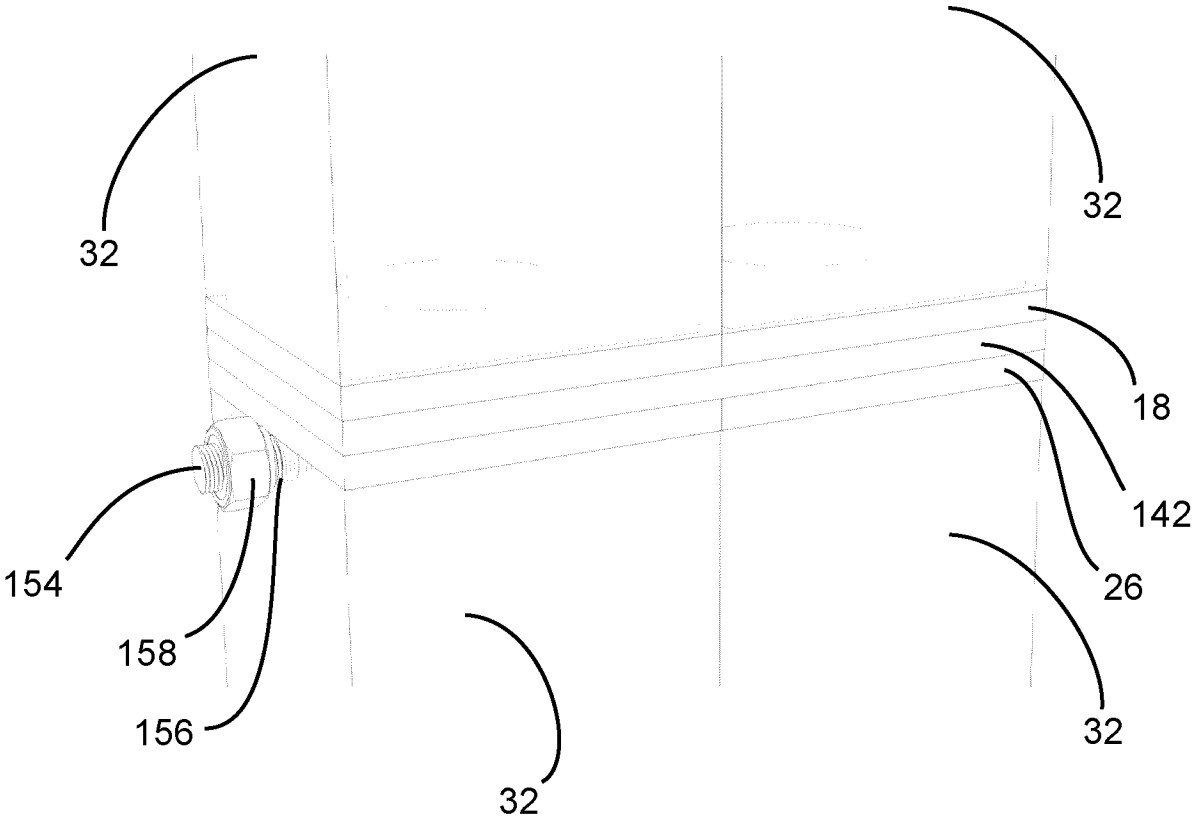
FIG. 67 is a perspective view of the bolt shown in FIG. 65, showing the bolt extending through the first and a second lower column.

Referring to FIGS. 66 and 67, the column 32 in accordance with the third embodiment includes column bolt holes 156 for receiving the terminus bolt 154. After the terminus bolt 154 has passed through the column bolt holes 156 and the terminus bolt holes 152 associated with two adjacent modules 10, the terminus bolt 154 is secured by a nut 158. In FIGS. 66 and 67, lower connection columns 32 are shown as having invisible or translucent walls to reveal details within such lower connection columns 32.

In the third embodiment, the vertical bolt holes 24 and 34 become optional and the spacer plate 142 and/or its holes 146 (FIGS. 44 and 45) become optional, given that a vertical bolt is not needed to be used. In some embodiments, however, the spacer plate 142 may be employed in conjunction with the third-embodiment terminus 150 such that the spacer plate 142 accurately positions adjacent modules 10 relative to each other. In some embodiments, the vertical bolt holes 24 and 34 (or vertical bolt holes 24, 34 and 146) are combined with the terminus bolt hole 152 and the column bolt holes 156 for additional connective strength between adjacent modules 10. Other techniques and combinations thereof for positioning and/or attaching adjacent modules 10, adjacent columns 32 of adjacent modules 10, adjacent male connectors 18 of adjacent modules 10, and/or adjacent female connectors 26 of adjacent modules 10 are possible.

Fourth Embodiment

Referring to 68 to 72, a key-lock system 160 for connecting adjacent modules 10 is employed in a fourth embodiment of the invention.

The key-lock system 160 includes a key-lock column 162 that is similar to the connection column 32 (FIG. 4), but is modified to include a lower end cap 164 having a central aperture 166 defining one or more end-cap key slots 168; to house a driver 170 and to include one or more inwardly projecting stop tabs 172; and to incorporate a key-lock male connector 174 having a connector stop 176 and one or more keys 178.

A key-lock female connector 180, having a key-lock plate 182 defining a key-lock aperture 184 and one or more key slots 186, is dimensioned to receive the key-lock male connector 174. Specifically in the fourth embodiment, the key-lock aperture 184 is dimensioned to receive the terminus 20 and the projection member 22 of the key-lock male connector 174 and the key slots 186 are dimensioned to receive the keys 178.

For ease of explanation, the key-lock columns 162 in FIGS. 68 to 72 are shown as see-through from a side view to render visible features that are housed within the key-lock columns 162. However, under ordinary conditions the key-lock columns 162 are solid, typically made of metal, and opaque along their respective sides.

A key-lock spacer plate 188 is employed in some embodiments during assembly of a modular building. The key-lock spacer plate 188 includes one or more key-lock spacer apertures 189 defining one or more spacer key slots 190. While FIGS. 68 to 72 show the key-lock spacer plate 188 as having only one key-lock spacer aperture 189, typically each key-lock spacer plate 188 includes either one, two, three or four key-lock spacer apertures 189 depending on the location within a given modular building of the key-lock spacer plate 188.

Typically, the key-lock column 162 includes the key-lock male connector 174 at one end and the key-lock female connector 180 at its opposite end. For example, FIGS. 68 to 72 show an upper key-column 162 (of a partly shown upper module 10) above a lower key-lock column 162 (of a partly shown lower module 10) in which each key-lock column 162 includes a key-lock male connector 174 at its lower end and a key-lock female connector 180 at its upper end. However, in some embodiments the key-lock column 162 includes its key-lock male connector 174 at its upper end and its key-lock female connector 180 at its lower end.

The driver 170 in the fourth embodiment extends nearly the entire inner length of the key-lock column 162 such that the driver 170 can be accessed through the key-lock aperture 184 without the driver 170 impinging on the recess defined by the key-lock female connector 180 for receiving the key-lock male connector 174. In some embodiments, the driver 170 is removably attachable to the remainder of the key-lock system 160, such as by being removably attachable to the connector stop 176 for example. In such embodiments, the removable driver 170 can be inserted into the key-lock column 162 via the key-lock aperture 184 for use, and need not be permanently housed within the key-lock column 162.

While FIGS. 68 to 72 show the key-lock column 162 in a vertical orientation, in some embodiments the key-lock system 160 is operated to connect horizontally adjacent modules 10 by horizontally orienting the key-lock columns 162.

Figure 68:
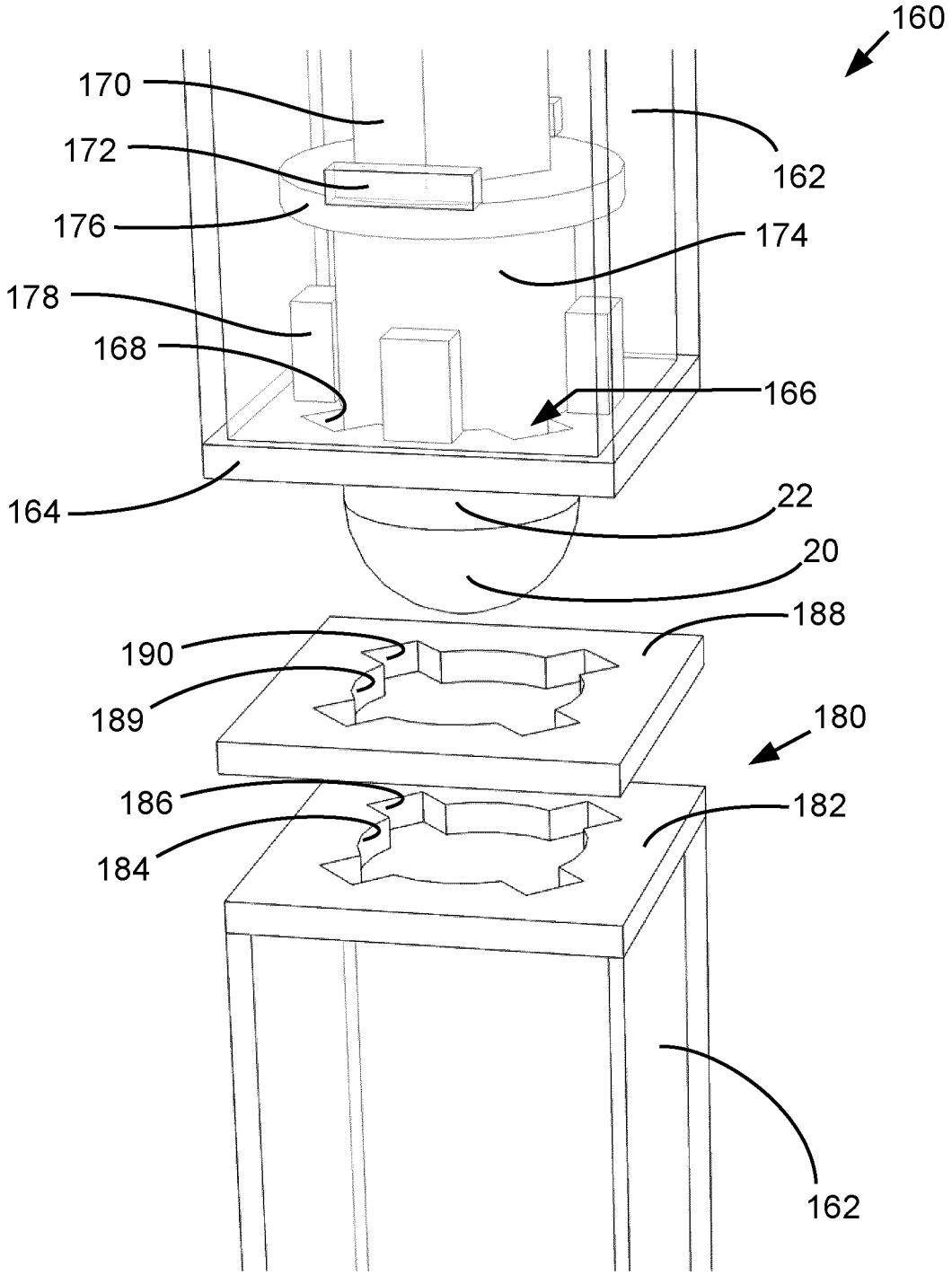
FIG. 68 is a perspective assembly view of a key-lock system for connecting adjacent modules according to a fourth embodiment of the invention.

Referring to FIG. 68, assembling at least one module 10 to form a modular building using the key-lock system 160 of the fourth embodiment involves lifting and rotating the key-lock male connector 174 until the keys 178 rest above lower end cap 164 and do not align with the end-cap key slots 168. Lifting and rotating the key-lock male connector 174 may be performed by directly grasping, clasping or clamping the key-lock male connector 174 to move it, by accessing a permanently housed driver 170 within the upper-key-lock column 162, or may be performed by inserting a removable driver 170 for example. In the fourth embodiment, the distance between the stop tabs 172 and the lower end cap 164 is at least as much as the distance between the top of the connector stop 176 and the bottoms of the keys 178, so that the keys 178 can fit above the lower end cap 164. In this manner, the stop tab(s) 172 advantageously prevent the terminus 20 of the key-lock male connector 174 from entering into the upper key-lock column 162 while advantageously permitting the driver 170 and the keys 178 to rotate within the upper key-lock column 162 above the lower end cap 164. The keys 178 can advantageously be prevented from exiting the bottom of the upper key-lock column 162 by misalignment between the keys 178 and the key slots 186.

Figure 69:
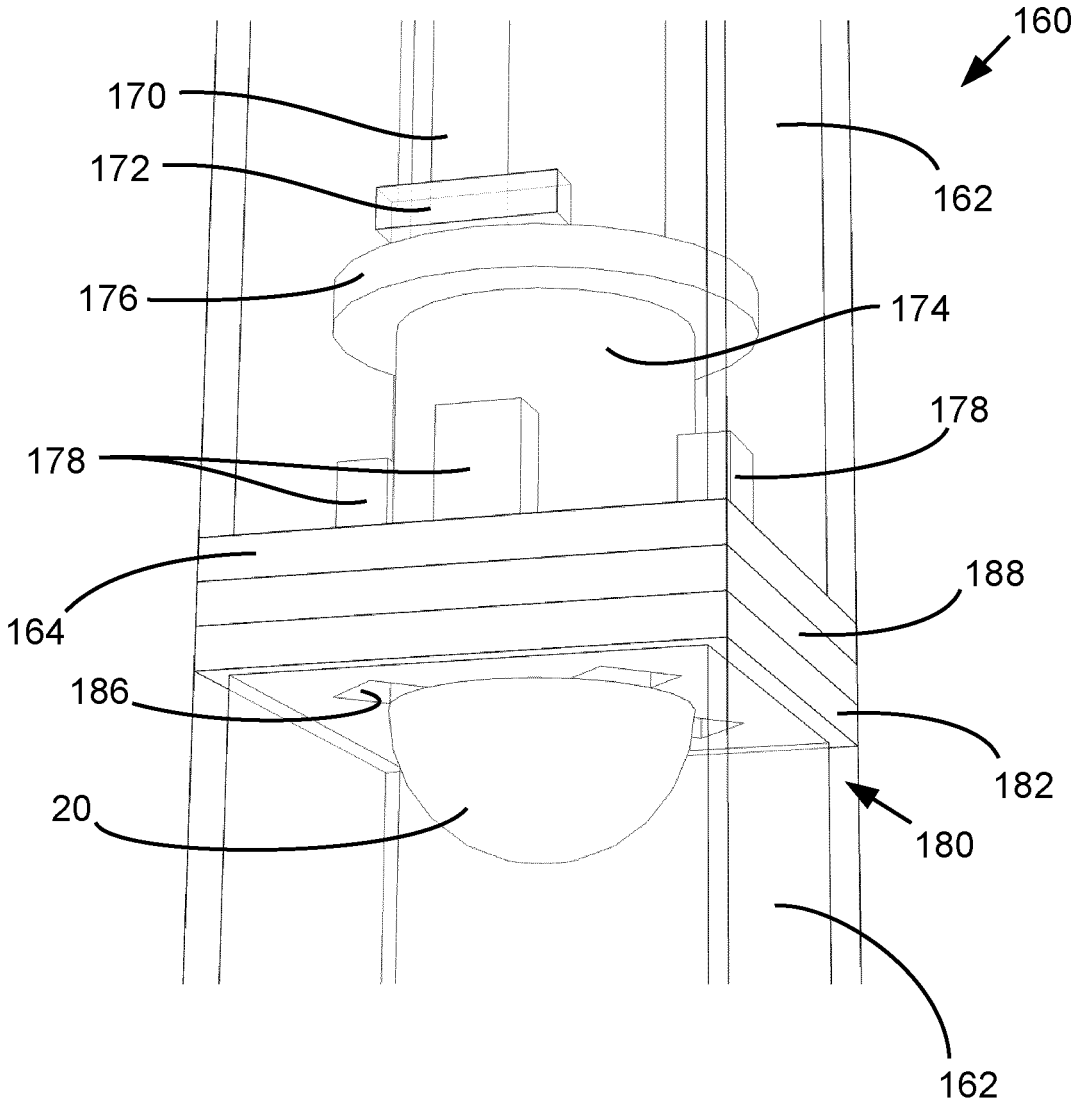
FIG. 69 is a perspective view of the key-lock system shown in FIG. 68, showing an upper column connected to a lower column in an unlocked state.

Referring to FIG. 69, assembling the modules 10 involves off-level installation as described herein above until the terminus 20 of the key-lock male connector 174 is received within a recess defined by the key-lock female connector 180. During off-level installation, the terminus 20 and the projection member 22 of the key-lock male connector 174 are prevented from excessively retreating up inside the key-lock column 162 by contact between the connector stop 176 and the stop tabs 172.

Figure 70:
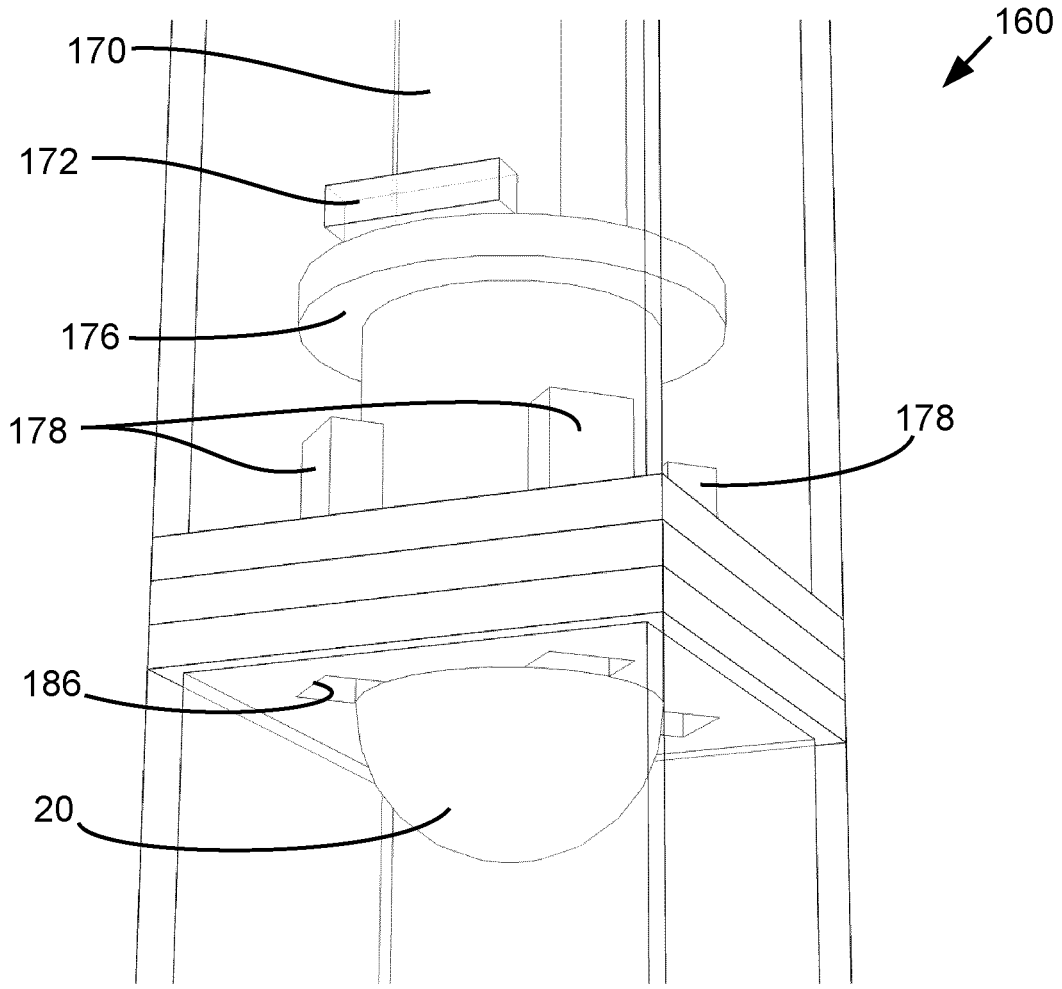
FIG. 70 is a perspective view of the connected upper and lower columns shown in FIG. 69, showing the unlocked key-lock male connector rotated to place keys of the key-lock male connector in alignment with key slots of a key-lock female connector.

Referring to FIG. 70, after the terminus 20 and the projection member 22 of the key-lock male connector 174 are received by the key-lock female connector 180, the driver 170 is accessed and rotated until the keys 178 are in alignment with the key slots 186.

Figure 71:
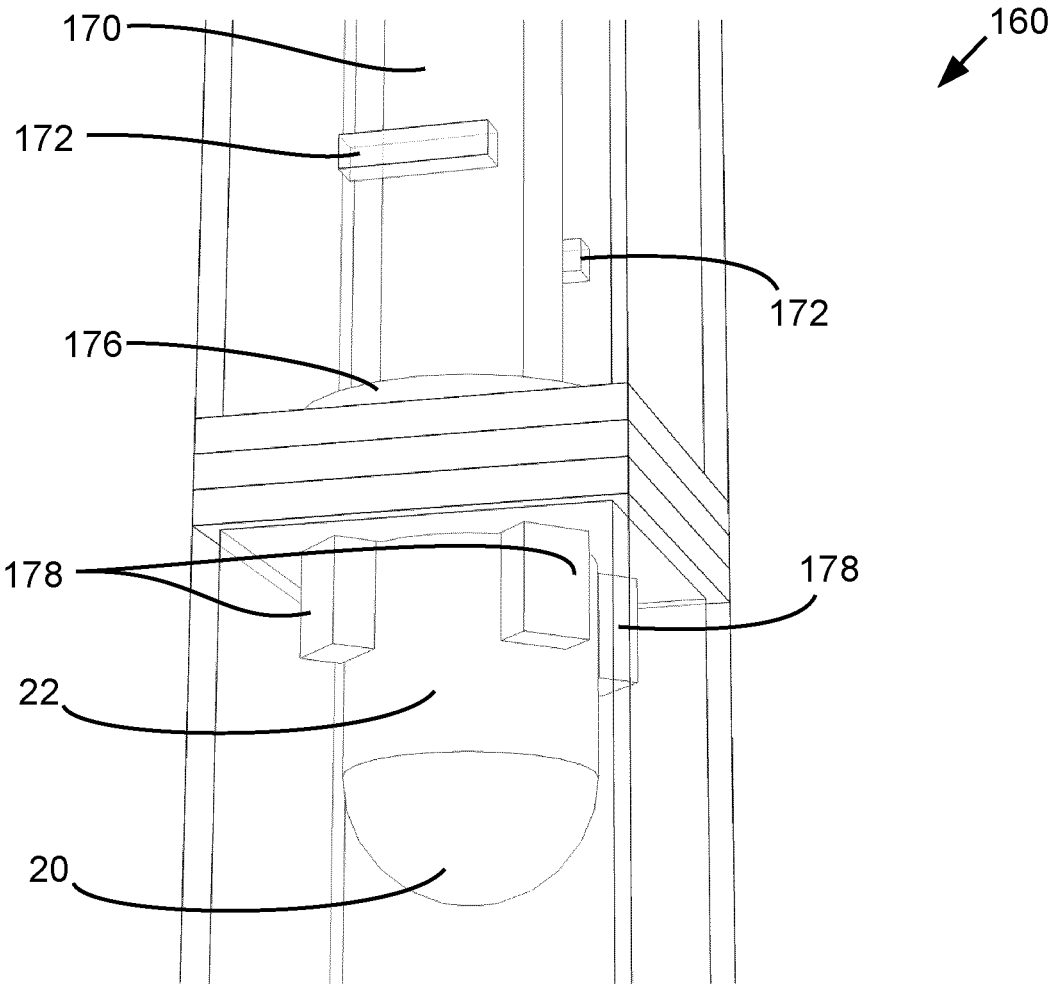
FIG. 71 is a perspective view of the connected upper and lower columns shown in FIGS. 69 and 70, showing the key-lock male connector fully received by the key-lock female connector.

Referring to FIG. 71, when the keys 178 are in alignment with the key slots 186, the key-lock male connector 174 falls or is pushed down until the keys 178 are fully in the recess below the key-lock plate 182 so as to be fully received by the key-lock female connector 180.

Figure 72:
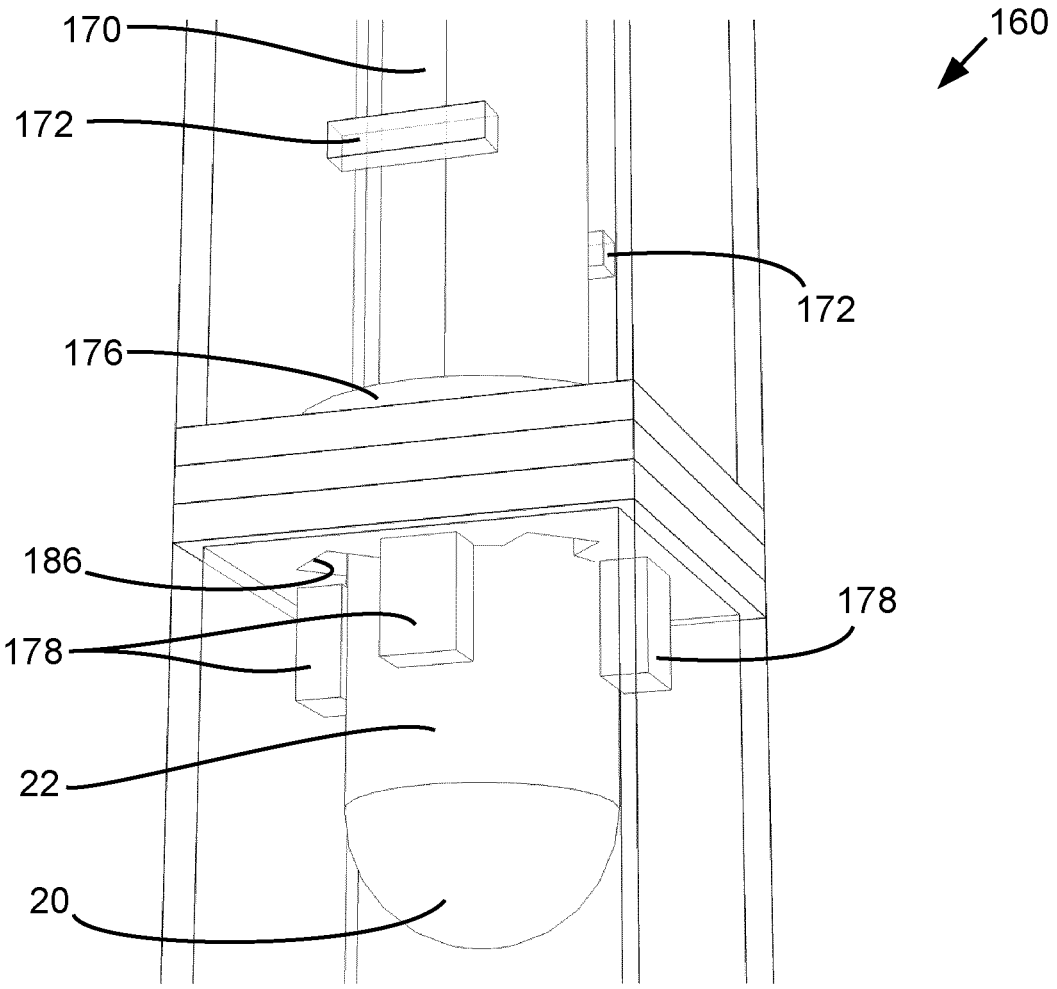
FIG. 72 is a perspective view of the connected upper and lower columns shown in FIGS. 69 to 71, showing the key-lock male connector locked to the key-lock female connector.

Referring to FIG. 72, when the key-lock male connector 174 including its keys 178 is fully received by the key-lock female connector 180, the driver 170 is accessed and rotated until the keys 178 do not align with the key slots 186 such that the key-lock male connector 174 is locked to the key-lock female connector 180.

In variations of embodiments, the bolt holes 24 and 34 of the first embodiment and/or the terminus bolt hole 152 and the column bolt holes 156 of the third embodiment may be combined with the key-lock system 160, for example. Other variations that would be apparent to those skilled in the art are possible and are within the scope contemplated by the present invention.

Roofing Modules

Figure 73:
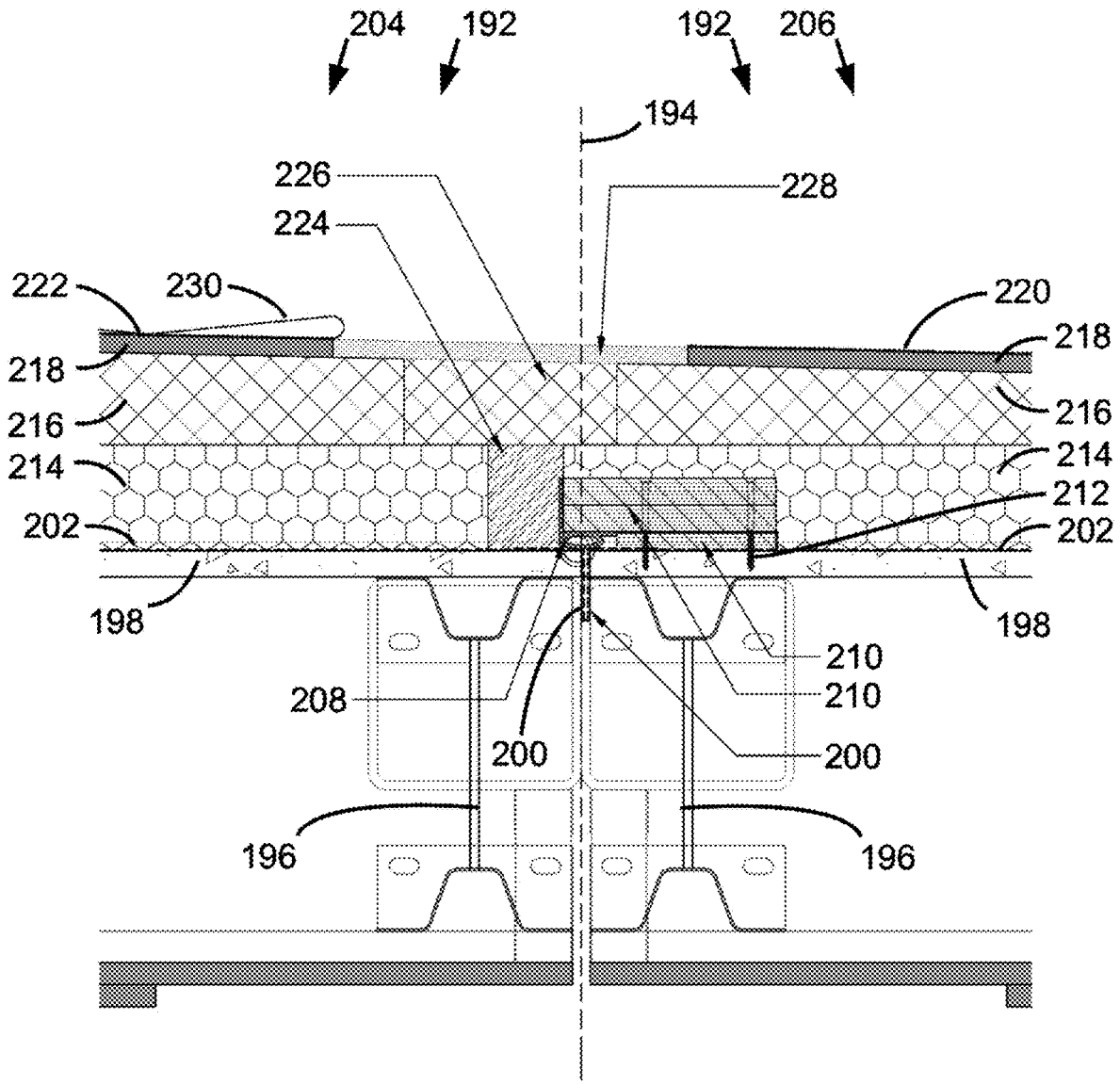
FIG. 73 is a sectional view of a pair of horizontally adjacent roofing modules according to any embodiment of the invention, showing a gasketed roofing module and a gasket-receiving roofing module.
Figure 74:
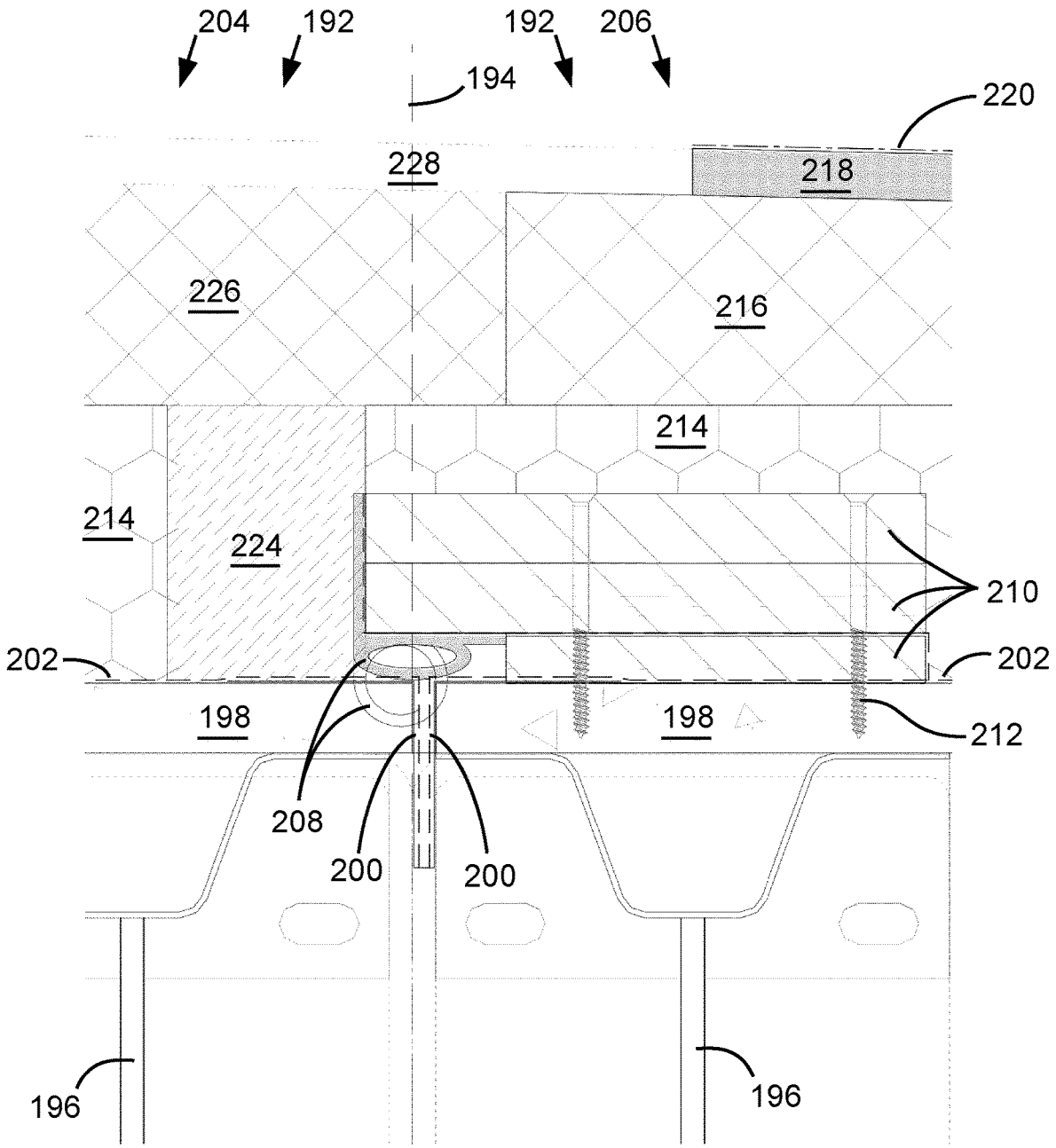
FIG. 74 is a close-up sectional view of the pair shown in FIG. 73, showing a roofing gasket in detail.

Referring to FIGS. 73 and 74, the modular building 148 in accordance with any embodiment may include one or more roofing modules 192. Each roofing module 192 includes at least one male connector 18 (not visible in FIGS. 73 and 74), and typically includes four male connectors 18 at opposing corners of the roofing module 192. Typically, the number of roofing modules 192 is equal to the number of habitation modules 10 that are horizontally adjacent on the topmost level of a given modular building. The roofing modules 192 are fabricated at a fabrication facility to be dimensioned for off-level installation of the roofing modules 192 at the top of a modular building, so as to connect and attach the male connectors 18 of the roofing module(s) 192 to female connectors 26 at the ceiling(s) 60 of the topmost level modules 10. Upon installation of the roofing modules 192 to a modular building, horizontally adjacent roofing modules 192 are sealed to each other on site.

Each roofing module 192 can have any suitable structure, although the roofing modules 192 are preferably structured according to local prevailing and extreme weather conditions to withstand and deflect snow accumulation, withstand wind speeds, prevent ingress of water and provide thermal insulation for a given modular building. Variations of the roofing modules 192 are within the scope contemplated by the present invention, provided the roofing modules 192 include the male connector(s) 18. Typically, the roofing modules 192 do not include any female connectors 26, in contrast to foundation modules (not shown) that typically include female connectors 26 but typically do not include any male connectors 18.

Sectional views of a portion of a pair of horizontally adjacent roofing modules 192 are shown in FIGS. 73 and 74. The boundary between the horizontally adjacent roofing modules 192 is indicated in FIGS. 73 and 74 by the dotted separation line 194. In the exemplary embodiment shown in FIGS. 73 and 74, each roofing module 192 includes structural elements, such as one or more joists 196, that rest above the ceiling of lower modules 10 when assembled in a modular building. Above the joists 196 is a roof deck 198, which may be made of any suitable material such as wood, plywood, steel, concrete, other roof deck material, and any combination thereof for example. In the exemplary embodiment of FIGS. 73 and 74, each roofing module 192 includes a pair of corner pieces 200 that are L-shaped in cross-section and installed to define an edge of the roofing module 192. The corner pieces 200 may be made of prefinished brake metal, for example.

Above the roof deck 198 and the corner piece 200 is a roofing membrane 202 for providing a vapour barrier. The inner roofing membrane 202 is indicated in FIGS. 73 and 74 by dotted line, and may be made of any suitable material and applied in any suitable manner. The inner roofing membrane 202 may be identical, similar or analogous to the envelope membrane 82 and/or the SIP envelope membrane 126, for example.

Still referring to FIGS. 73 and 74, to the left of the separation line 194 is a gasket-receiving roofing module 204 and to the right of the separation line 194 is a gasketed roofing module 206.

The gasketed roofing module 206 includes a roofing gasket 208, which may be any suitable gasket dimensioned to span any gap existing between the roofing modules 204 and 206 upon assembly. The roofing gasket 208 may be identical, similar or analogous to the horizontal membrane gasket 98 of the first embodiment, for example. Analogous to the exterior wall 116 of the first embodiment, the roofing gasket 208 is fastened or otherwise attached to the roofing blocking 210 so as to face downward as shown in FIGS. 73 and 74.

FIGS. 73 and 74 show a loop section of the roofing gasket 208 in both its uncompressed state prior to installation of the gasketed roofing module 206 and in its compressed state upon installation of the gasketed roofing module 206.

In the exemplary embodiment of FIGS. 73 and 74, screws 212 fasten the roofing blocking 210, with the roofing gasket 208 attached thereto, to the roof deck 198. Around and above is a layer of first roofing insulation 214, above that is a layer of second roofing insulation 216, and above that is a protection board 218 suitable for protecting the first and second insulations 214 and 216 therebelow. The protection board 218 also provides a rigid surface on which to adhere or otherwise attach an outer roofing membrane 220 applied to the outer side of the protection board 218. The outer roofing membrane 220 may be made of any suitable material and applied in any suitable manner. The outer roofing membrane 220 may be identical, similar, different, or analogous to the envelope membrane 82, the SIP envelope membrane 126, and/or the inner roofing membrane 202 for example. The outer roofing membrane 220 is preferably selected according to local prevailing and extreme weather conditions, for example.

The gasket-receiving roofing module 204 includes above its inner roofing membrane 202 the layer of first roofing insulation 214, the layer of second roofing insulation 216, the protection board 218, and the foldable roofing membrane 222, in a manner identical, similar or analogous to such roofing components 214 to 220 of the gasketed roofing module 206. However, some or all of such roofing components 214 to 222 of the gasket-receiving roofing module 204 are fabricated at a fabrication facility to be set back from the edge of the gasket-receiving roofing module 204 so as to leave a gap between the roofing components 214 to 222 of the horizontally adjacent modules 204 and 206 upon assembly. Such roofing components 214 to 222 are typically made of materials that are identical to that of the roofing components 214 to 222 of the gasketed roofing module 206, respectively, although variations are possible, for example. In the exemplary embodiment shown in FIGS. 73 and 74, the gasket-receiving roofing module 204 does not include the roofing gasket 208, the roofing blocking 210 and the screws 212.

Installation of the roofing modules 204 and 206 is preferably sequenced such that the gasket-receiving roofing module 204 is installed prior to installing the gasketed roofing module 206. Sequenced installation advantageously permits the roofing gasket 208 to compress against the inner roofing membranes 202 of both horizontally adjacent modules 204 and 206 and to span any gap present between the horizontally adjacent modules 204 and 206. In some installations, sealant or other filler material is applied on-site to fill gaps between modules 10.

After sequenced installation of the horizontally adjacent modules 204 and 206, a layer of first interposing roofing insulation 224 is applied on-site between the respective first roofing insulation 214 layers of the horizontally adjacent modules 204 and 206. The first interposing roofing insulation 224 is typically dimensioned to extend between the first roofing insulations 214 of the horizontally adjacent modules 204 and 206, and can be made of a material that is identical to that of the first roofing insulation 214 for example.

A layer of second interposing roofing insulation 226 is applied on-site above the first interposing roofing insulation 224. The second interposing roofing insulation 226 is typically dimensioned to extend between the second roofing insulations 216 of the horizontally adjacent modules 204 and 206, and can be made of a material that is identical to that of the second roofing insulation 216 for example.

A protection board section 228 is applied on-site to extend between the protection boards 218 of the horizontally adjacent modules 204 and 206, and can be made of the same material as the protection boards 218 for example.

The foldable roofing membrane 222 includes the membrane flap 230 that is folded over onto the protection board section 228 and preferably at least slightly overlapping the outer roofing membrane 220 of the gasketed (or otherwise adjacent) roofing module 206. The membrane flap 230 is attached in any suitable manner, such as by adhering (including possibly by peel-and-stick application), heat welding, other attachment techniques, and any combination thereof for example.

While FIGS. 73 and 74 show the membrane flap 230 as part of the gasket-receiving roofing module 204, in general the membrane flap 230 may form part of either the gasket-receiving roofing module 204 or the gasketed roofing module 206. Preferably, where the roof of a modular building is desired to be sloped, the membrane flap 230 forms part of the higher roofing module 192 so that it can be folded over onto a lower roofing module 192, in the manner of overlapping roof shingles for example.

In some embodiments, all roofing components that are sloped, such as those above the first roofing insulation 214 of both horizontally adjacent modules 204 and 206, are installed on site. In some embodiments, the heights of the joists 196 are varied such that the roof deck 198 is sloped. In variations, any or all roofing components of the roofing module 192 may or may not be sloped.

In general, the roofing module 192 may include any number of layers of insulation, need not include either or both of the first and second roofing insulations 214 and 216, and need not be limited to only including the first and second roofing insulations 214 and 216.

Figure 75:
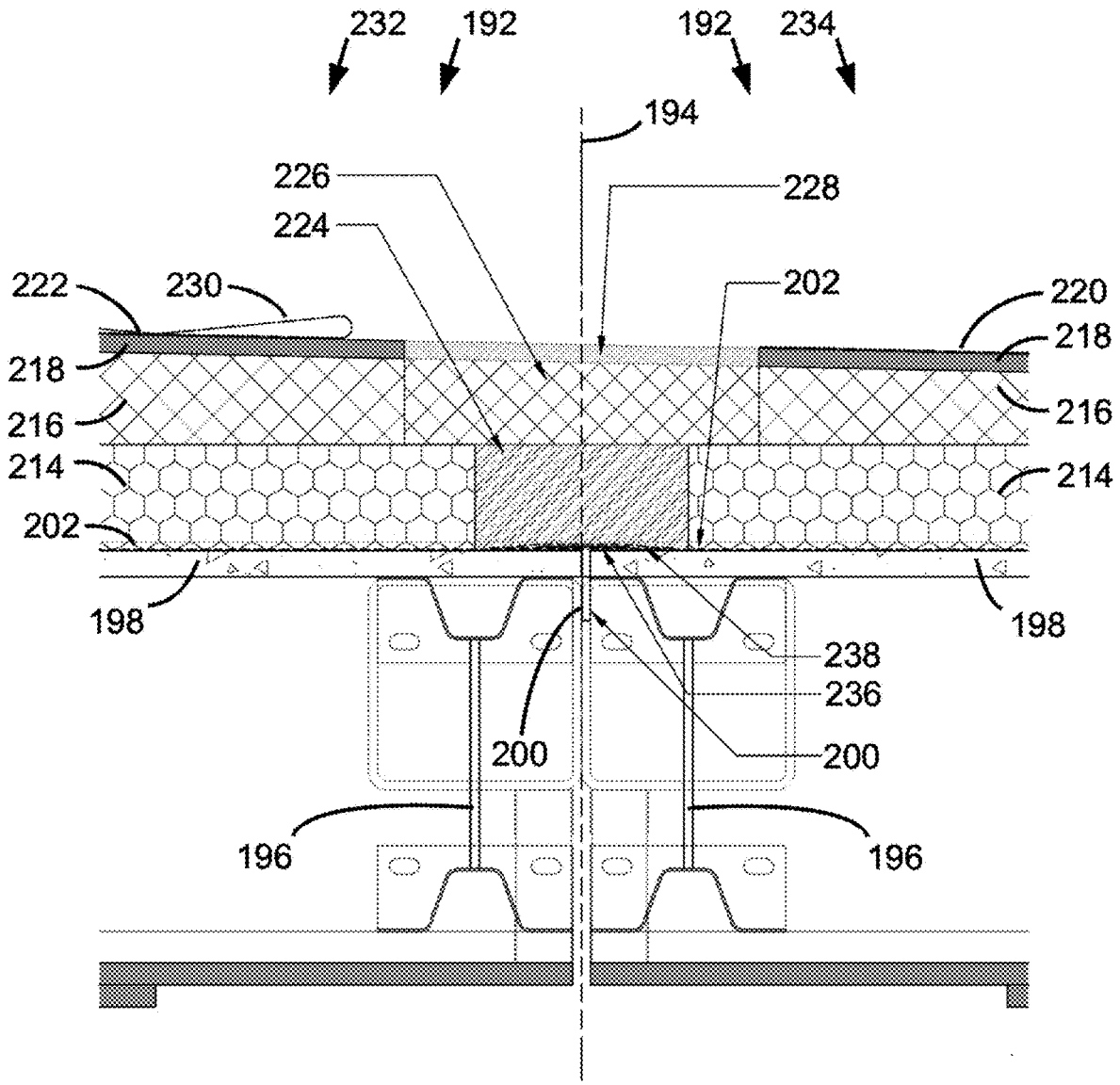
FIG. 75 is a sectional view of first and second horizontally adjacent roofing modules according to a variation of the pair shown in FIGS. 73 and 74, showing a membrane strip laid on inner roofing membranes of the first and second adjacent roofing modules.
Figure 76:
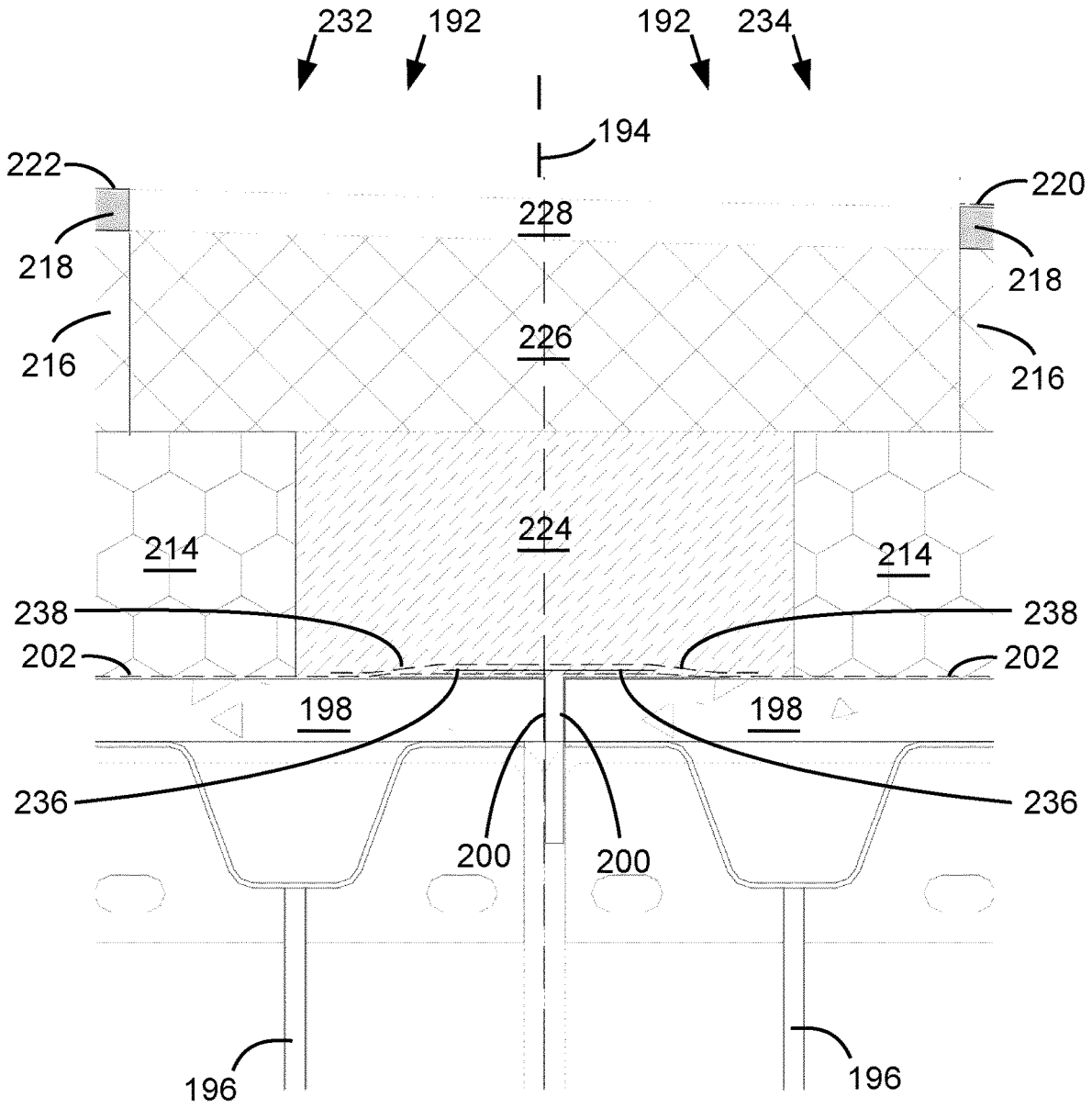
FIG. 76 is a close-up sectional view of the first and second adjacent roofing modules shown in FIG. 75, showing the membrane strip in detail.

Referring to FIGS. 75 and 76, a variation of the roofing modules 192 does not include the roofing gasket 208. In such variation, at least a first adjacent roofing module 232 and a second adjacent roofing module 234 are installed to a modular building in any order so as to be horizontally adjacent to each other. Typically, each of the first and second adjacent roofing modules 232 and 234 are pre-fabricated to include the inner roofing membrane 202, and to optionally include the corner piece 200. Also, the first and second adjacent roofing modules 232 and 234 are typically pre-fabricated to each include first roofing insulation 214, second roofing insulation 216, and protection board 218 dimensioned to be set back from the separation line 194 shown in FIGS. 75 and 76. Given that the roofing gasket 208 is excluded from the embodiment shown in FIGS. 75 and 76, such embodiment need not include the roofing blocking 210 and the screws 212 (FIGS. 73 and 74).

Thereafter on-site, a bridging piece 236 may be optionally placed on the inner roofing membranes 202 of the first and second adjacent roofing modules 232 and 234 so as to bridge across any gap existing between the first and second adjacent roofing modules 232 and 234. The bridging piece 236 is typically rigid or semi-rigid, and may be made of any suitable material such as sheet metal for example.

In accordance with the variation shown in FIGS. 75 and 76, a membrane strip 238 is laid on the inner roofing membranes 202 of the first and second adjacent roofing modules 232 and 234 (or the optional bridging piece 236) so as to extend across any gap existing between the roofing modules 232 and 234. In this manner, the first and second adjacent roofing modules 232 and 234 advantageously do not need to include the roofing gasket 208 and advantageously can be installed in any order.

The first and second interposing roofing insulation 224 and 226 and the protection board section 228 are installed in the manner described herein above, and the membrane flap 230 is attached in the manner described herein above.

Figure 77:
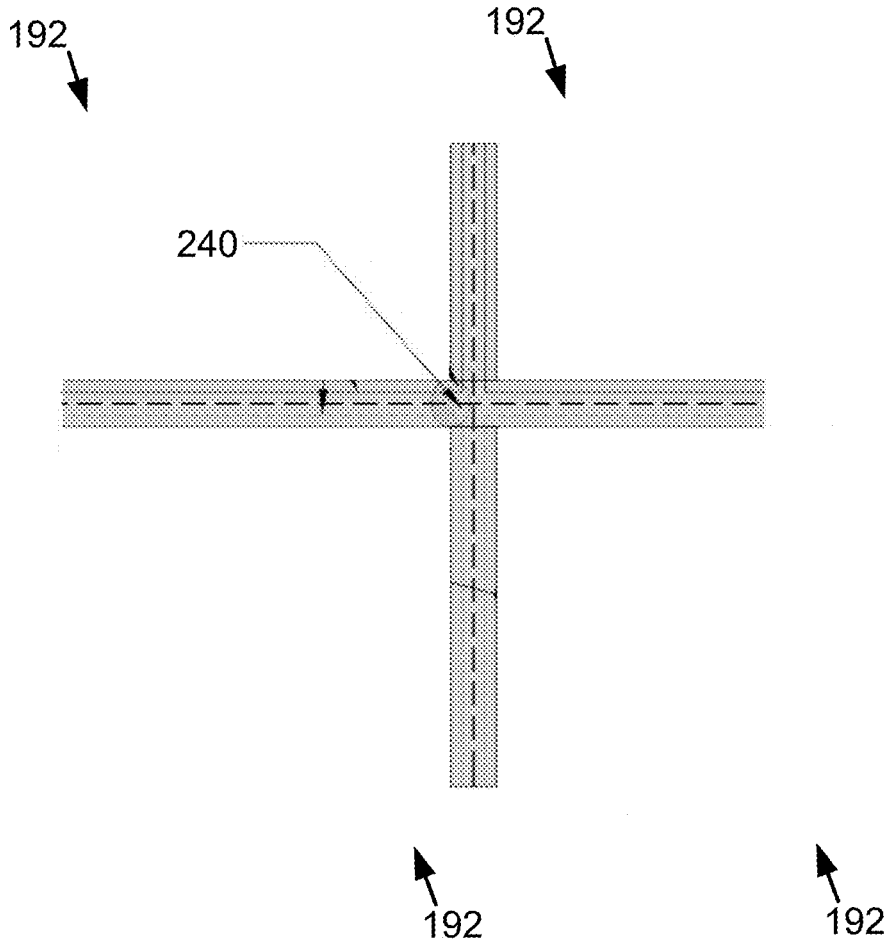
FIG. 77 is a plan view of four horizontally adjacent roofing modules, showing site-applied sealant.

Referring to FIG. 77, in some embodiments sealant 240 is installed on-site, such as being applied at the intersection of four horizontally adjacent roofing modules 192, to seal the intersecting roofing modules 192 of a given modular building.

In variations of embodiments, the module flashing 104 (FIG. 22) can be applied to any given module 10, including to the bottom and/or top of a foundation (not shown) and/or a roofing module 192 of a modular building.

Thus, there is provided a module for a modular building, the module comprising a male connector projecting from a first side of the module to form a projection terminated by a terminus having a hemispherical shape, the male connector being dimensioned for being received by a female connector having an aperture dimensioned to receive said terminus and at least a portion of said projection so as to permit the module to be connected to the female connector by off-level installation.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

What is claimed is:

1. A pair of mating modules for a modular building, the pair comprising a first module and a second module, the first module comprising a male connector projecting from a first side of the first module to form a cylindrical projection terminated by a terminus having a hemispherical shape, the second module comprising a female connector comprising a rigid plate having therethrough an aperture dimensioned to receive said terminus and at least a portion of said cylindrical projection so as to permit the first be connected to the second module by off-level installation, the pair of mating modules further comprising a second-side female connector disposed on a second side of the first module opposite the first side, the second-side female connector comprising a rigid plate having therethrough an aperture dimensioned to receive a corresponding said male connector of a corresponding module of the modular building.

2. The pair of mating modules of claim 1 wherein at least one of the first and second modules further comprises a module gasket for rendering the at least one of the first and second modules self-sealing.

3. A modular building comprising a plurality of modules, each module of the plurality of modules comprising a first male connector projecting from a first side of said each module to form a cylindrical projection terminated by a terminus having a hemispherical shape, the first male connector being dimensioned for being received by a first female connector having an aperture dimensioned to receive said terminus and at least a portion of said cylindrical projection so as to permit said each module to be connected to the first female connector by off-level installation, wherein the plurality of modules comprises a first module comprising the first male connector and a second module comprising the first female connector, the first male connector being connected to the first female connector when the modular building is assembled, the first female connector comprising a rigid plate defining the aperture.

4. The modular building of claim 3 wherein the plurality of modules comprises at least one module gasket for rendering at least one module of the plurality of modules self-sealing.

5. The modular building of claim 3 wherein the plurality of modules comprises a gasketed roofing module and a gasket-receiving roofing module.

6. The modular building of claim 4 wherein the plurality of modules comprises a gasketed roofing module and a gasket-receiving roofing module.

7. The modular building of claim 3 wherein the plurality of modules further comprises a second female connector disposed on a second side of said each module opposite the first side, the second female connector comprising a second rigid plate having therethrough a second aperture dimensioned to receive a corresponding said male connector of a corresponding module of the modular building.

8. The modular building of claim 3 wherein the plurality of modules comprises a third module comprising a second said male connector, said first and second male connectors being horizontally adjacent to each other when the modular building is assembled, the modular building further comprising at least one spacer plate dimensioned for being received by said first and second male connectors.

9. The modular building of claim 8 wherein at least one of said first and third module comprises a module gasket for rendering said at least one of first and third module self-sealing.

10. The modular building of claim 3 further comprising a bolt for attaching the first male connector and the first female connector to each other.

11. The modular building of claim 3 further comprising a key-lock system for locking the first male connector and the first female connector to each other.

12. The modular building of claim 11 wherein the key-lock system comprises a key-lock male connector comprising at least one key, the key-lock system further comprising a key-lock female connector comprising a key-lock plate defining a key slot, the key-lock male connector being rotatable when connected to the key-lock female connector such that said at least one key locks against the key-lock plate when said at least one key is not aligned with the key slot.

13. A method of assembling a modular building having a first module having a male connector and a second module having a female connector dimensioned for receiving the male connector, the method comprising:

(a) off-level contacting a hemispherical terminus of the male connector to the female connector;

(b) aligning the first and second modules such that a cylindrical projection member of the male connector is received by the female connector and the first module becomes connected to the second module by off-level installation; and (c) attaching the male connector to the female connector by bolting the male connector to the female connector.

14. The method of claim 13 wherein attaching the male connector to the female connector comprises bolting the male connector to an adjacent male connector of a third module of the modular building.

15. The method of claim 14 wherein attaching the male connector to the female connector comprises locking the male connector to the female connector by a key-lock system.

16. A modular building comprising a plurality of modules, each module of the plurality of modules comprising a first male connector projecting from a first side of the module to form a cylindrical projection terminated by a terminus having a hemispherical shape, the first male connector being dimensioned for being received by a first female connector having an aperture dimensioned to receive said terminus and at least a portion of said cylindrical projection so as to permit said each module to be connected to the first female connector by off-level installation, the plurality of modules further comprising a first module comprising the first male connector and a second module comprising the first female connector, the first male connector being connected to the first female connector when the modular building is assembled, the modular building further comprising at least one of a bolt for attaching the first male connector and the first female connector to each other and a key-lock system for locking the first male connector and the first female connector to each other.

17. The modular building of claim 16 wherein the key-lock system comprises a key-lock male connector comprising at least one key, the key-lock system further comprising a key-lock female connector comprising a key-lock plate defining a key slot, the key-lock male connector being rotatable when connected to the key-lock female connector such that said at least one key locks against the key-lock plate when said at least one key is not aligned with the key slot.

18. The method of claim 13 wherein step (b) comprises aligning the first and second modules such that the cylindrical projection member is received by an aperture of the female connector comprising a rigid plate for defining the aperture.

* * * * *